US008212726B2

(12) United States Patent
Baliarda et al.

(10) Patent No.: US 8,212,726 B2
(45) Date of Patent: Jul. 3, 2012

(54) SPACE-FILLING MINIATURE ANTENNAS

(75) Inventors: Carles Puente Baliarda, Barcelona (ES); Edouard Jean Louis Rozan, Barcelona (ES); Jaume Anguera Pros, Barcelona (ES)

(73) Assignee: Fractus, SA, Barcelona (ES)

( * ) Notice: Subject to any disclaimer, the term of this patent is extended or adjusted under 35 U.S.C. 154(b) by 220 days.

(21) Appl. No.: 12/347,462

(22) Filed: Dec. 31, 2008

(65) Prior Publication Data

US 2009/0109101 A1 Apr. 30, 2009

Related U.S. Application Data

(60) Continuation of application No. 11/686,804, filed on Mar. 15, 2007, which is a division of application No. 11/179,250, filed on Jul. 12, 2005, now Pat. No. 7,202,822, which is a continuation of application No. 11/110,052, filed on Apr. 20, 2005, now Pat. No. 7,148,850, which is a continuation of application No. 10/182,635, filed as application No. PCT/EP00/00411 on Jan. 19, 2000, now abandoned.

(51) Int. Cl.
*H01Q 1/38* (2006.01)

(52) U.S. Cl. ..... 343/700 MS; 343/702; 343/767; 343/866

(58) Field of Classification Search ..... 343/700 MS, 343/702, 767, 866, 795, 792.5, 806
See application file for complete search history.

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altmayer |
| 3,622,890 | A | 11/1971 | Fujimoto et al. |
| 3,683,379 | A | 8/1972 | Pronovost |
| 3,818,490 | A | 6/1974 | Leahy |
| 3,967,276 | A | 6/1976 | Goubau |
| 3,969,730 | A | 7/1976 | Fuchser |
| 4,021,810 | A | 5/1977 | Urpo et al. |
| 4,024,542 | A | 5/1977 | Ikawa et al. |
| 4,072,951 | A | 2/1978 | Kaloi |
| 4,131,893 | A | 12/1978 | Munson et al. |
| 4,141,016 | A | 2/1979 | Nelson |
| 4,381,566 | A | 4/1983 | Kane |
| 4,471,358 | A | 9/1984 | Glasser |

(Continued)

FOREIGN PATENT DOCUMENTS

AU 5984099 4/2001

(Continued)

OTHER PUBLICATIONS

Anguera, J, et al.; A procedure to design wide-band electromagnetically-coupled stacked microstrip antennas based on a simple network model; IEEE Antennas and Propagation Society International Symposium; Jul. 11, 2007.

(Continued)

*Primary Examiner* — Hoang V Nguyen
(74) *Attorney, Agent, or Firm* — Howison & Arnott, L.L.P.

(57) ABSTRACT

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

127 Claims, 25 Drawing Sheets

U.S. PATENT DOCUMENTS

| | | | |
|---|---|---|---|
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,623,894 | A | 11/1986 | Lee et al. |
| 4,628,322 | A | 12/1986 | Marko |
| 4,673,948 | A | 6/1987 | Kuo |
| 4,723,305 | A | 2/1988 | Phillips et al. |
| 4,730,195 | A | 3/1988 | Phillips et al. |
| 4,752,968 | A | 6/1988 | Lindenmeier |
| 4,827,266 | A | 5/1989 | Sato |
| 4,839,660 | A | 6/1989 | Hadzoglou |
| 4,843,468 | A | 6/1989 | Drewery |
| 4,847,629 | A | 7/1989 | Shimazaki |
| 4,849,766 | A | 7/1989 | Inaba et al. |
| 4,857,939 | A | 8/1989 | Shimazaki |
| 4,890,114 | A | 12/1989 | Egashira |
| 4,894,663 | A | 1/1990 | Urbish et al. |
| 4,907,011 | A | 3/1990 | Kuo |
| 4,912,481 | A | 3/1990 | Mace et al. |
| 4,975,711 | A | 12/1990 | Lee |
| 5,030,963 | A | 7/1991 | Tadama |
| 5,138,328 | A | 8/1992 | Zibrik et al. |
| 5,168,472 | A | 12/1992 | Lockwood |
| 5,172,084 | A | 12/1992 | Fiedzuiszko et al. |
| 5,200,756 | A | 4/1993 | Feller |
| 5,214,434 | A | 5/1993 | Hsu |
| 5,218,370 | A | 6/1993 | Blaese |
| 5,227,804 | A | 7/1993 | Oda |
| 5,227,808 | A | 7/1993 | Davis |
| 5,245,350 | A | 9/1993 | Sroka |
| 5,248,988 | A | 9/1993 | Makimo |
| 5,255,002 | A | 10/1993 | Day |
| 5,257,032 | A | 10/1993 | Diamond et al. |
| 5,337,065 | A | 8/1994 | Bonnet |
| 5,347,291 | A | 9/1994 | Moore |
| 5,355,144 | A | 10/1994 | Walton et al. |
| 5,355,318 | A | 10/1994 | Dionnet et al. |
| 5,373,300 | A | 12/1994 | Jenness et al. |
| 5,402,134 | A | 3/1995 | Miller et al. |
| 5,420,599 | A | 5/1995 | Erkocevic |
| 5,422,651 | A | 6/1995 | Chang |
| 5,451,965 | A | 9/1995 | Matsumoto |
| 5,451,968 | A | 9/1995 | Emery |
| 5,453,751 | A | 9/1995 | Tsukamoto et al. |
| 5,457,469 | A | 10/1995 | Diamond et al. |
| 5,471,224 | A | 11/1995 | Barkeshli |
| 5,493,702 | A | 2/1996 | Crowley et al. |
| 5,495,261 | A | 2/1996 | Baker et al. |
| 5,508,709 | A | 4/1996 | Krenz et al. |
| 5,534,877 | A | 7/1996 | Sorbello et al. |
| 5,537,367 | A | 7/1996 | Lockwood et al. |
| 5,569,879 | A | 10/1996 | Gloton et al. |
| H001631 | H | 2/1997 | Montgomery et al. |
| 5,619,205 | A | 4/1997 | Johnson |
| 5,684,672 | A | 11/1997 | Karidis et al. |
| 5,712,640 | A | 1/1998 | Andou et al. |
| 5,767,811 | A | 6/1998 | Mandai et al. |
| 5,784,032 | A | 7/1998 | Johnston et al. |
| 5,798,688 | A | 8/1998 | Schofield |
| 5,821,907 | A | 10/1998 | Zhu et al. |
| 5,838,285 | A | 11/1998 | Tay |
| 5,841,402 | A | 11/1998 | Dias et al. |
| 5,841,403 | A | 11/1998 | West |
| 5,870,066 | A | 2/1999 | Asakura et al. |
| 5,872,546 | A | 2/1999 | Ihara et al. |
| 5,898,404 | A | 4/1999 | Jou |
| 5,903,240 | A | 5/1999 | Kawahata et al. |
| 5,926,141 | A | 7/1999 | Lindenmeier et al. |
| 5,936,583 | A | 8/1999 | Sekine et al. |
| 5,943,020 | A | 8/1999 | Liebendoerfer et al. |
| 5,966,098 | A | 10/1999 | Qi et al. |
| 5,973,651 | A | 10/1999 | Suesada et al. |
| 5,986,609 | A | 11/1999 | Spall |
| 5,986,610 | A | 11/1999 | Miron |
| 5,986,615 | A | 11/1999 | Westfall et al. |
| 5,990,838 | A | 11/1999 | Burns et al. |
| 5,995,052 | A | 11/1999 | Sadler et al. |
| 6,002,367 | A | 12/1999 | Engblom et al. |
| 6,005,524 | A | 12/1999 | Hayes et al. |
| 6,016,130 | A | 1/2000 | Annamaa |
| 6,028,568 | A | 2/2000 | Asakura et al. |
| 6,031,499 | A | 2/2000 | Dichter |
| 6,031,505 | A | 2/2000 | Qi et al. |
| 6,040,803 | A | 3/2000 | Spall |
| 6,058,211 | A | 5/2000 | Bormans |
| 6,069,592 | A | 5/2000 | Wass |
| 6,075,489 | A | 6/2000 | Sullivan |
| 6,075,500 | A | 6/2000 | Kurz et al. |
| 6,078,294 | A | 6/2000 | Mitarai |
| 6,091,365 | A | 7/2000 | Derneryd et al. |
| 6,097,345 | A | 8/2000 | Walton |
| 6,104,349 | A * | 8/2000 | Cohen ..... 343/702 |
| 6,111,545 | A | 8/2000 | Saari |
| 6,127,977 | A | 10/2000 | Cohen |
| 6,131,042 | A | 10/2000 | Lee et al. |
| 6,140,969 | A | 10/2000 | Lindenmeier et al. |
| 6,140,975 | A | 10/2000 | Cohen |
| 6,147,649 | A | 11/2000 | Ivrissimtzis |
| 6,147,652 | A | 11/2000 | Sekine |
| 6,157,344 | A | 12/2000 | Bateman |
| 6,160,513 | A | 12/2000 | Davidson et al. |
| 6,172,618 | B1 | 1/2001 | Hazokai et al. |
| 6,181,281 | B1 | 1/2001 | Desclos et al. |
| 6,181,284 | B1 | 1/2001 | Madsen et al. |
| 6,211,824 | B1 | 4/2001 | Holden et al. |
| 6,211,889 | B1 | 4/2001 | Stoutamire |
| 6,218,992 | B1 | 4/2001 | Sadler et al. |
| 6,236,372 | B1 | 5/2001 | Lindenmeier et al. |
| 6,239,765 | B1 | 5/2001 | Johnson et al. |
| 6,243,592 | B1 | 6/2001 | Nakada |
| 6,266,023 | B1 | 7/2001 | Nagy et al. |
| 6,272,356 | B1 | 8/2001 | Dolman et al. |
| 6,281,846 | B1 | 8/2001 | Puente Baliarda et al. |
| 6,281,848 | B1 | 8/2001 | Nagumo |
| 6,285,342 | B1 | 9/2001 | Brady et al. |
| 6,292,154 | B1 | 9/2001 | Deguchi et al. |
| 6,300,910 | B1 | 10/2001 | Kim |
| 6,300,914 | B1 | 10/2001 | Yang |
| 6,301,489 | B1 | 10/2001 | Winstead et al. |
| 6,307,511 | B1 | 10/2001 | Ying et al. |
| 6,307,512 | B1 | 10/2001 | Geeraert |
| 6,327,485 | B1 | 12/2001 | Waldron |
| 6,329,951 | B1 | 12/2001 | Wen et al. |
| 6,329,954 | B1 | 12/2001 | Fuchs et al. |
| 6,329,962 | B2 | 12/2001 | Ying |
| 6,333,716 | B1 | 12/2001 | Pontoppidan |
| 6,343,208 | B1 | 1/2002 | Ying |
| 6,346,914 | B1 | 2/2002 | Annamaa |
| 6,353,443 | B1 | 3/2002 | Ying |
| 6,360,105 | B2 | 3/2002 | Nakada et al. |
| 6,367,939 | B1 | 4/2002 | Carter et al. |
| 6,373,447 | B1 | 4/2002 | Rostoker et al. |
| 6,380,902 | B2 | 4/2002 | Duroux |
| 6,388,626 | B1 | 5/2002 | Gamalielsson et al. |
| 6,407,710 | B2 | 6/2002 | Keilen et al. |
| 6,408,190 | B1 | 6/2002 | Ying |
| 6,417,810 | B1 | 7/2002 | Huels et al. |
| 6,417,816 | B2 | 7/2002 | Sadler et al. |
| 6,421,013 | B1 | 7/2002 | Chung |
| 6,431,712 | B1 | 8/2002 | Turnbull |
| 6,445,352 | B1 | 9/2002 | Cohen |
| 6,452,549 | B1 | 9/2002 | Lo |
| 6,452,553 | B1 | 9/2002 | Cohen |
| 6,476,766 | B1 | 11/2002 | Cohen |
| 6,483,462 | B2 | 11/2002 | Weinberger |
| 6,496,154 | B2 | 12/2002 | Gyenes |
| 6,525,691 | B2 | 2/2003 | Varadan et al. |
| 6,538,604 | B1 | 3/2003 | Isohatala |
| 6,552,690 | B2 | 4/2003 | Veerasamy |
| 6,603,434 | B2 | 8/2003 | Lindenmeier et al. |
| 6,697,024 | B2 | 2/2004 | Fuerst et al. |
| 6,707,428 | B2 | 3/2004 | Gram |
| 6,756,944 | B2 | 6/2004 | Tessier et al. |
| 6,784,844 | B1 | 8/2004 | Boakes et al. |

| | | | |
|---|---|---|---|
| 6,839,040 | B2 | 1/2005 | Huber |
| 6,928,413 | B1 | 8/2005 | Pulitzer |
| 2001/0002823 | A1 | 6/2001 | Ying |
| 2001/0050636 | A1 | 12/2001 | Weinberger |
| 2002/0000940 | A1 | 1/2002 | Moren et al. |
| 2002/0109633 | A1 | 8/2002 | Ow et al. |
| 2002/0175879 | A1 | 11/2002 | Sabet |
| 2003/0090421 | A1 | 5/2003 | Sajadinia |

FOREIGN PATENT DOCUMENTS

| | | | |
|---|---|---|---|
| DE | 3337941 | | 5/1985 |
| DE | 101 42 965 | | 3/2003 |
| EP | 0096847 | | 12/1983 |
| EP | 0297813 | | 1/1989 |
| EP | 0358090 | | 3/1990 |
| EP | 0396033 | A2 | 11/1990 |
| EP | 0543645 | | 5/1993 |
| EP | 0571124 | | 11/1993 |
| EP | 0620677 | A1 | 10/1994 |
| EP | 0688040 | | 12/1995 |
| EP | 0736926 | A1 | 10/1996 |
| EP | 0765001 | | 3/1997 |
| EP | 0823748 | A2 | 8/1997 |
| EP | 0825672 | A2 | 8/1997 |
| EP | 0814536 | | 12/1997 |
| EP | 0 843 905 | | 5/1998 |
| EP | 0871238 | | 10/1998 |
| EP | 0892459 | | 1/1999 |
| EP | 0929121 | | 7/1999 |
| EP | 0932219 | | 7/1999 |
| EP | 0938158 | A2 | 8/1999 |
| EP | 0942488 | | 9/1999 |
| EP | 0969375 | | 1/2000 |
| EP | 0986130 | | 3/2000 |
| EP | 0997974 | | 5/2000 |
| EP | 1011167 | A1 | 6/2000 |
| EP | 1016158 | B1 | 7/2000 |
| EP | 1018777 | | 7/2000 |
| EP | 1018779 | | 7/2000 |
| EP | 1 024 552 | | 8/2000 |
| EP | 1 026 774 | | 8/2000 |
| EP | 1071161 | | 1/2001 |
| EP | 1079462 | | 2/2001 |
| EP | 1 083 623 | | 3/2001 |
| EP | 1083624 | | 3/2001 |
| EP | 1 091 446 | | 4/2001 |
| EP | 1094545 | | 4/2001 |
| EP | 1096602 | | 5/2001 |
| EP | 1 126 522 | | 8/2001 |
| EP | 1148581 | | 10/2001 |
| EP | 1198027 | | 4/2002 |
| EP | 1237224 | | 9/2002 |
| EP | 1267438 | | 12/2002 |
| EP | 0924793 | B1 | 3/2003 |
| EP | 1 317 018 | | 6/2003 |
| EP | 1 326 302 | | 7/2003 |
| EP | 1 374 336 | | 1/2004 |
| EP | 1 396 906 | | 3/2004 |
| EP | 1 414 106 | | 4/2004 |
| EP | 1 453 140 | | 9/2004 |
| EP | 0843905 | B1 | 12/2004 |
| EP | 1515392 | A2 | 3/2005 |
| ES | 2112163 | | 3/1998 |
| ES | 2142280 | | 5/1998 |
| ES | 200001508 | | 1/2002 |
| ES | 2174707 | | 11/2002 |
| FR | 2543744 | | 10/1984 |
| FR | 2704359 | | 10/1994 |
| FR | 2837339 | | 9/2003 |
| GB | 1313020 | | 4/1973 |
| GB | 2 161 026 | | 1/1986 |
| GB | 2215136 | | 9/1989 |
| GB | 2 293 275 | | 3/1996 |
| GB | 2330951 | | 5/1999 |
| GB | 2355116 | | 4/2001 |
| JP | 55-147806 | | 11/1980 |
| JP | 5007109 | | 1/1993 |
| JP | 5129816 | | 5/1993 |
| JP | 5267916 | | 10/1993 |
| JP | 5347507 | | 12/1993 |
| JP | 6204908 | | 7/1994 |
| JP | 773310 | | 3/1995 |
| JP | 8052968 | A1 | 2/1996 |
| JP | 09-069718 | | 3/1997 |
| JP | 9 199 939 | | 7/1997 |
| JP | 10209744 | | 8/1998 |
| SE | 5 189 88 | | 12/2002 |
| WO | 93/12559 | | 6/1993 |
| WO | 95/11530 | | 4/1995 |
| WO | 96/27219 | | 9/1996 |
| WO | 96/29755 | | 9/1996 |
| WO | 96/68881 | | 12/1996 |
| WO | 97/06578 | | 2/1997 |
| WO | 97/07557 | | 2/1997 |
| WO | 97/11507 | | 3/1997 |
| WO | 97/32355 | | 9/1997 |
| WO | 97/33338 | | 9/1997 |
| WO | 97/35360 | | 9/1997 |
| WO | 97/47054 | | 12/1997 |
| WO | 98/12771 | | 3/1998 |
| WO | 98/36469 | | 8/1998 |
| WO | 99/03166 | | 1/1999 |
| WO | 99/03167 | | 1/1999 |
| WO | 99/25042 | | 5/1999 |
| WO | 99/25044 | | 5/1999 |
| WO | 99/27608 | | 6/1999 |
| WO | 9943039 | A1 | 8/1999 |
| WO | 99/56345 | | 11/1999 |
| WO | 00/01028 | | 1/2000 |
| WO | 00/03167 | | 1/2000 |
| WO | 00/03453 | | 1/2000 |
| WO | 00/22695 | | 4/2000 |
| WO | 0025266 | A1 | 5/2000 |
| WO | 00/36700 | | 6/2000 |
| WO | 0034916 | A1 | 6/2000 |
| WO | 00/49680 | | 8/2000 |
| WO | 00/52784 | | 9/2000 |
| WO | 00/52787 | | 9/2000 |
| WO | 00/65686 | | 11/2000 |
| WO | 00/77884 | | 12/2000 |
| WO | 0077728 | A1 | 12/2000 |
| WO | 01/03238 | | 1/2001 |
| WO | 01/05048 | | 1/2001 |
| WO | 01/82410 | | 1/2001 |
| WO | 01/08254 | | 2/2001 |
| WO | 01/08257 | | 2/2001 |
| WO | 01/08260 | | 2/2001 |
| WO | 01/11721 | | 2/2001 |
| WO | 01/13464 | | 2/2001 |
| WO | 0108093 | A1 | 2/2001 |
| WO | 01/15271 | | 3/2001 |
| WO | 01/17063 | | 3/2001 |
| WO | 01/17064 | | 3/2001 |
| WO | 01/20714 | | 3/2001 |
| WO | 01/20927 | | 3/2001 |
| WO | 01/22528 | | 3/2001 |
| WO | 01/24314 | | 4/2001 |
| WO | 01/26182 | | 4/2001 |
| WO | 01/28035 | | 4/2001 |
| WO | 01/31739 | | 5/2001 |
| WO | 01/33663 | | 5/2001 |
| WO | 01/33664 | | 5/2001 |
| WO | 01/33665 | | 5/2001 |
| WO | 01/35491 | | 5/2001 |
| WO | 01/35492 | | 5/2001 |
| WO | 01/37369 | | 5/2001 |
| WO | 01/37370 | | 5/2001 |
| WO | 01/41252 | | 6/2001 |
| WO | 01/47056 | | 6/2001 |
| WO | 01/48860 | | 7/2001 |
| WO | 01/48861 | | 7/2001 |
| WO | 01/54225 | | 7/2001 |
| WO | 01/65636 | | 9/2001 |
| WO | 01/73890 | | 10/2001 |
| WO | 01/78192 | | 10/2001 |
| WO | 01/86753 | | 11/2001 |
| WO | 01/89031 | | 11/2001 |
| WO | 02/35646 | | 5/2002 |

| | | |
|---|---|---|
| WO | 02/35652 | 5/2002 |
| WO | 02/078121 | 10/2002 |
| WO | 02/078123 | 10/2002 |
| WO | 02/078124 | 10/2002 |
| WO | 02/080306 | 10/2002 |
| WO | 02/084790 | 10/2002 |
| WO | 02/091518 | 11/2002 |
| WO | 02/095874 | 11/2002 |
| WO | 02/096166 | 11/2002 |
| WO | 03/017421 | 2/2003 |
| WO | 03/023900 | 3/2003 |
| WO | 2005/076933 | 8/2005 |
| WO | 2005/081358 | 9/2005 |

OTHER PUBLICATIONS

Balanis, Constantine A.; Traveling Wave and Broadband Antennas; Antenna Theory—Analysis and design—Chapter 10; Hamilton Printing; 1982, pp. 498-499.
Garg, R. et al.; Microstrip antenna design handbook; Artech House; Jan. 1, 2001.
James, J.R.; Handbook of microstrip antennas—Chapter 7; Institution of Electrical Engineers; Jan. 2, 1989.
Peitgen et al.; Chaos and fractals. New frontiers of science; Feb. 12, 1993.
Waterhouse, R.B.; Small printed antennas with low cross-polarised fields; Electronic letters; Jul. 17, 1997; pp. 1280-1281; vol. 33, No. 15.
Chu, J.L., Physical limitations of omni-directional antennas, Journal of Applied Physics, Dec. 1948.
Wheeler, Fundamental limitations of small antennas, Proceedings of the I.R.E., 1947.
Addison, P. S., Fractals and chaos, Institute of Physics Publishing, 1997.
Falconer, K., Fractal geometry. Mathematical foundations and applications, Wiley, 2003.
Carver, K.R.; Mink, J.W., "Microstrip antenna technology", IEEE Transactions on Antennas and Propagation, Jan. 1981 in Microstrip antennas. The analysis and design of microstrip antennas and arrays, Pozar-Schaubert, 1995.
Chapters: 6) Wheeler, H.A. "Small antennas", 7) Munson, R.E. "Microstrip antennas", 14) Duhamel, R.H.; Scherer, J.P. "Frequency-independent antennas", 23) OFFUTT, W.B.; Desize, L.K. "Methods of polarization synthesis" in Antenna engineering handbook, McGraw-Hill, 1993.
Kraus, J.D., Antennas, McGraw-Hill, 1988, p. 354-358.
Garg, R.; Bahl, I.J., Characteristics of coupled microstriplines, IEEE Transactions on microwave theory and techniques, Jul. 1979.
Tang, Y.Y. et al, The application of fractal analysis to feature extraction, IEEE, 1999.
Ng, V.; Coldman, A., Diagnosis of melanoma withn fractal dimensions, IEEE Tencon'93, 1993.
Kobayashi, K. et al, Estimation of 3D fractal dimension of real electrical tree patterns, Proceedings of the 4th International Conference on Properties and Applications of Dielectric Materials, Jul. 1994.
Feng. J. et al, Fractional box-counting approach to fractal dimension estimation, IEEE, 1996.
Rouvier, R. et al, Fractal analysis of bidimensional profiles and application to electromagnetic scattering from soils, IEEE, 1996.
Sarkar, N.; Chaudhuri, B.B., An efficient differential box-counting approach to compute fractal dimension of image, IEEE Transactions on System, Man and Cybernetics, Jan. 3, 1994.
Chen, S., et al, On the calculation of Fractal features from images, IEEE Transactions on Pattern Analysis and Machine Intelligence, Oct. 1993.
Penn, A.I., et al, Fractal dimension of low-resolution medical images, 18th annual international conference of the IEEE Engineering in Medicine and Biology Society, 1996.
Berizzi, F.; Dalle-Mese, E., Fractal analysis of the signal scattered from the sea surface, IEEE Transactions on Antennas and Propagation, Feb. 1999.
Boshoff, H.F.V., A fast box counting algorithm for determining the fractal dimension of sampled continuous functions, IEEE, 1992.
Chapters: 1) "Counting and number systems", 3) "Meanders and fractals" and 5) "The analysis of a fractal" in Lauwerier, H., Fractals. Endlessly repeated geometrical figures, Princeton University Press, 1991.
Romeu, J. et al, Small fractal antennas, Fractals in engineering conference, India, Jun. 1999.
Russell, D. A., Dimension of strange attractors, Physical Review Letters, vol. 45, No. 14, Oct. 1980.
So, P. et al, Box-counting dimension without boxes—Computing D0 from average expansion, Physical Review E, vol. 60, No. 1, Jul. 1999.
Prokhorov, A.M., Bolshaya Sovetskaya Entsiklopediya, Sovetskaya Entsiklopediya, 1976, vol. 24, Book 1, p. 67.
Model, A.M., Microwave filters in radio relay systems, Moscow, Svyaz, 1967, p. 108-109.
Pozar, D.M., Microstrip antennas, Proceedings of the IEEE, 1992.
G. James, J.R.; Hall, P.S., Handbook of microstrip antennas, IEE, 1989, vol. 1, p. 355-357.
Navarro, M., Diverse modifications applied to the Sierpinski antenna, a multi-band fractal antenna (final degree project), Universitat Politècnica de Catalunya, Oct. 1997.
Neary, D., Fractal methods in image analysis and coding, Dublin City University—School of Electronic Engineering, Jan. 22, 2001.
Breden , R. et al, Printed fractal antennas, National conference on antennas and propagation, Apr. 1999.
Cohen , N. et al, Fractal loops and the small loop approximation—Exploring fractal resonances, Communications quarterly, Dec. 1996.
Gobien, Andrew T., "Investigation of Low Profile Antenna Designs for Use in Hand-Held Radios" (Thesis), Aug. 1, 1997, Faculty of the Virginia Polytechnic Institute and State University, Blacksburg, Virginia, U.S.A.
Werner et al. Radiation characteristics of thin-wire ternary fractal trees, Electronics Letters, 1999, vol. 35, No. 8.
Hoffmeister, M., The dual frequency inverted f monopole antenna for mobile communications, 1999.
Kutter, R.E., Fractal antenna design, Bee, University of Dayton, Ohio, 1996.
Davidson, B. et al. Wideband helix antenna for PDC diversity, International Congress, Molded Interconnect Devices, Sep. 1998.
Breden, R. et al. Multiband printed antenna for vehicles, 1999.
Dr. Carles Puente Baliarda; Fractal Antennas; Ph. D. Dissertation; May 1997; Cover page—p. 270; Electromagnetics and Photonics Engineering group, Dept. of Signal Theory and Communications, Universtat Poltecnica de Catalunya; Barcelona, Spain.
Oscar Campos Escala; Study of Multiband and Miniature Fractal Antennas; Final Year Project; Cover Page—119 plus translation; Superior Technical Engineering School of Telecommunications, Barcelona Polytechnic University, Barcelona, Spain.
Oriol Verdura Contrras; Fractal Miniature Antenna; Final Year Project; Sep. 1997; Cover Page—61 plus translation; UPC Baix Llobregat Polytechnic University; Barcelona Spain.
E.A. Parker and A.N.A. El Sheikh; Convoluted Dipole Array Elements; Electronic Letters; Feb. 14, 1001; pp. 322-333; vol. 27, No. 4; IEE; United Kingdom.
Carmen Borja Borau; Antennas Fractales Microstrip (Microstrip Fractal Antennas); Thesis; 1997; Cover Page—Biblografia p. 3 (261 pages); E.T.X. d'Enginyeria de Telecomunicacio; Barcelona, Spain.
Chien-Jen Wang and Christina F. Jou, "Compact Microstrip Meander Antenna," IEEE Microwave and Optical Technology Letters, vol. 22, No. 6, pp. 413-414, Sep. 20, 1999.
H.Y. Wang and M.J. Lancaster, "Aperture-Coupled Thin-Film Superconducting Meander Antennas," IEEE Transactions on Antennas and Propagation, vol. 47, No. 5, pp. 829-836, May 1999.
Christian Braun, Gunnar Engblom and Claes Beckman, "Antenna Diversity for Mobile Telephones," AP-S IEEE, pp. 2220-2223, Jun. 1998.
R.B. Waterhouse, D.M. Kokotoff and F. Zavosh, "Investigation of Small Printed Antennas Suitable for Mobile Communication Handsets," AP-S IEEE, pp. 1946-1949, Jun. 1998.
Terry Kin-Chung Lo and Yeongming Hwang, "Bandwidth Enhancement of PIFA Loaded with Very High Permitivity Material Using FDTD," AP-S IEEE, pp. 798-801, Jun. 1998.

Jui-Han Lu and Kai-Ping Yang, "Slot-Coupled Compact Triangular Microstrip Antenna With Lumped Load," AP-S IEEE, pp. 916-919, Jun. 1998.
Hua-Ming Chen and Kin-Lu Wong, "On the Circular Plarization Operation of Annular-Ring Microstrip Antennas," IEEE Transactions on Antennas and Propagation, vol. 47, No. 8, pp. 1289-1292, Aug. 1999.
Choon Sae Lee and Vahakn Nalbandian, "Planar Circularly Polarized Microstrip Antenna with a Single Feed," IEEE Transactions on Antennas and Propagation, vol. 47, No. 6, pp. 1005-1007, Jun. 1999.
Chih-Yu Huang, Jian-Yi Wu and Kin-Lu Wong, "Cross-Slot-Coupled Microstrip Antenna and Dielectric Resonator Antenna for Circular Polarization," IEEE Transactions on Antennas and Propagation, vol. 47, No. 4, pp. 605-609, Apr. 1999.
David M. Kokotoff, James T. Aberle and Rod B. Waterhouse, "Rigorous Analysis of Probe-Fed Printed Annular Ring Antennas," IEEE Transactions on Antennas and Propagation, vol. 47, No. 2, pp. 384-388, Feb. 1999.
Rod Be Waterhouse, S.D. Targonski and D.M. Kokotoff, Design and Performance of Small Printed Antennas, IEEE Transactions on Antennas and Propagation, vol. 46, No. 11, pp. 1629-1633, Nov. 1998.
Yan Wai Chow, Edward Kai Ning Yung, Kim Fung Tsand and Hon Tat Hiu, "An Innovative Monopole Antenna for Mobile-Phone Handsets," Microwave and Optical Technology Letters, vol. 25, No. 2, pp. 119-121, Apr. 20, 2000.
Wen-Shyang Chen, "Small Circularly Polarized Microstrip Antennas," AP-S IEEE, pp. 1-3, Jul. 1999.
W.K. Lam and Edward K.N. Yung, "A Novel Leaky Wave Antenna for the Base Station in an Innovative Indoors Cellular Mobile Communication System," AP-S IEEE, Jul. 1999.
H. Iwasaki, "A circularly Polarized Small-Size Microstrop Antenna with a Cross Slot," IEEE Transactions on Antennas and Propagation, vol. 44, No. 10, pp. 1399-1401, Oct. 1996.
Choon Sae Lee and Pi-Wei Chen, "Electrically Small Microstrip Antennas," IEEE, 2000.
Jui-Han Lu, Chia-Luan Tang and Kin-Lu Wong, "Slot-Coupled Small Triangular Microstrip Antenna," Microwave and Optical Technology Letters, vol. 16, No. 6, pp. 371-374, Dec. 20, 1997.
Chia-Luan Tang, Hong-Twu Chen and Kin-Lu Wong, "Small Circular Microstrip Antenna with Dual-Frequency Operation," IEEE Electronic Letters, vol. 33, pp. 1112-1113, Jun. 10, 1997.
R. Waterhouse, "Small Microstrip Patch Antenna," IEEE Electronic Letters, vol. 31, pp. 604-605, Feb. 21, 1995.
R. Waterhouse, "Small Printed Antenna Easily Integrated Into a Mobile Handset Terminal," IEEE Electronic Letters, vol. 34, No. 17, pp. 1629-1631, Aug. 20, 1998.
O. Leisten, Y. Vardaxoglou, T. Schmid, B. Rosenberger, E. Agboraw, N. Kuster and G. Nicolaidis, "Miniature Dielectric-Loaded Personal Telephone Antennas with Low User Exposure," IEEE Electronic Letters, vol. 34, No. 17, pp. 1628-2629, Aug. 20, 1998.
Hua-Ming Chen, "Dual-Frequency Microstrip Antenna with Embedded Reactive Loading," IEEE Microwave and Optical Technology Letters, vol. 23, No. 3, pp. 186-188, Nov. 5, 1999.
Shyh-Timg Fang and Kin-Lu Wong, "A Dual Frequency Equilateral-Traingular Microstrip Antenna with a Pair of Narrow Slots," IEEE Microwave and Optical Technology Letters, vol. 23, No. 2, pp. 82-84, Oct. 20, 1999.
Kin-Lu Wong and Kai-Ping Yang, "Modified Planar Inverter F. Antenna," IEE Electronic Letters, vol. 34, No. 1, pp. 7-8, Jan. 8, 1998.
S.K. Palit, A. Hamadi and D. Tan, "Design of a Wideband Dual-Frequency Notched Microstrip Antenna," AP-S IEEE, pp. 2351-2354, Jun. 1998.
T. Williams, M. Rahman and M.A. Stuchly, "Dual-Band Meander Antenna for Wireless Telephones," IEEE Microwave and Optical Technology Letters, vol. 24, No. 2, pp. 81-85, Jan. 20, 2000.
Nathan Cohen, "Fractal Antennas, Part 1," Communications Quarterly: The Journal of Communications Technology, pp. 7-22, Summer, 1995.
Nathan Cohen, "Fractal and Shaped Dipoles," Communications Quarterly: The Journal of Communications Technology, pp. 25-36, Spring 1995.
Nathan Cohen, "Fractal Antennas, Part 2," Communications Quarterly: The Journal of Communications Technology, pp. 53-66, Summer 1996.
John P. Gianvittorio and Yahya Rahmat-Samii, Fractal Element Antennas; A Compilation of Configurations with Novel Characteristics, IEEE, 2000.
Jacob George, C.K. Aanandan, P. Mohanan and K.G. Nair, "Analysis of a New Compact Microstrip Antenna," IEEE Transactions on Antennas and Propagation, vol. 46, No. 11, pp. 1712-1717, Nov. 1998.
Jungmin Chang and Sangseol Lee, "Hybrid Fractal Cross Antenna," IEEE Microwave and Optical Technology Letters, vol. 25, No. 6, pp. 429-435, Jun. 20, 2000.
Jaume Anguera, Carles Puente, Carmen Borja, Jordi Romeu and Marc Aznar,"Antenas Microstrip Apiladas con Geometria de Anillo," Proceedings of the XIII National Symposium of the Scientific International Union of Radio, URSI '00, Zaragoza, Spain, Sep. 2000.
C. Puente, J. Romeu, R. Pous, J. Ramis and A Hijazo, "La Antena de Koch: Un Monopolo Large Pero Pequeno," XIII Simposium Nacional URSI, vol. 1, pp. 371-373, Pamplona, Sep. 1998.
C. Puente, and R. Pous, "Diseno Fractal de Agrupaciones de Antenas," IX Simposium Nacional URSI, vol. 1, pp. 227-231, Las Palmas, Sep. 1994.
C. Puente, J. Romeu, R. Pous and A. Cardama, "Multiband Fractal Antennas and Arrays," Fractals in Engineering, J.L. Vehel, E. Lutton, C. Tricot editors, Springer, New York, pp. 222-236, 1997.
C. Puente and R. Pous, "Fractal Design of Multiband and Low Side-Lobe Arrays," IEEE Transactions on Antennas and Propagation, vol. 44, No. 5, pp. 730-739, May 1996.
Wong, An improved microstrip sierpinski carpet antenna, Proceedings of APM2001, 2001.
Musser, G. Practical Fractals, Scientific American, Jul. 1999, vol. 281, Num. 1.
Hart, Fractal element antennas, [http://www.manukau.ac.nz/departments/e_e/research/ngaire.pdf]., 2007.
Matsushima, Electromagnetically coupled dielectric chip antenna, IEEE Antennas and Propagation Society International Symposium, 1998, vol. 4.
Smith, Efficiency of electrically small antennas combined with matching networks, IEEE Transactions on Antennas and Propagation, May 1977, vol. AP-25, p. 369-373.
Strugatsky, Multimode multiband antenna, Proceedings of the Tactical Communications Conference, 1992. vol. 1.
Pozar, Comparision of three methods for the measurement of printed antenna efficiency, IEEE Transactions on Antennas and Propagation, Jan. 1988, vol. 36.
Yew-Siow, Dipole configurations with strongly improved radiation efficiency for hand-held transceivers, IEEE Transactions on Antennas and Propagation, 1998, vol. 46, Num. 6.
Arutaki, Communication in a three-layered conducting media with a vertical magnetic dipole, IEEE Transactions on Antennas and Propagation, Jul. 1980, vol. AP-28, Num 4.
Desclos, An interdigitated printed antenna for PC card applications, IEEE Transactions on Antennas and Propagation, Sep. 1998, vol. 46, No. 9.
Hikita et al. Miniature SAW antenna duplexer for 800-MHz portable telephone used in cellular radio systems, IEEE Transactions on Microwave Theory and Techniques, Jun. 1988, vol. 36, No. 6.
Ancona, On small antenna impedance in weakly dessipative media, IEEE Transactions on Antennas and Propagation, Mar. 1978, vol. AP-26, No. 2.
Simpson, Equivalent circuits for electrically small antennas using LS-decomposition with the method of moments, IEEE Transactions on Antennas and Propagation, Dec. 1989, vol. 37, No. 12.
Debicki, Calculating input impedance of electrically small insulated antennas for microwave hyperthermia, IEEE Transactions on Microwave Theory and Techniques, Feb. 1993, vol. 41, No. 2.
McLEAN, A re-examination of the fundamental limits on the radiation Q of electrically small antennas, IEEE Transactions on Antennas and Propagation, May 1996, vol. 44, No. 5.
Muramoto, Characteristics of a small planar loop antenna, IEEE Transactions on Antennas and Propagation, Dec. 1997, vol. 45, No. 12.

Eratuuli, Dual frequency wire antennas, Electronic Letters, Jun. 1996, vol. 32, No. 12.
Ohmine, A TM mode annular-ring microstrip anetenna for personal satellite communication use, IEEE Transactions Communication, Sep. 1996, vol. E-79.
Poilasne, Active Metallic Photonic Band-Gap Materials (MPBG): Experimental Results on Beam Shaper, IEEE Transactions on Antennas and Propagation, Jan. 2000, vol. 48, No. 1.
Omar, A new broad-brand, dual-frequency coplanar waveguide fed slot-antenna, IEEE Antennas and Propagation Society International Symposium, 1999. vol. 2.
Puente, C. et al., "Multiband properties of a fractal tree antenna generated by electrochemical deposition," Electronics Letters, IEE Stevenage, GB, vol. 32, No. 25, pp. 2298-2299, Dec. 5, 1996.
Puente, C. et al., "Small but long Koch fractal monopole," Electronics Letters, IEE Stevenage, GB, vol. 34, No. 1, pp. 9-10, Jan. 8, 1998.
Puente Baliarda, Carles et al., "The Koch Monopole: A Small Fractal Antenna," IEEE Transactions on Antennas and Propagation, New York, vol. 48, No. 11, pp. 1773-1781, Nov. 1, 2000.
Cohen, Nathan, "Fractal Antenna Applications in Wireless Telecommunications," Electronic Industries Forum of New England, 1997, Professional Program Proceedings, Boston, Massachusetts, May 6-8 n1997, IEEE, pp. 43-49, New York, New York, May 6, 1997.
Anguera, J. et al., "Miniature Wideband Stacked Microstrip Patch Antenna Based on the Sierpinski Fractal Geometry," IEEE Antennas and Propagation Society International Symposium, 2000 Digest Aps., vol. 3 of 4, pp. 1700-1703, Jul. 16, 2000.
Hara Prasad, R.V. et al., "Microstrip Fractal Patch Antenna for Multi-Band Communication," Electronics Letter, IEE Stevenage, GB, vol. 36, No. 14, pp. 1179-1180, Jul. 6, 2000.
Borja, C. et al., "High Directivity Fractal Boundary Microstrip Patch Antenna," Electronics Letters, IEE Stevenage, GB, vol. 36, No. 9, pp. 778-779, Apr. 27, 2000.
Hansen, R.C., "Fundamental Limitations in Antennas," Proceedings of the IEEE, vol. 69, No. 2, pp. 170-182, Feb. 1981.
Jaggard, Dwight L., "Fractal Electrodynamics and Modeling," Direction in Electromagnetic Wave Modeling, pp. 435-446, 1991.
Hohlfeld, Robert G. et al., "Self-Similarity and the Geometric Requirements for Frequency Independence in Antennae," Fractals, vol. 7, No. 1, pp. 79-84, 1999.
Samavati, Hirad et al., "Fractal Capacitors," IEEE Journal of Solid-State Circuits, vol. 33, No. 12, pp. 2035-2041, Dec. 1998.
Pribetich, P. et al. "Quasifractal Planar Microstrip Resonators for Microwave Circuits," Microwave and Optical Technology Letters, vol. 21, No. 6, pp. 443-436, Jun. 20, 1999.
Zhang, Dawei, et al., "Narrowband Lumped-Element Microstrip Filters Using Capacitively-Loaded Inductors," IEEE MTT-S Microwave Symposium Digest, pp. 379-382, May 16, 1995.
Gough C.E. et al., "High Te coplanar resonators for microwave applications and scientific studies," Physics C, NL, North-Holland Publishing, Amsterdam, vol. 282-287, No. 2001, pp. 395-398, Aug. 1, 1997.
Book by H. Meinke and F. V. Gundlah, Radio Engineering Reference, vol. 1, Radio components. Circuits with lumped parameters. Transmission lines. Wave-guides. Resonators. Arrays. Radio wave propagation, States Energy Publishing House, Moscow, with English translation, 4 pages, 1961.
V. A. Volgov, "Parts and Units of Radio Electronic Equipment (Design & Computation)," Energiya, Moscow, with English translation, 4 pages, 1967.
Ali, M. et al., "A Triple-Band Internal Antenna for Mobile Hand-held Terminals," IEEE, pp. 32-35, 1992.
Romeu, Jordi et al., "A Three Dimensional Hilbert Antenna," IEEE, pp. 550-553, 2002.
Parker et al., "Convoluted Array Elements and Reduced Size Unit Cells for Frequency-Selective Surfaces," Microwaves, Antennas & Propagation, IEEE Proceedings H, vol. 138, No. 1, pages 19-22, Feb. 1991.
Sanad, Mohamed, "A Compact Dual-Broadband Microstrip Antenna Having Both Stacked and Planar Parasitic Elements," IEEE Antennas and Propagation Society International Symposium 1996 Digest, pp. 6-9, Jul. 21-26, 1996.
European Patent Office Communication from the corresponding European patent application dated Feb. 7, 2003, 10 pages.

* cited by examiner

SPACE-FILLING MINIATURE ANTENNAS

CROSS-REFERENCE TO RELATED APPLICATIONS

This application is a Continuation of U.S. patent application Ser. No. 11/686,804, filed Mar. 15, 2007, entitled SPACE-FILLING MINIATURE ANTENNAS, which is a Divisional Application of U.S. Pat. No. 7,202,822, issued Apr. 10, 2007, entitled SPACE-FILLING MINIATURE ANTENNAS, which is a Continuation Application of U.S. Pat. No. 7,148,850, issued on Dec. 12, 2006, entitled: SPACE-FILLING MINIATURE ANTENNAS, which is a Continuation Application of U.S. patent application Ser. No. 10/182,635, filed on Nov. 1, 2002, now abandoned, entitled: SPACE-FILLING MINIATURE ANTENNAS, which is a 371 of PCT/EP00/00411, filed on Jan. 19, 2000, entitled: SPACE-FILLING MINIATURE ANTENNAS.

TECHNICAL FIELD

The present invention generally refers to a new family of antennas of reduced size based on an innovative geometry, the geometry of the curves named as Space-Filling Curves (SFC). An antenna is said to be a small antenna (a miniature antenna) when it can be fitted in a small space compared to the operating wavelength. More precisely, the radiansphere is taken as the reference for classifying an antenna as being small. The radiansphere is an imaginary sphere of radius equal to the operating wavelength divided by two times pi.; an antenna is said to be small in terms of the wavelength when it can be fitted inside said radiansphere.

A novel geometry, the geometry of Space-Filling Curves (SFC) is defined in the present invention and it is used to shape a part of an antenna. By means of this novel technique, the size of the antenna can be reduced with respect to prior art, or alternatively, given a fixed size the antenna can operate at a lower frequency with respect to a conventional antenna of the same size.

The invention is applicable to the field of the telecommunications and more concretely to the design of antennas with reduced size.

BACKGROUND

The fundamental limits on small antennas where theoretically established by H-Wheeler and L. J. Chu in the middle 1940's. They basically stated that a small antenna has a high quality factor (Q) because of the large reactive energy stored in the antenna vicinity compared to the radiated power. Such a high quality factor yields a narrow bandwidth; in fact, the fundamental derived in such theory imposes a maximum bandwidth given a specific size of an small antenna.

Related to this phenomenon, it is also known that a small antenna features a large input reactance (either-capacitive or inductive) that usually has to be compensated with an external matching/loading circuit or structure. It also means that is difficult to pack a resonant antenna into a space which is small in terms of the wavelength at resonance. Other characteristics of a small antenna are its small radiating resistance and its low efficiency.

Searching for structures that can efficiently radiate from a small space has an enormous commercial interest, especially in the environment of mobile communication devices (cellular telephony, cellular pagers, portable computers and data handlers, to name a few examples), where the size and weight of the portable equipments need to be small. According to R. C. Hansen (R. C. Hansen, "Fundamental Limitations on Antennas," Proc. IEEE, vol. 69, no. 2, February 1981), the performance of a small antenna depends on its ability to efficiently use the small available space inside the imaginary radiansphere surrounding the antenna.

In the present invention, a novel set of geometries named Space-Filling Curves (hereafter SFC) are introduced for the design and construction of small antennas that improve the performance of other classical antennas described in the prior art (such as linear monopoles, dipoles and circular or rectangular loops).

Some of the geometries described in the present invention are inspired in the geometries studied already in the XIX century by several mathematicians such as Giusepe Peano and David Hilbert. In all said cases the curves were studied from the mathematical point of view but were never used for any practical-engineering application.

The dimension (D) is often used to characterize highly complex geometrical curves and structures such those described in the present invention. There exists many different mathematical definitions of dimension but in the present document the box-counting dimension (which is well-known to those skilled in mathematics theory) is used to characterize a family of designs. Those skilled in mathematics theory will notice that optionally, an Iterated Function System (IFS), a Multireduction Copy Machine (MRCM) or a Networked Multireduction Copy Machine (MRCM) algorithm can be used to construct some space-filling curves as those described in the present invention.

The key point of the present invention is shaping part of the antenna (for example at least a part of the arms of a dipole, at least a part of the arm of a monopole, the perimeter of the patch of a patch antenna, the slot in a slot antenna, the loop perimeter in a loop antenna, the horn cross-section in a horn antenna, or the reflector perimeter in a reflector antenna) as a space-filling curve, that is, a curve that is large in terms of physical length but small in terms of the area in which the curve can be included. More precisely, the following definition is taken in this document for a space-filling curve: a curve composed by at least ten segments which are connected in such a way that each segment forms an angle with their neighbours, that is, no pair of adjacent segments define a larger straight segment, and wherein the curve can be optionally periodic along a fixed straight direction of space if and only if the period is defined by a non-periodic curve composed by at least ten connected segments and no pair of said adjacent and connected segments define a straight longer segment. Also, whatever the design of such SFC is, it can never intersect with itself at any point except the initial and final point (that is, the whole curve can be arranged as a closed curve or loop, but none of the parts of the curve can become a closed loop). A space-filling curve can be fitted over a flat or curved surface, and due to the angles between segments, the physical length of the curve is always larger than that of any straight line that can be fitted in the same area (surface) as said space-filling curve. Additionally, to properly shape the structure of a miniature antenna according to the present invention, the segments of the SFC curves must be shorter than a tenth of the free-space operating wavelength.

Depending on the shaping procedure and curve geometry, some infinite length SFC can be theoretically designed to feature a Haussdorf dimension larger than their topological-dimension. That is, in terms of the classical Euclidean geometry, It is usually understood that a curve is always a one-dimension object; however when the curve is highly convoluted and its physical length is very large, the curve tends to fill parts of the surface which supports it; in that case the Haussdorf dimension can be computed over the curve (or at least an approximation of it by means of the box-counting algorithm) resulting in a number larger than unity. Such theoretical infinite curves can not be physically constructed, but they can be approached with SFC designs. The curves 8 and 17 described in and FIG. 2 and FIG. 5 are some examples of such SFC, that approach an ideal infinite curve featuring a dimension D=2.

The advantage of using SFC curves in the physical shaping of the antenna is two-fold: (a) Given a particular operating frequency or wavelength said SFC antenna can be reduced in size with respect to prior art. (b) Given the physical size of the SFC antenna, said SFC antenna can be operated at a lower frequency (a longer wavelength) than prior art.

BRIEF DESCRIPTION OF THE DRAWINGS

For a more complete understanding, reference is now made to the following description taken in conjunction with the accompanying Drawings in which.

DETAILED DESCRIPTION

Figure 1:
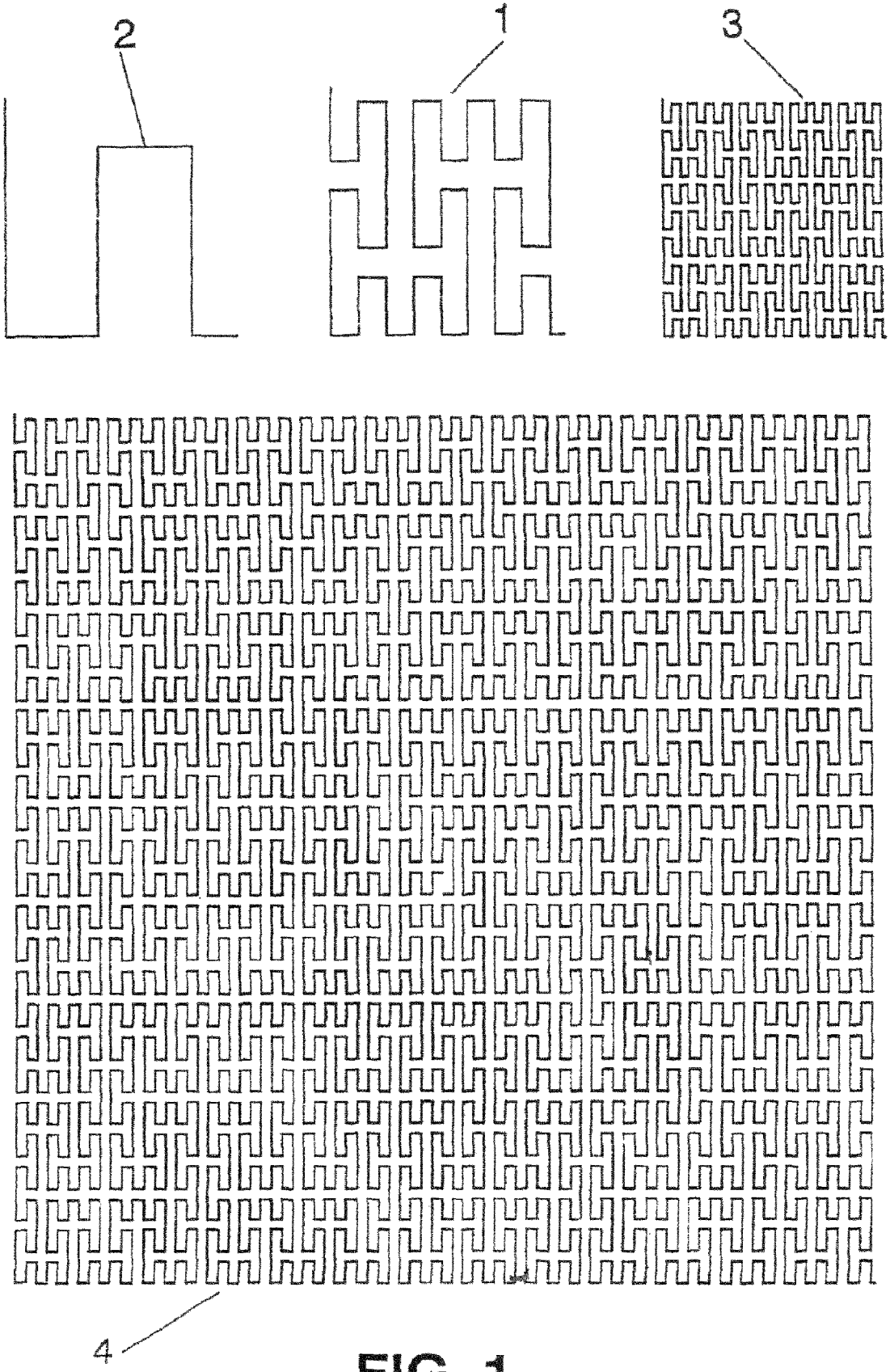
FIG. 1 shows some particular cases of SFC curves. From an initial curve (2), other curves (1), (3) and (4) with more than 10 connected segments are formed. This particular family of curves are named hereafter SZ curves.
Figure 2:
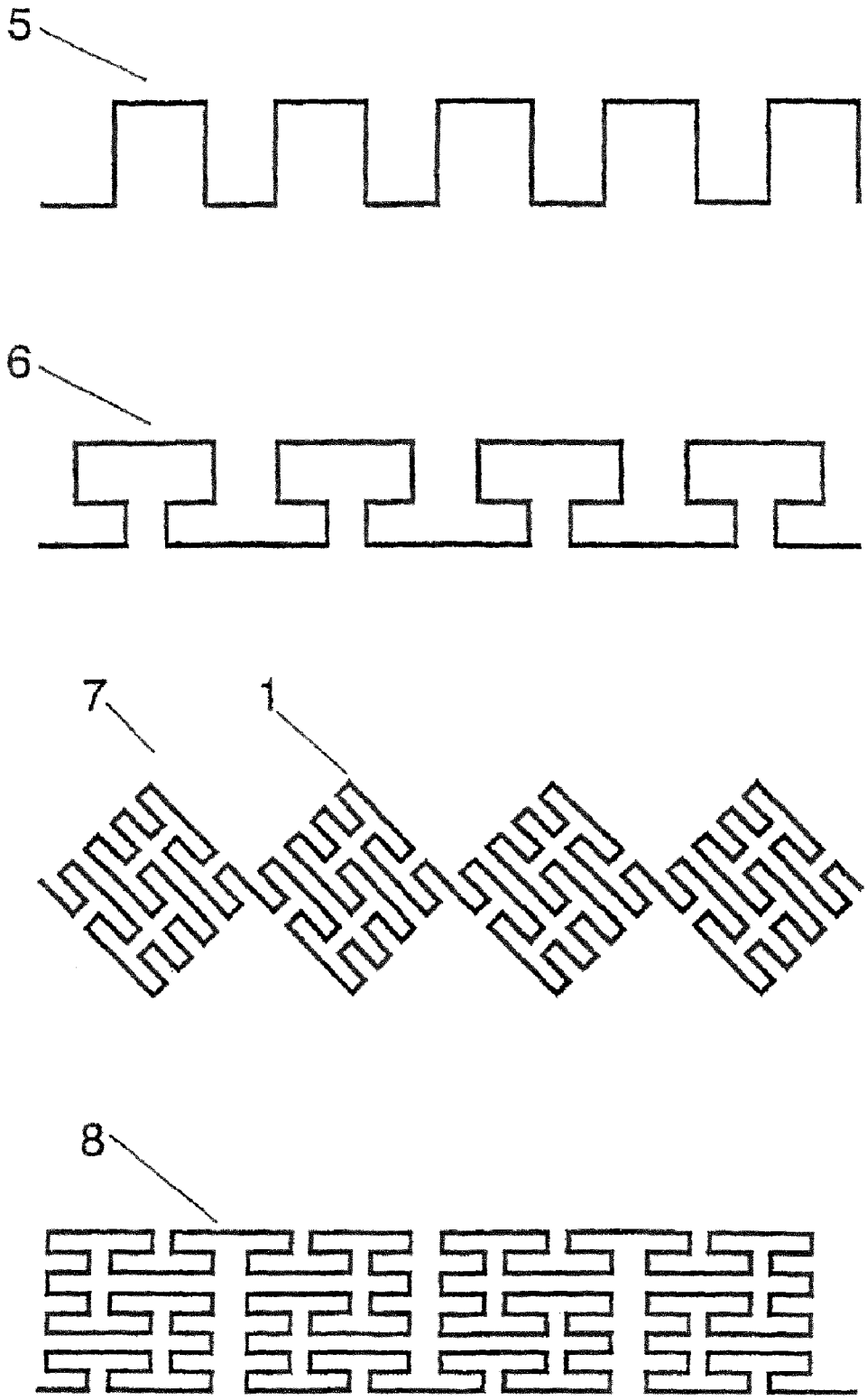
FIG. 2 shows a comparison between two prior art meandering lines and two SFC periodic curves, constructed from the SZ curve of drawing 1.

FIG. 1 and FIG. 2 show some examples of SFC curves. Drawings (1), (3) and (4) in FIG. 1 show three examples of SFC curves named SZ curves. A curve that is not an SFC since it is only composed of 6 segments is shown in drawing (2) for comparison. The drawings (7) and (8) in FIG. 2 show another two particular examples of SFC curves, formed from the periodic repetition of a motive including the SFC curve (1). It is important noticing the substantial difference between these examples of SFC curves and some examples of periodic, meandering and not SFC curves such as those in drawings (5) and (6) in FIG. 2. Although curves (5) and (6) are composed by more than 10 segments, they can be substantially considered periodic along a straight direction (horizontal direction) and the motive that defines a period or repetition cell is constructed with less than 10 segments (the period in drawing (5) includes only four segments, while the period of the curve (6) comprises nine segments) which contradicts the definition of SFC curve introduced in the present invention. SFC curves are substantially more complex and pack a longer length in a smaller space; this fact in conjunction with the fact that each segment composing and SFC curve is electrically short (shorter than a tenth of the free-space operating wavelength as claimed in this invention) play a key role in reducing the antenna size. Also, the class of folding mechanisms used to obtain the particular SFC curves described in the present invention are important in the design of miniature antennas.

Figure 3:
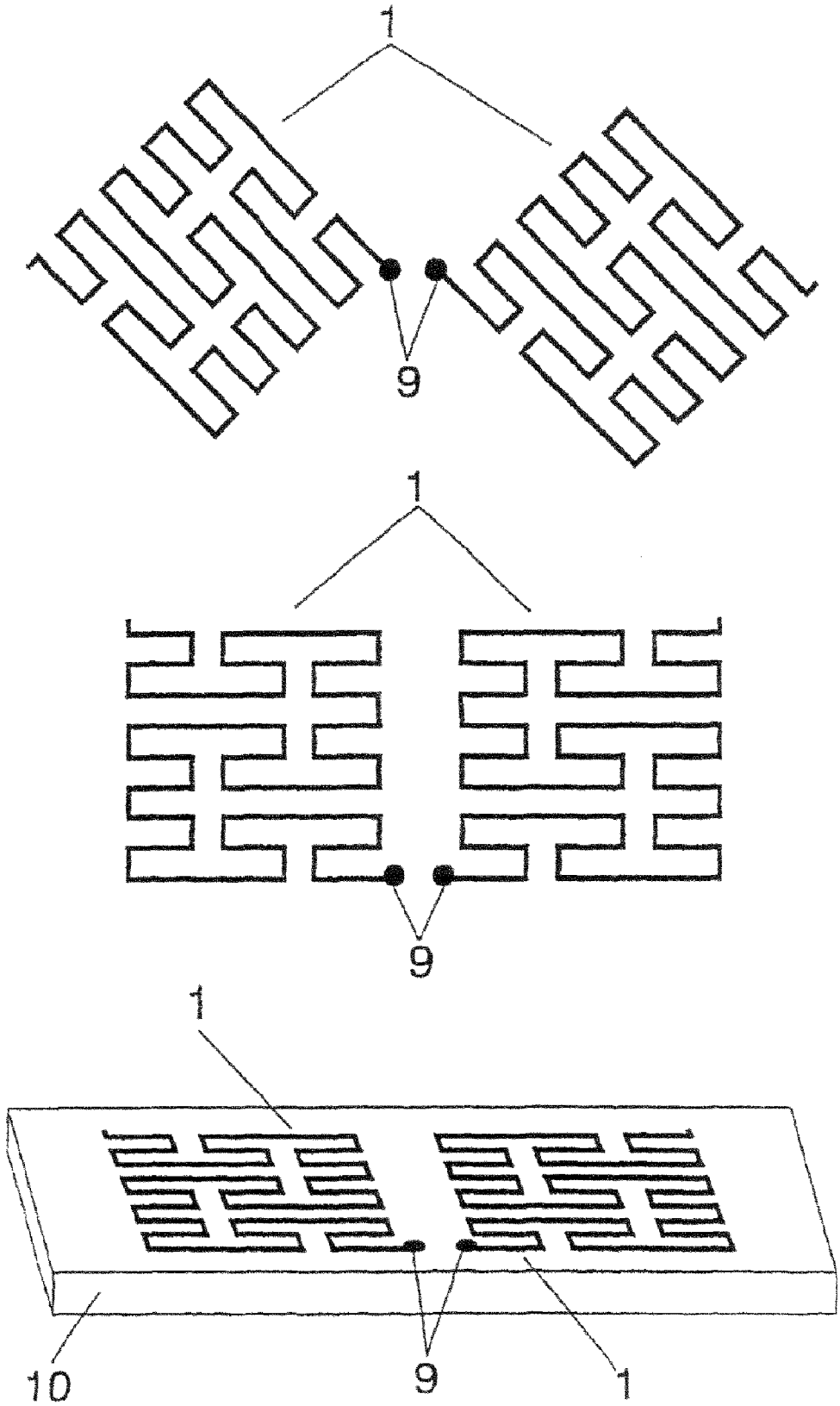
FIG. 3 shows a particular configuration of an SFC antenna. It consists on tree different configurations of a dipole wherein each of the two arms is fully shaped as an SFC curve (1)

FIG. 3 describes a preferred embodiment of an SFC antenna. The three drawings display different configurations of the same basic dipole. A two-arm antenna dipole is constructed comprising two conducting or superconducting parts, each part shaped as an SFC curve. For the sake of clarity but without loss of generality, a particular case of SFC curve (the SZ curve (1) of FIG. 1) has been chosen here; other SFC curves as for instance, those described in FIG. 1, 2, 6, 8, 14, 19, 20, 21, 22, 23, 24 or 25 could be used instead. The two closest tips of the two arms form the input terminals (9) of the dipole. The terminals (9) have been drawn as conducting or superconducting circles, but as it is clear to those skilled in the art, such terminals could be shaped following any other pattern as long as they are kept small in terms of the operating wavelength. Also, the arms of the dipoles can be rotated and folded in different ways to finely modify the input impedance or the radiation properties of the antenna such as, for instance, polarization. Another preferred embodiment of an SFC dipole is also shown in FIG. 3, where the conducting or superconducting SFC arms are printed over a dielectric substrate (10); this method is particularly convenient in terms of cost and mechanical robustness when the SFC curve is long. Any of the well-known printed circuit fabrication techniques can be applied to pattern the SFC curve over the dielectric substrate. Said dielectric substrate can be for instance a glass-fibre board, a teflon based substrate (such as Cuclad®) or other standard radiofrequency and microwave substrates (as for instance Rogers 4003® or Kapton®). The dielectric substrate can even be a portion of a window glass if the antenna is to be mounted in a motor vehicle such as a car, a train or an air-plane, to transmit or receive radio, TV, cellular telephone (GSM 900, GSM 1800, UMTS) or other communication services electromagnetic waves. Of course, a balun network can be connected or integrated at the input terminals of the dipole to balance the current distribution among the two dipole arms.

Figure 4:
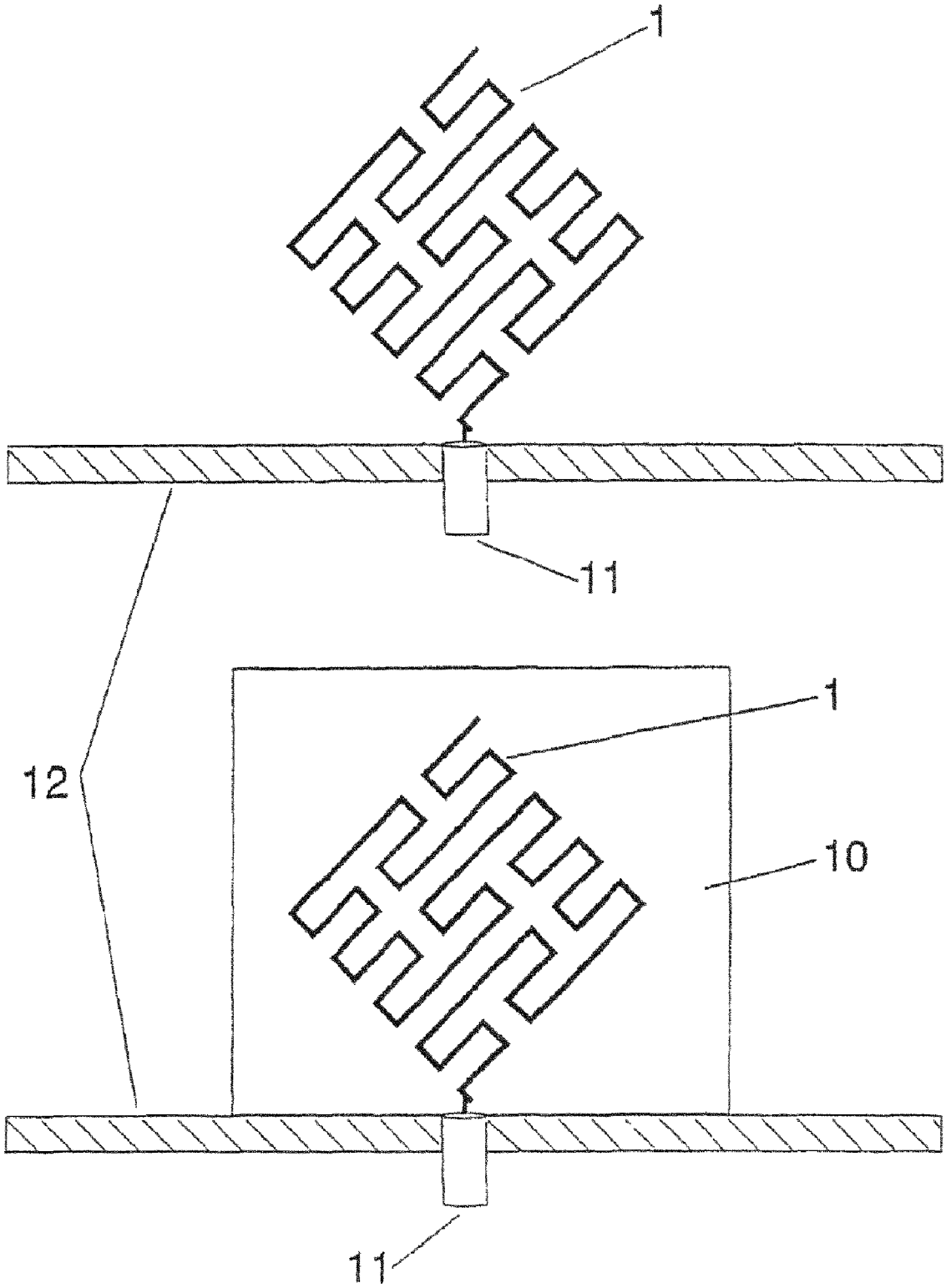
FIG. 4 shows other particular cases of SFC antennas. They consist on monopole antennas.

Another preferred embodiment of an SFC antenna is a monopole configuration as shown in FIG. 4. In this case one of the dipole arms is substituted by a conducting or superconducting counterpoise or ground plane (12). A handheld telephone case, or even a part of the metallic structure of a car, train or can act as such a ground counterpoise. The ground and the monopole arm (here the arm is represented with SFC curve (1), but any other SFC curve could be taken instead) are excited as usual in prior art monopoles by means of, for instance, a transmission line (11). Said transmission line is formed by two conductors, one of the conductors is connected to the ground counterpoise while the other is connected to a point of the SFC conducting or superconducting structure. In the drawings of FIG. 4, a coaxial cable (11) has been taken as a particular case of transmission line, but it is clear to any skilled in the art that other transmission lines (such as for instance a microstrip arm) could be used to excite the monopole. Optionally, and following the scheme described in FIG. 3, the SFC curve can be printed over a dielectric substrate (10).

Figure 5:
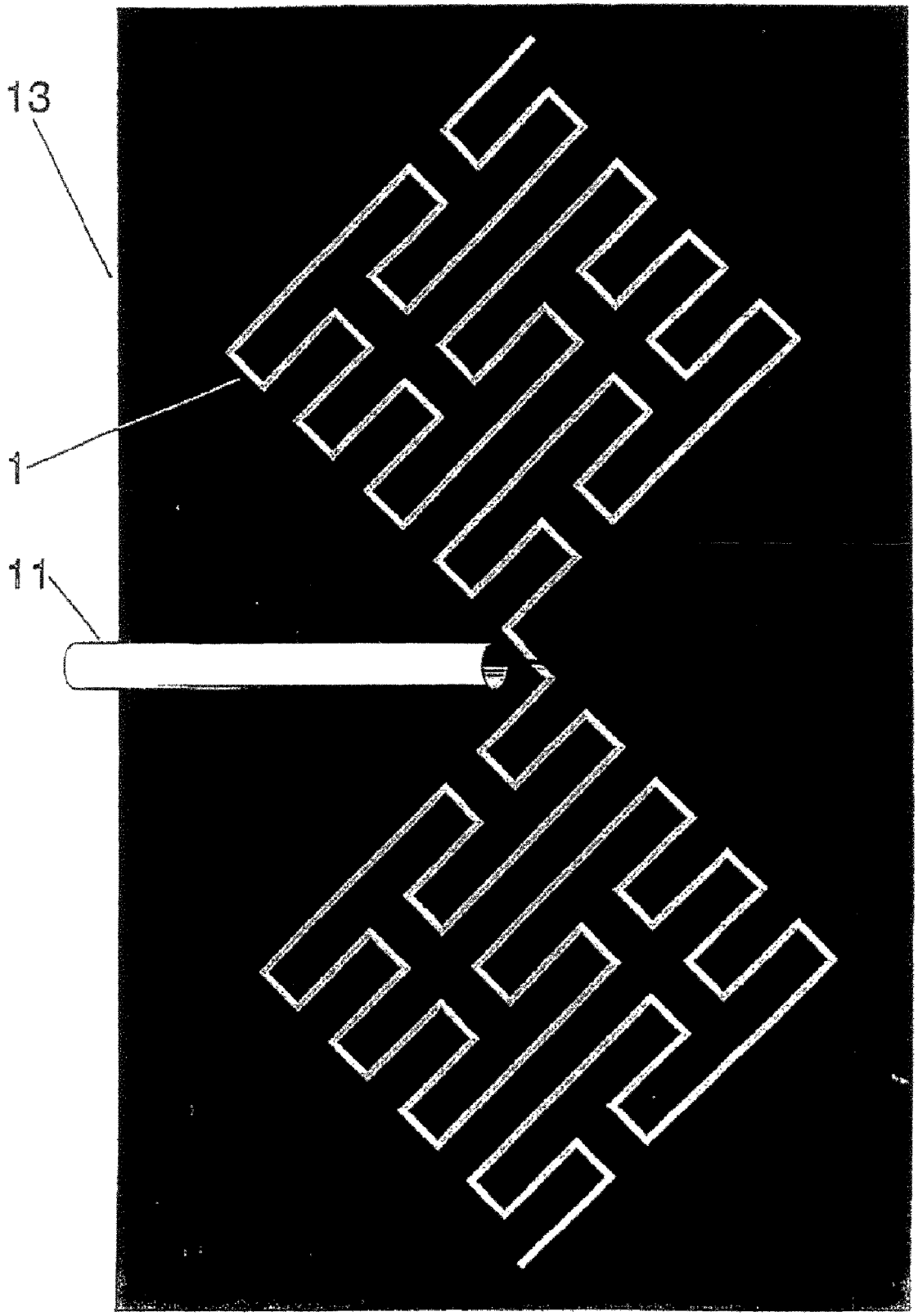
FIG. 5 shows an example of an SFC slot antenna where the slot is shaped as the SFC in drawing 1.
Figure 6:
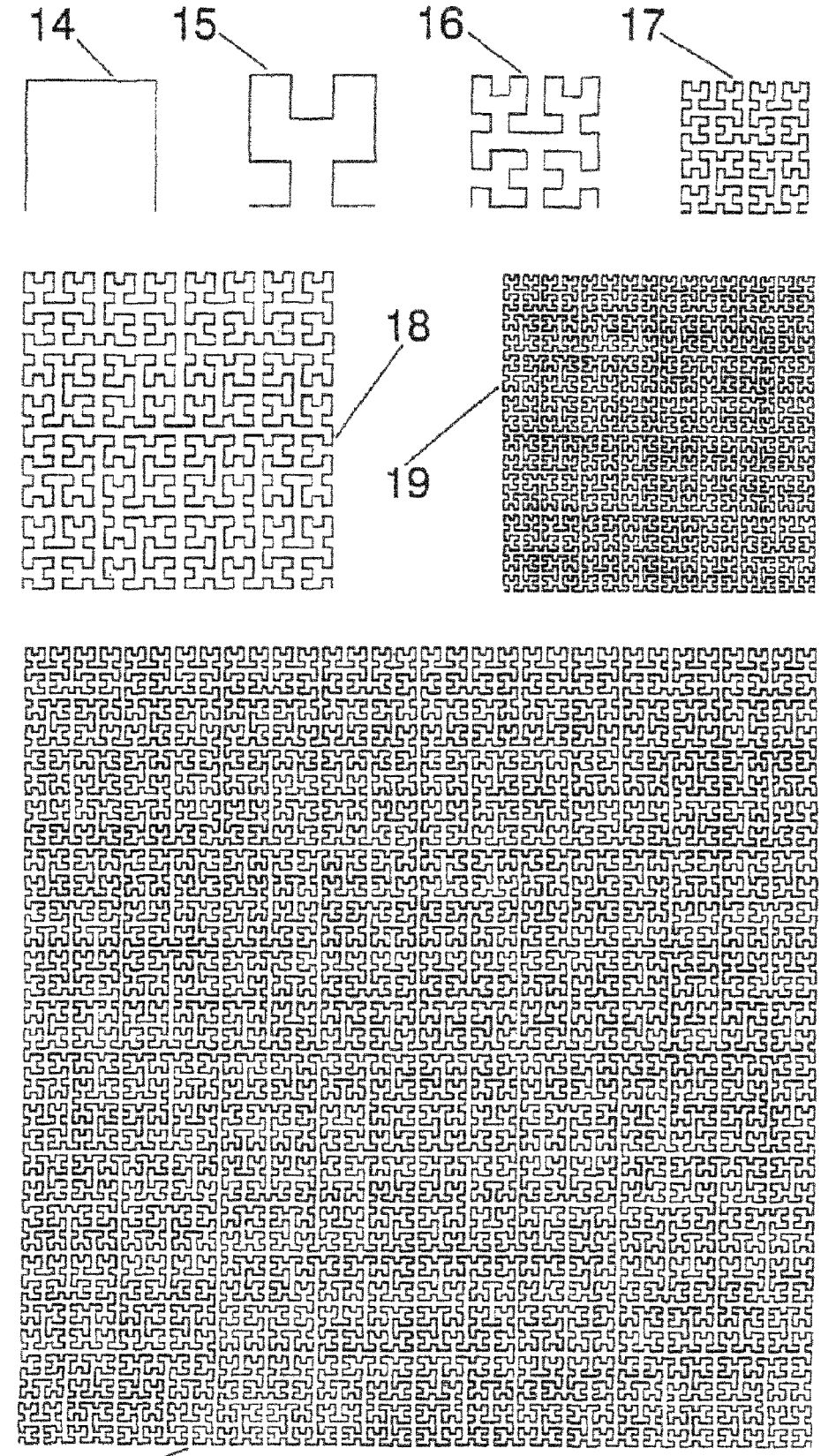
FIG. 6 shows another set of SFC curves (15-20) inspired on the Hilbert curve and hereafter named as Hilbert curves. A standard, non-SFC curve is shown in (14) for comparison.
Figure 7:
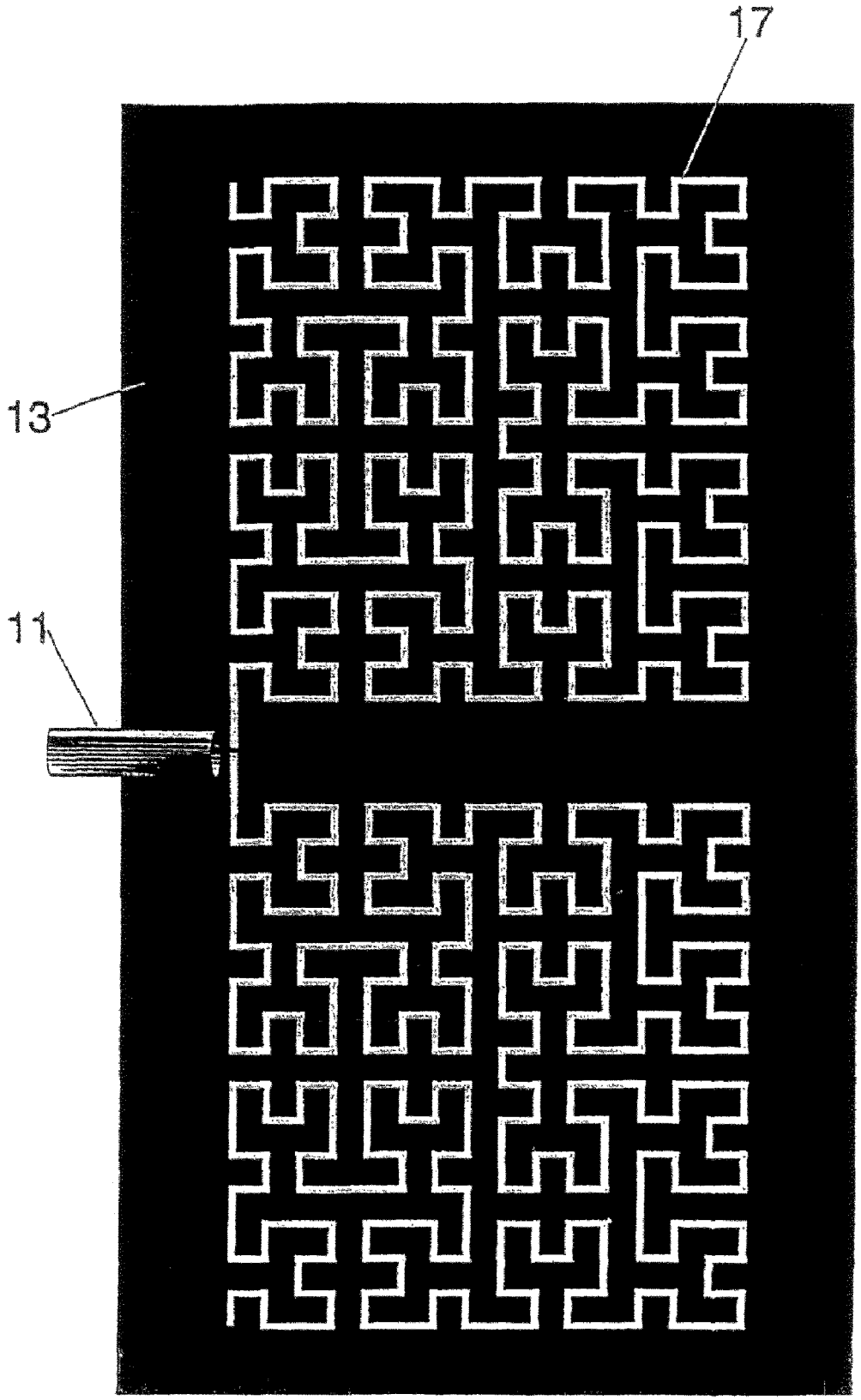
FIG. 7 shows another example of an SFC slot antenna based on the SFC curve (17) in drawing 6.
Figure 8:
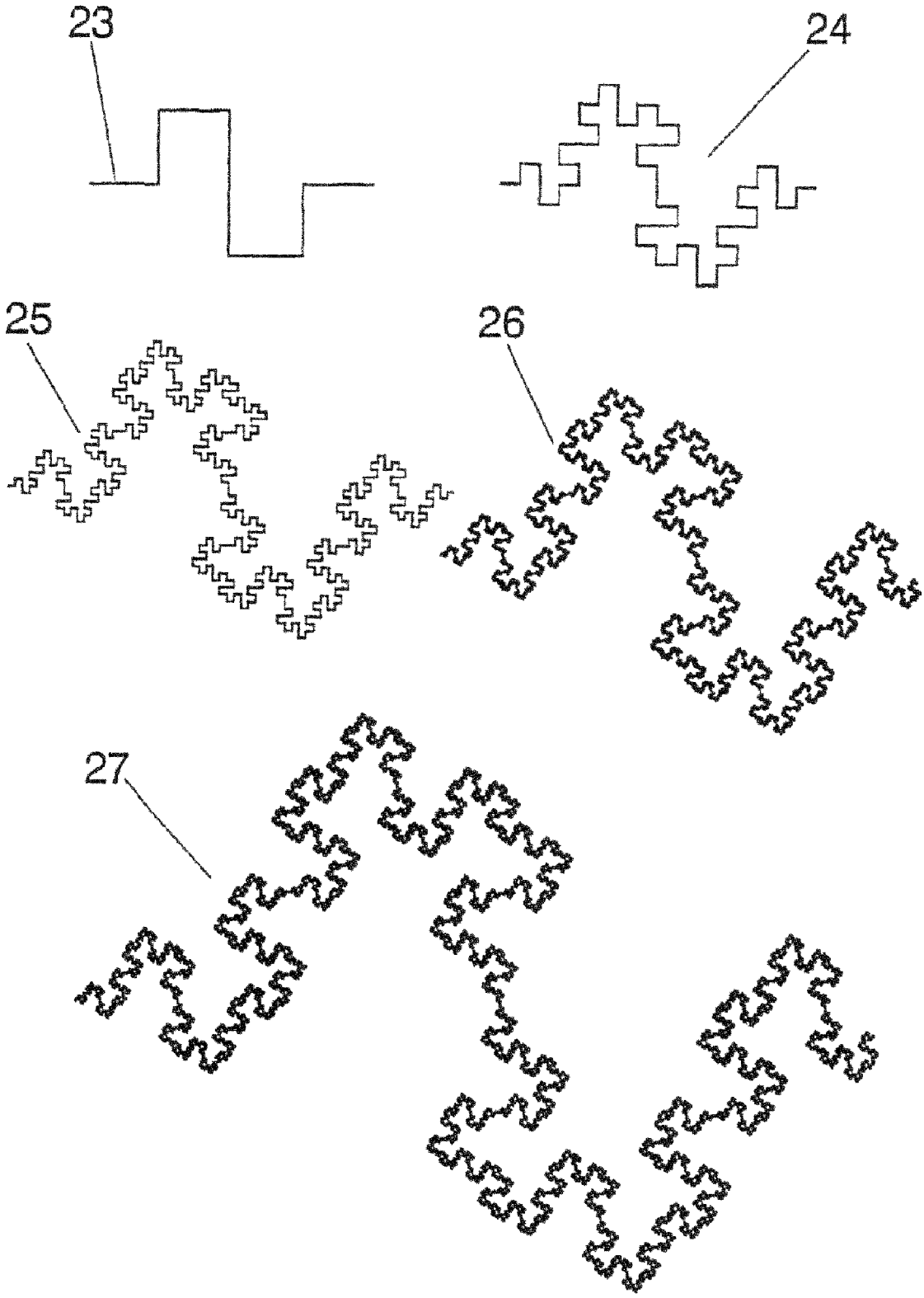
FIG. 8 shows another set of SFC curves (24, 25, 26, 27) hereafter known as ZZ curves. A conventional squared zigzag curve (23) is shown for comparison.
Figure 10:
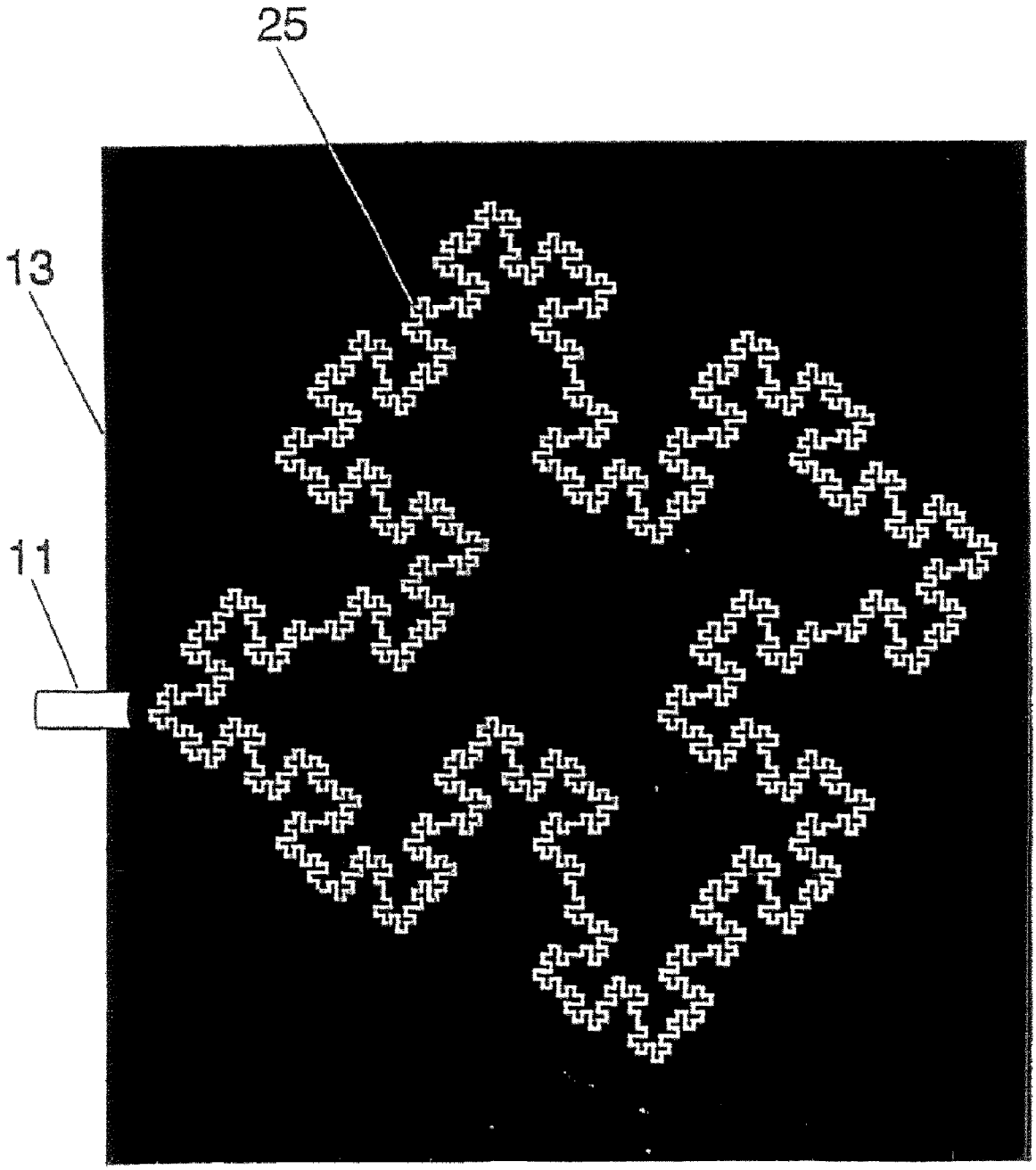
FIG. 10 shows a slot loop antenna based on the SFC (25) in drawing 8.

Another preferred embodiment of an SFC antenna is a slot antenna as shown, for instance in FIGS. 5, 7 and 10. In FIG. 5, two connected SFC curves (following the pattern (1) of FIG. 1) form an slot or gap impressed over a conducting or superconducting sheet (13). Such sheet can be, for instance, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or airplane. The exciting scheme can be any of the well known in conventional slot antennas and it does not become an essential part of the present invention. In all said three figures, a coaxial cable (11) has been used to excite the antenna, with one of the conductors connected to one side of the conducting sheet and the other one connected at the other side of the sheet across the slot. A microstrip transmission line could be used, for instance, instead of the coaxial cable.

To illustrate that several modifications of the antenna that can be done based on the same principle and spirit of the present invention, a similar example is shown in FIG. 7, where another curve (the curve (17) from the Hilbert family) is taken instead. Notice that neither in FIG. 5, nor in FIG. 7 the slot reaches the borders of the conducting sheet, but in another embodiment the slot can be also designed to reach the boundary of said sheet, breaking said sheet in two separate conducting sheets.

FIG. 10 describes another possible embodiment of an slot SFC antenna. It is also an slot antenna in a closed loop configuration. The loop is constructed for instance by connecting four SFC gaps following the pattern of SFC (25) in FIG. 8 (it is clear that other SFC curves could be used instead according to the spirit and scope of the present invention). The resulting closed loop determines the boundary of a conducting or superconducting island surrounded by a conducting or superconducting sheet. The slot can be excited by means of any of the well-known conventional techniques; for instance a coaxial cable (11) can be used, connecting one of the outside conductor to the conducting outer sheet and the inner conductor to the inside conducting island surrounded by the SFC gap. Again, such sheet can be, for example, a sheet over a dielectric substrate in a printed circuit board configuration, a transparent conductive film such as those deposited over a glass window to protect the interior of a car from heating infrared radiation, or can even be part of the metallic structure of a handheld telephone, a car, train, boat or air-plane. The slot can be even formed by the gap between two close but not co-planar conducting island and conducting sheet; this can be physically implemented for instance by mounting the inner conducting island over a surface of the optional dielectric substrate, and the surrounding conductor over the opposite surface of said substrate.

Figure 9:
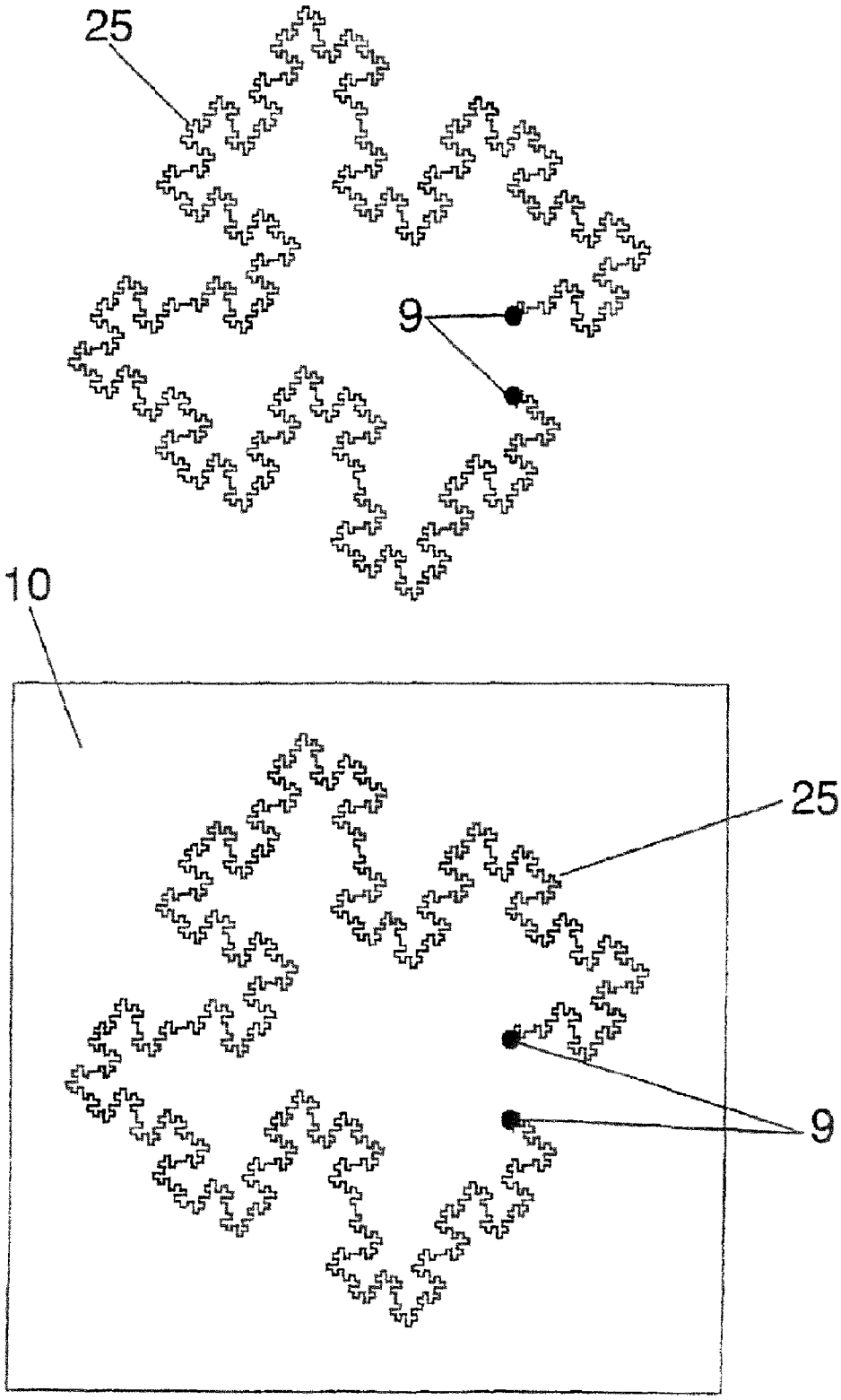
FIG. 9 shows a loop antenna based on curve (25) in a wire configuration (top). Below, the loop antenna 29 is printed over a dielectric substrate (10)

The slot configuration is not, of course, the only way of implementing an SFC loop antenna. A closed SFC curve made of a superconducting or conducting material can be used to implement a wire SFC loop antenna as shown in another preferred embodiment as that of FIG. 9. In this case, a portion of the curve is broken such as the two resulting ends of the curve form the input terminals (9) of the loop. Optionally, the loop can be printed also over a dielectric substrate (10). In case a dielectric substrate is used, a dielectric antenna can be also constructed by etching a dielectric SFC pattern over said substrate, being the dielectric permittivity of said dielectric pattern higher than that of said substrate.

Figure 11:
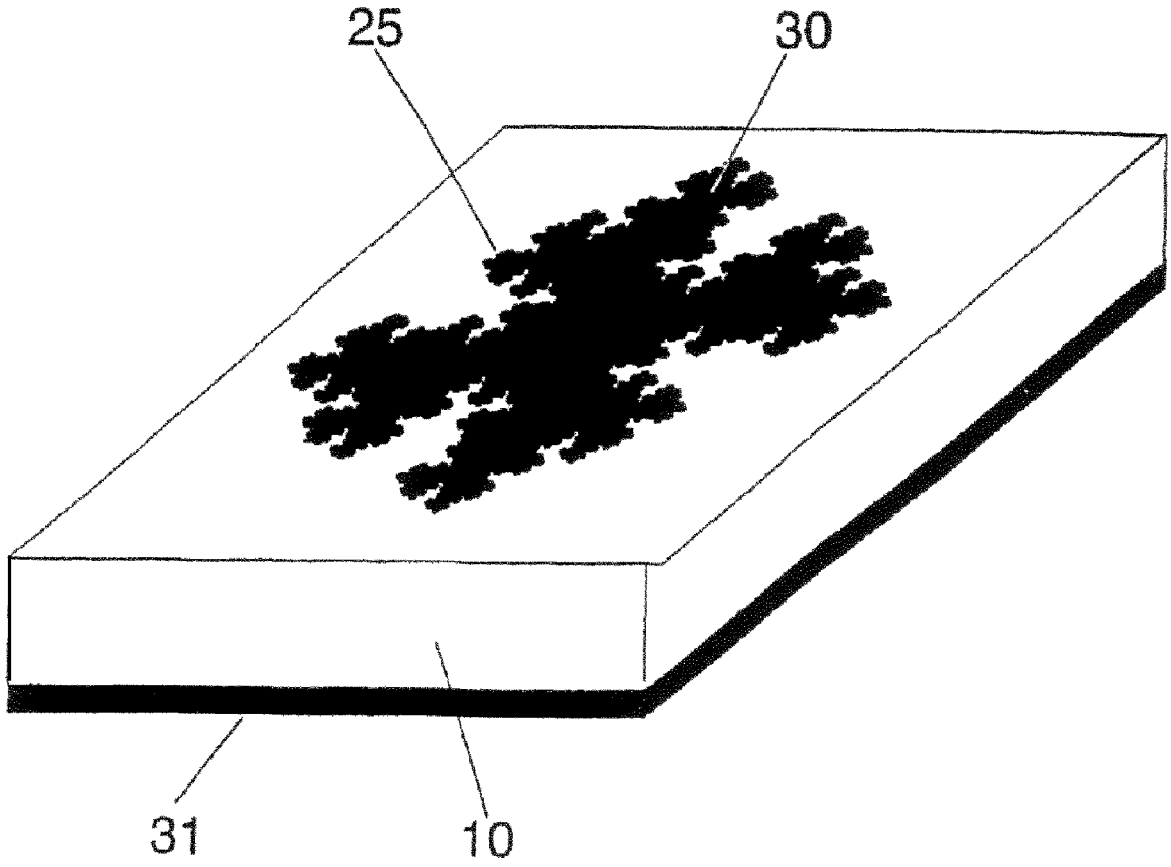
FIG. 11 shows a patch antenna wherein the patch perimeter is shaped according to SFC (25)

Another preferred embodiment is described in FIG. 11. It consists on a patch antenna, with the conducting or superconducting patch (30) featuring an SFC perimeter (the particular case of SFC (25) has been used here but it is clear that other SFC curves could be used instead). The perimeter of the patch is the essential part of the invention here, being the rest of the antenna conformed, for example, as other conventional patch antennas: the patch antenna comprises a conducting or superconducting ground-plane (31) or ground counterpoise, an the conducting or superconducting patch which is parallel to said ground-plane or ground-counterpoise. The spacing between the patch and the ground is typically below (but not restricted to) a quarter wavelength. Optionally, a low-loss dielectric substrate (10) (such as glass-fibre, a teflon substrate such as Cuclad® or other commercial materials such as Rogers® 4003) can be place between said patch and ground counterpoise. The antenna feeding scheme can be taken to be any of the well-known schemes used in prior art patch antennas, for instance: a coaxial cable with the outer conductor connected to the ground-plane and the inner conductor connected to the patch at the desired input resistance point (of course the typical modifications including a capacitive gap on the patch around the coaxial connecting point or a capacitive plate connected to the inner conductor of the coaxial placed at a distance parallel to the patch, and so on can be used as well); a microstrip transmission line sharing the same ground-plane as the antenna with the strip capacitively coupled to the patch and located at a distance below the patch, or in another embodiment with the strip placed below the ground-plane and coupled to the patch through an slot, and even a microstrip transmission line with the strip co-planar to the patch. All these mechanisms are well known from prior art and do not constitute an essential part of the present invention. The essential part of the present invention is the shape of the antenna (in this case the SFC perimeter of the patch) which contributes to reducing the antenna size with respect to prior art configurations.

Figure 13:
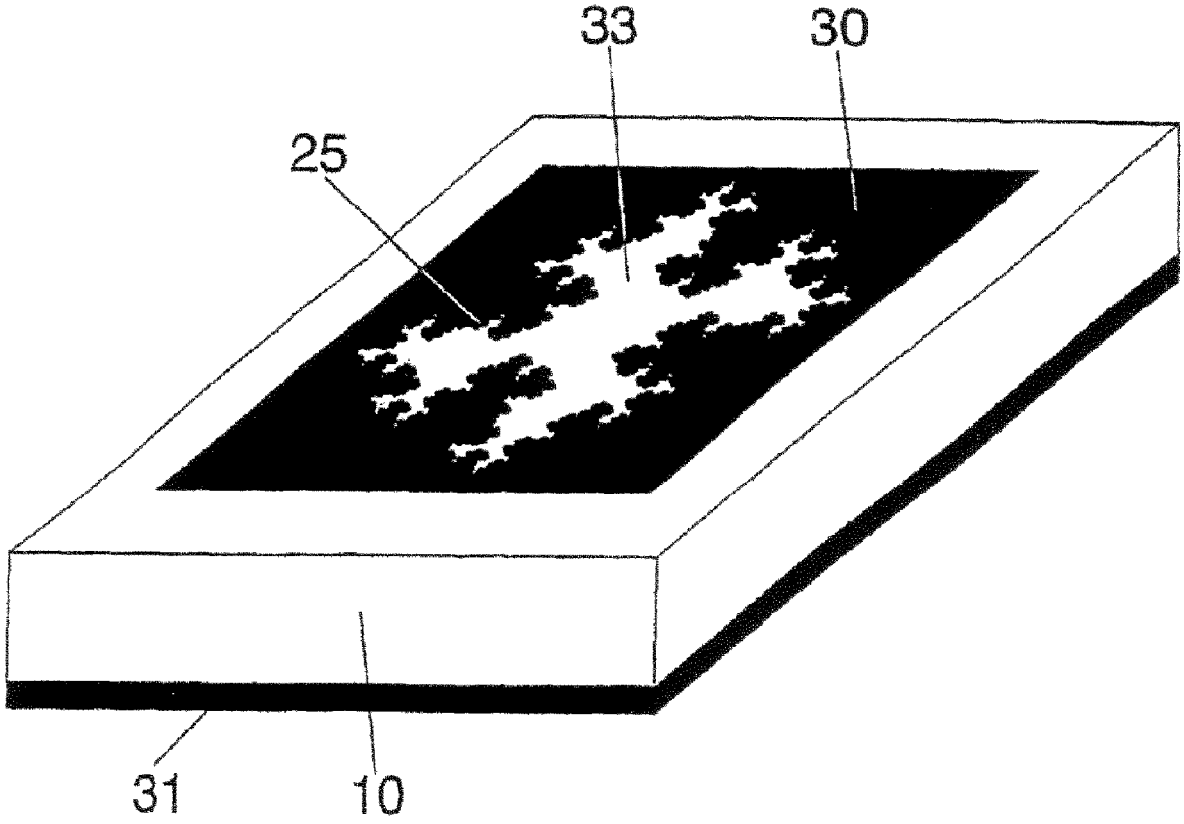
FIG. 13 shows a patch antenna with an aperture on the patch based on SFC (25)
Figure 14:
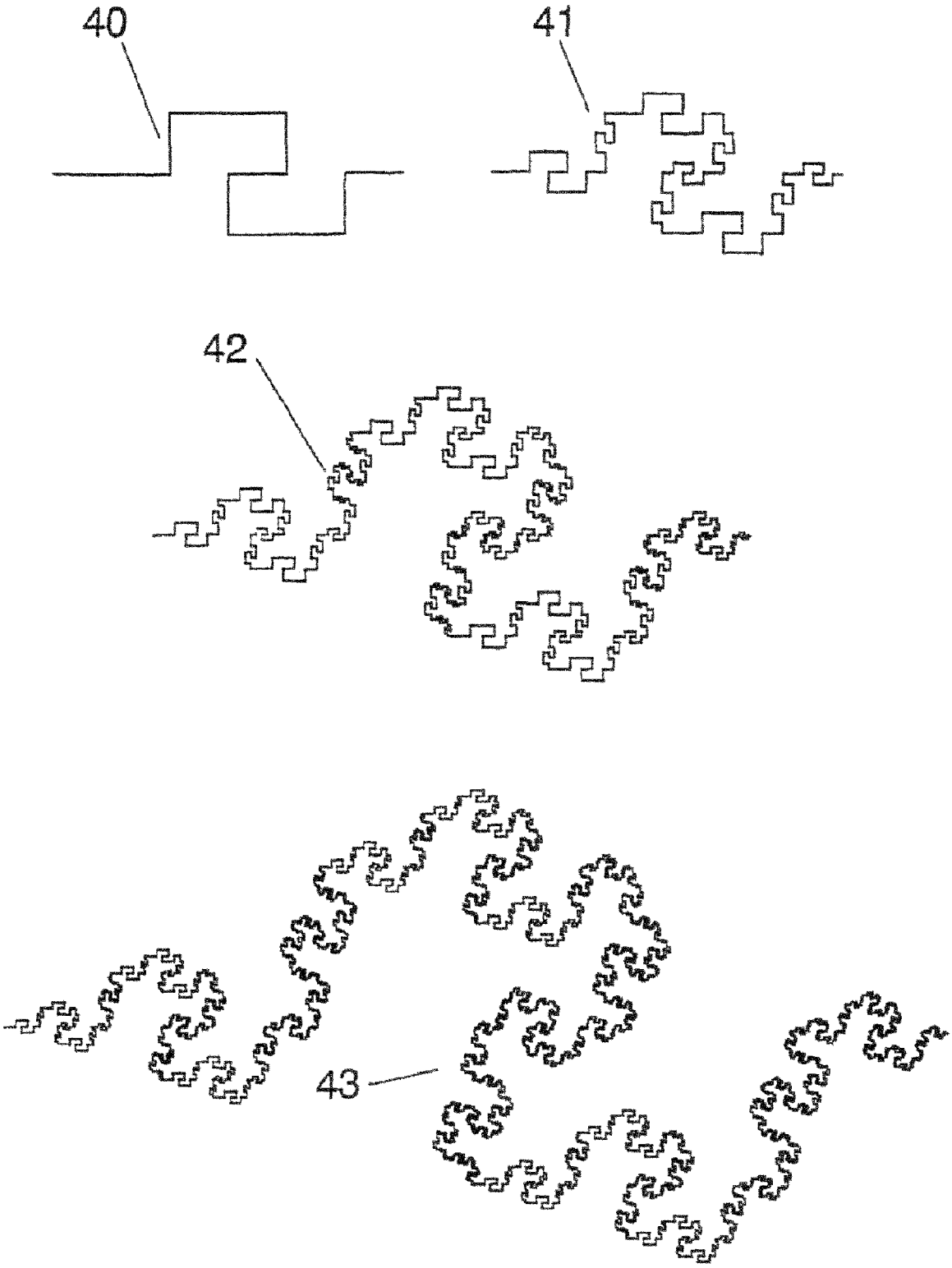
FIG. 14 shows another particular example of a family of SFC curves (41, 42, 43) based on the Giusepe Peano curve. A non-SFC curve formed with only 9 segments is shown for comparison.
Figure 15:
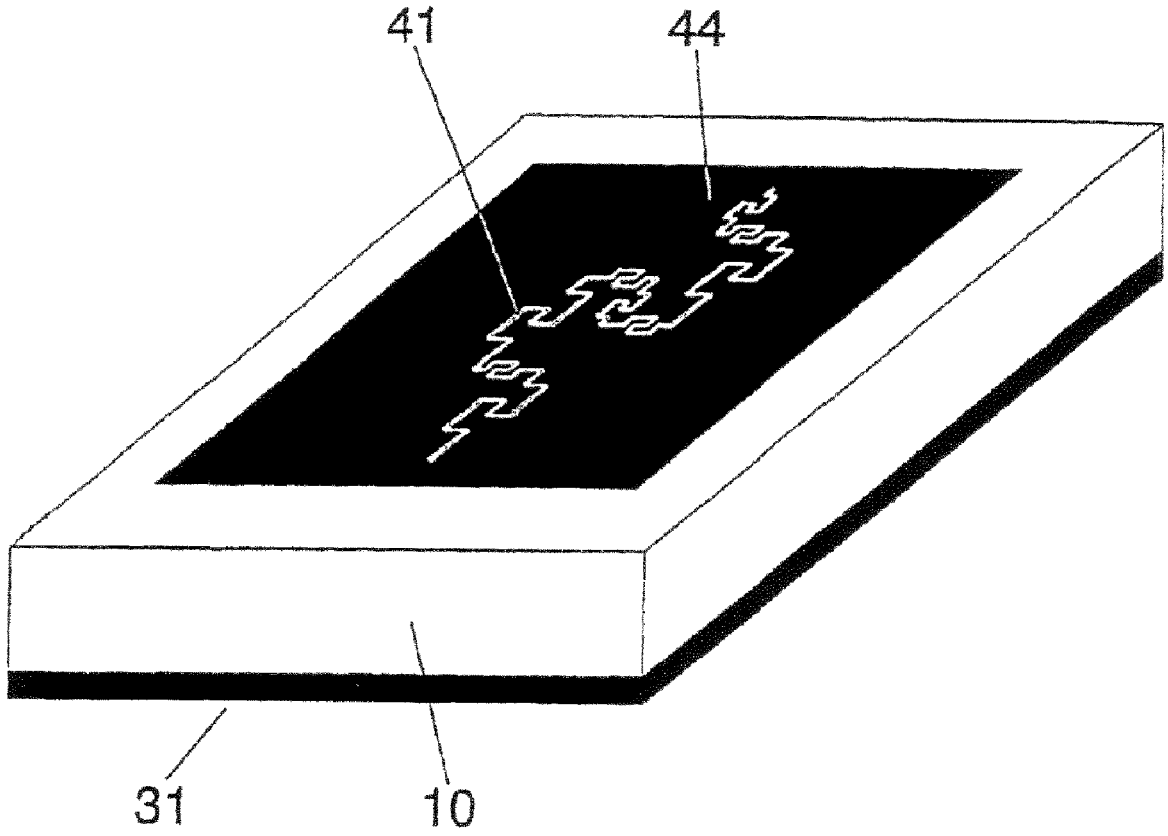
FIG. 15 shows a patch antenna with an SFC slot based on SFC (41)

Other preferred embodiments of SFC antennas based also on the patch configuration are disclosed in FIG. 13 and FIG. 15. They consist on a conventional patch antenna with a polygonal patch (30) (squared, triangular, pentagonal, hexagonal, rectangular, or even circular, to name just a few examples), with an SFC curve shaping a gap on the patch. Such an SFC line can form an slot or spur-line (44) over the patch (as seen in FIG. 15) contributing this way in reducing the antenna size and introducing new resonant frequencies for a multiband operation, or in another preferred embodiment the SFC curve (such as (25) defines the perimeter of an aperture (33) on the patch (30) (FIG. 13). Such an aperture contributes significantly to reduce the first resonant frequency of the patch with respect to the solid patch case, which significantly contributes to reducing the antenna size. Said two configurations, the SFC slot and the SFC aperture cases can of course be use also with SFC perimeter patch antennas as for instance the one (30) described in FIG. 11.

At this point it becomes clear to those skilled in the art what is the scope and spirit of the present invention and that the same SFC geometric principle can be applied in an innovative way to all the well known, prior art configurations. More examples are given in FIGS. 12, 16, 17 and 18.

Figure 12:
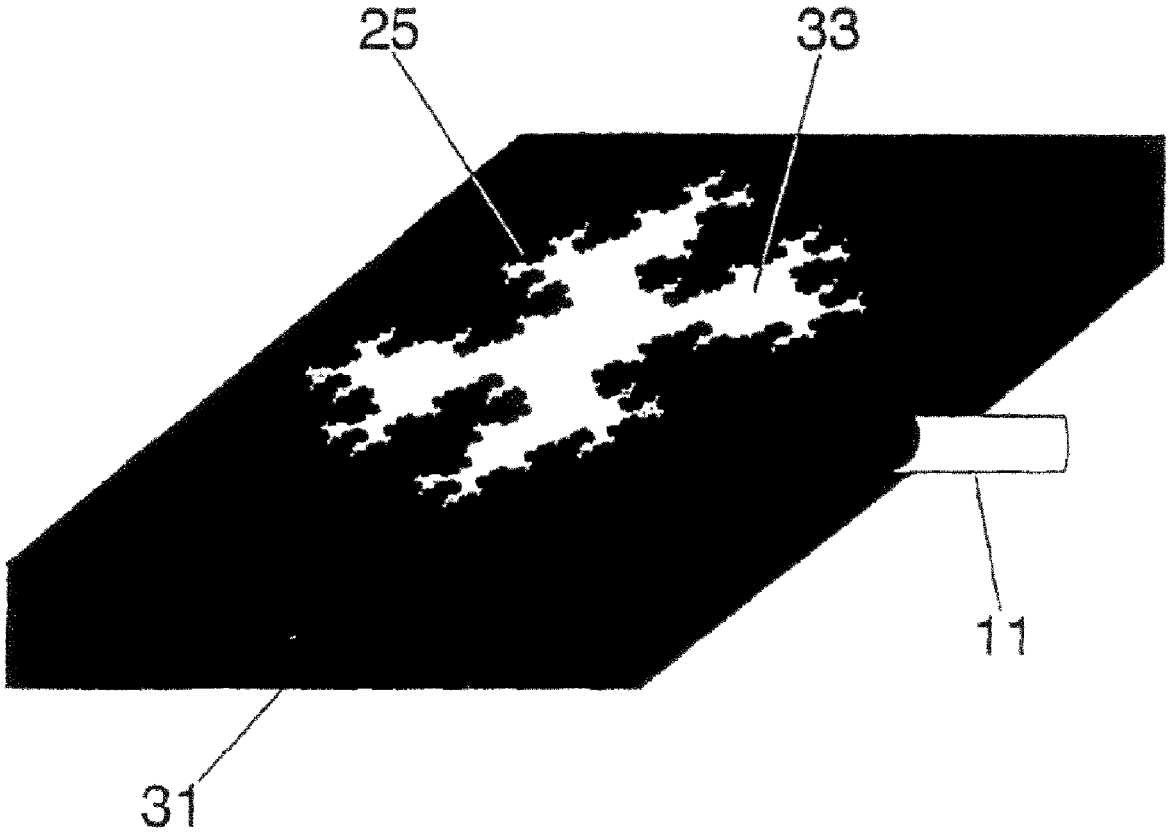
FIG. 12 shows an aperture antenna wherein the aperture (33) is practiced on a conducting or superconducting structure (31), said aperture being shaped with SFC (25)

FIG. 12 describes another preferred embodiment of an SFC antenna. It consists on an aperture antenna, said aperture being characterized by its SFC perimeter, said aperture being impressed over a conducting ground-plane or ground-counterpoise (34), said ground-plane of ground-counterpoise consisting, for example, on a wall of a waveguide or cavity resonator or a part of the structure of a motor vehicle (such as a car, a lorry, an airplane or a tank). The aperture can be fed by any of the conventional techniques such as a coaxial cable (11), or a planar microstrip or strip-line transmission line, to name a few.

Figure 16:
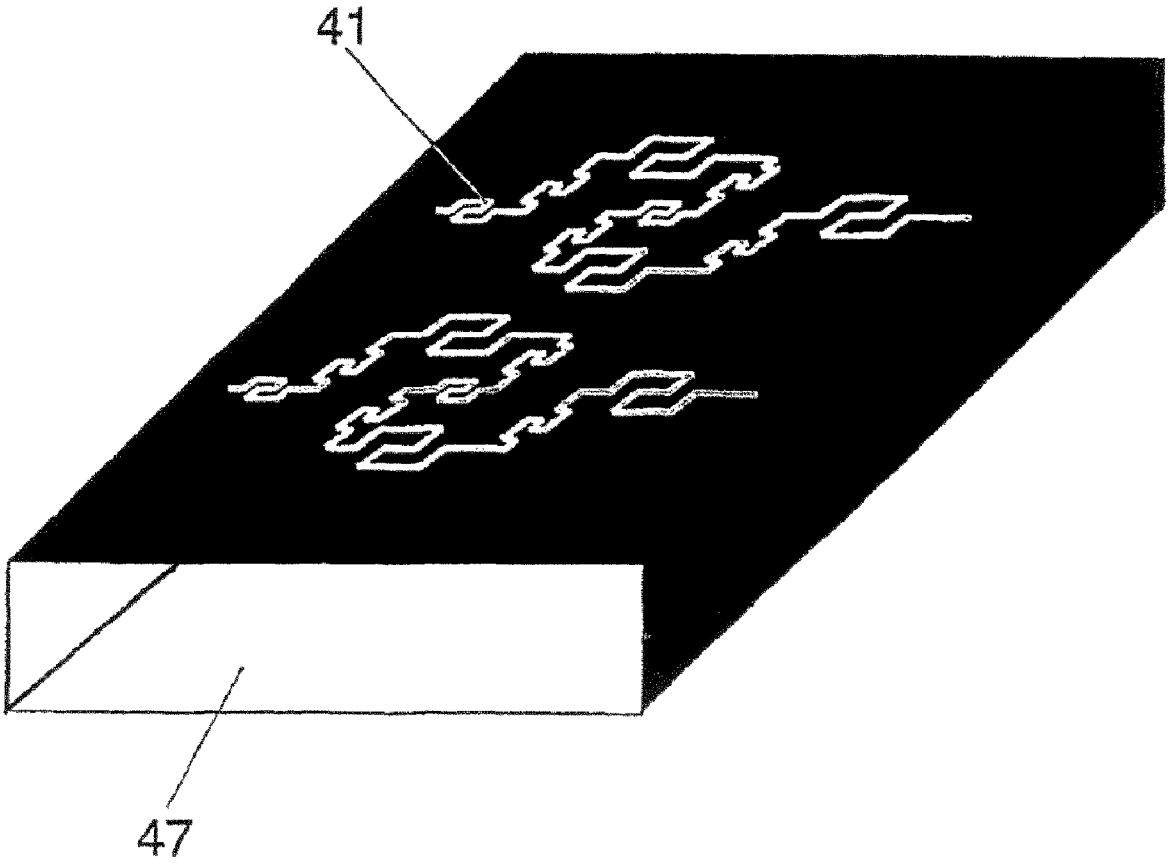
FIG. 16 shows a wave-guide slot antenna wherein a rectangular waveguide (47) has one of its walls slotted with SFC curve (41)

FIG. 16 shows another preferred embodiment where the SFC curves (41) are slotted over a wall of a waveguide (47) of arbitrary cross-section. This way and slotted waveguide array can be formed, with the advantage of the size compressing properties of the SFC curves.

Figure 17:
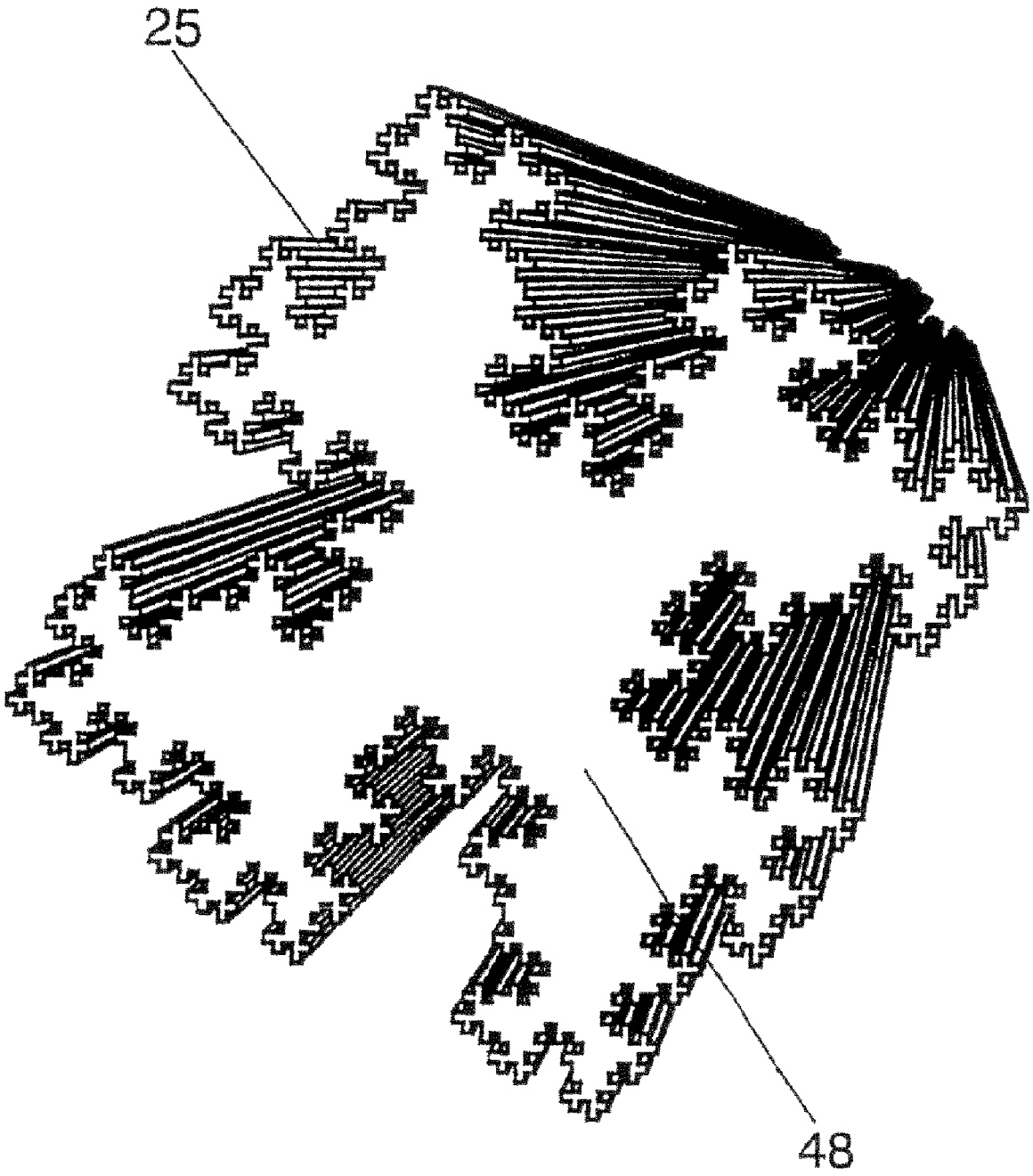
FIG. 17 shows a horn antenna, wherein the aperture and cross-section of the horn is shaped after SFC (25)

FIG. 17 depicts another preferred embodiment, in this case a horn antenna (48) where the cross-section of the antenna is an SFC curve (25). In this case, the benefit comes not only from the size reduction property of SFC Geometries, but also from the broadband behavior that can be achieved by shaping the horn cross-section. Primitive versions of these techniques have been already developed in the form of Ridge horn antennas. In said prior art cases, a single squared tooth introduced in at least two opposite walls of the horn is used to increase the bandwidth of the antenna. The richer scale structure of an SFC curve further contributes to a bandwidth enhancement with respect to prior art.

Figure 18:
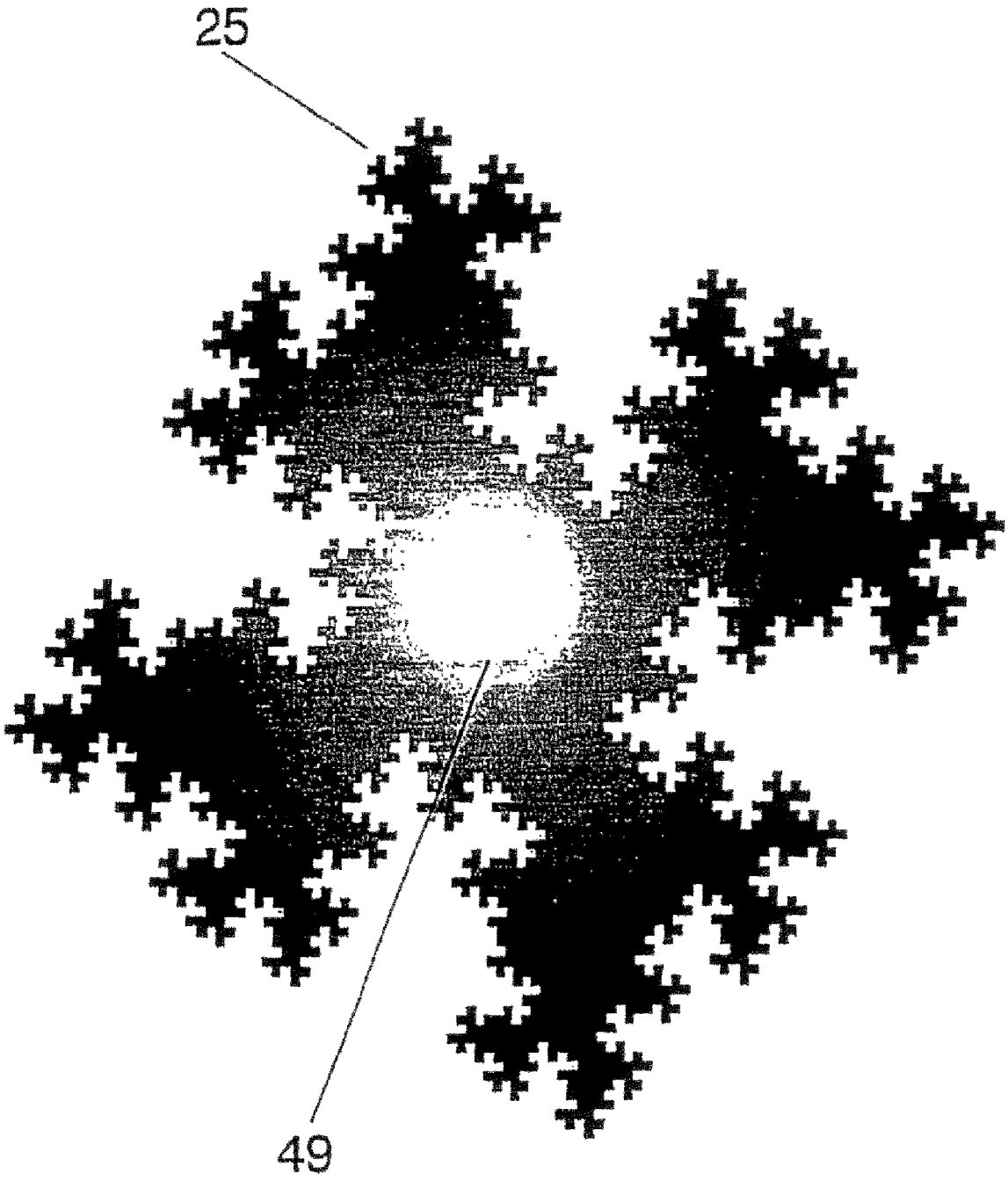
FIG. 18 shows a reflector of a reflector antenna wherein the perimeter of said reflector is shaped as SFC (25)
Figure 19:
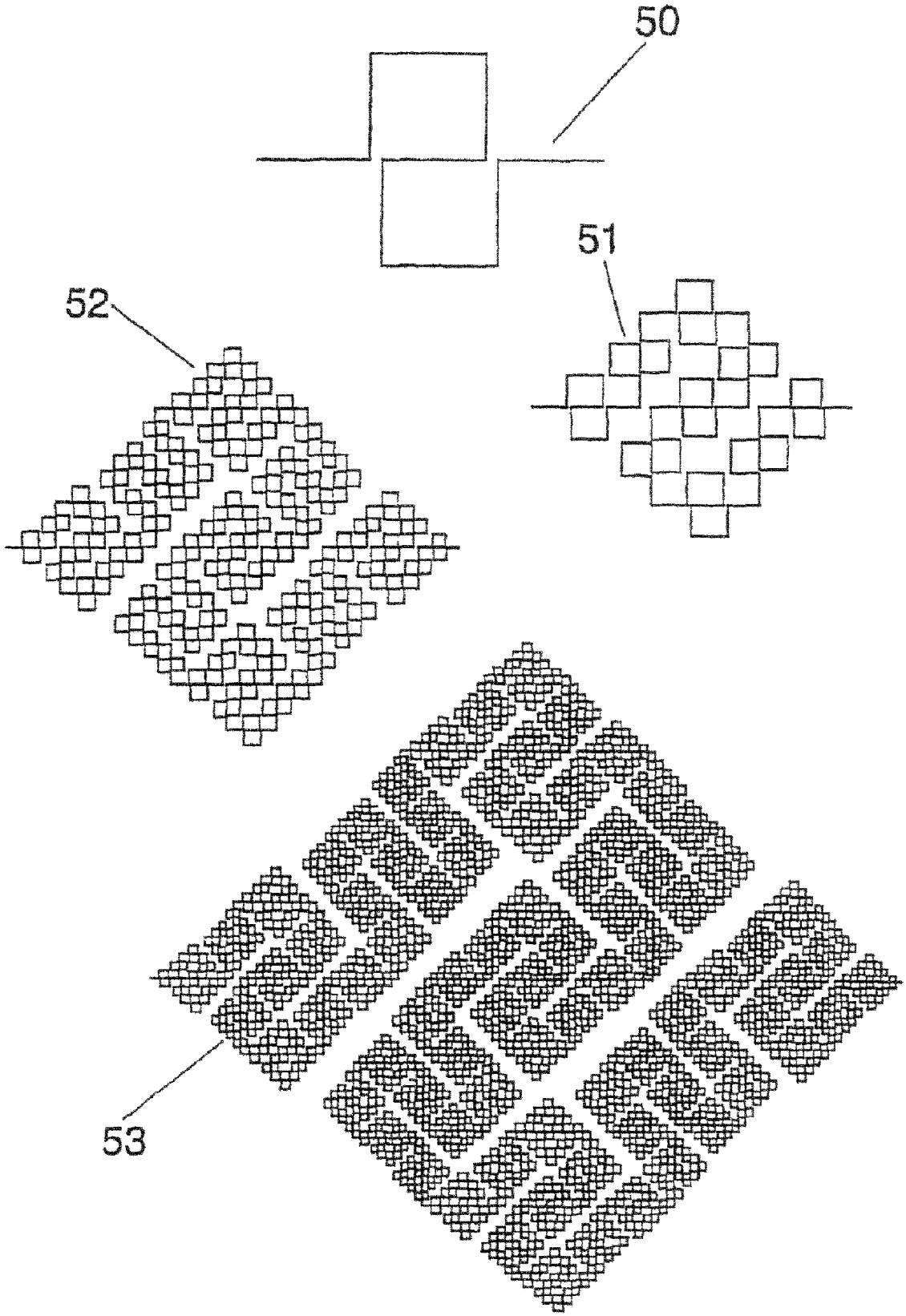
FIG. 19 shows a family of SFC curves (51, 52, 53) based on the Giusepe Peano curve. A non-SFC curve formed with only nine segments is shown for comparison (50)
Figure 20:
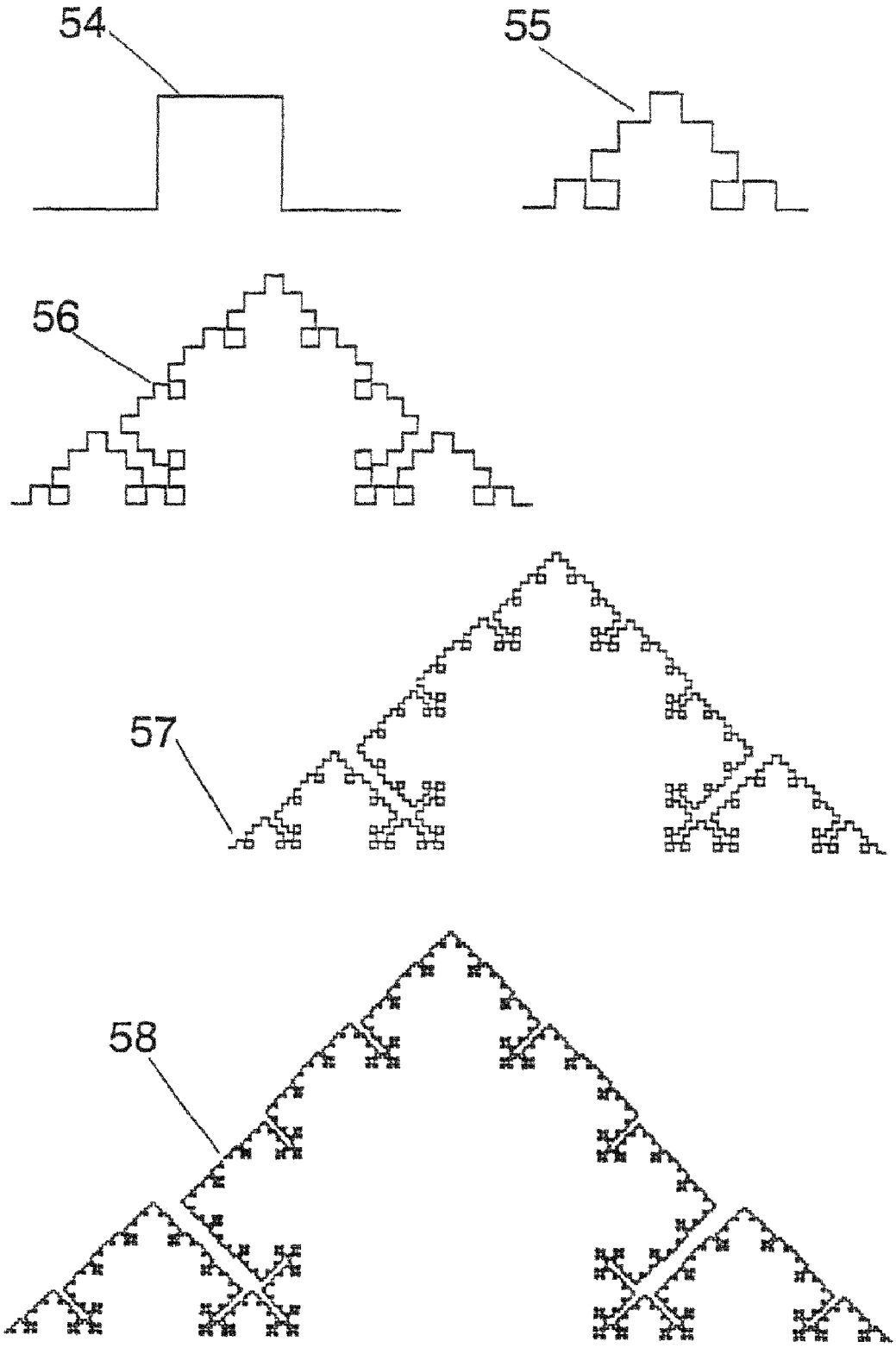
FIG. 20 shows another family of SFC curves (55, 56, 57, 58). A non-SFC curve (54) constructed with only five segments is shown for comparison.
Figure 21:
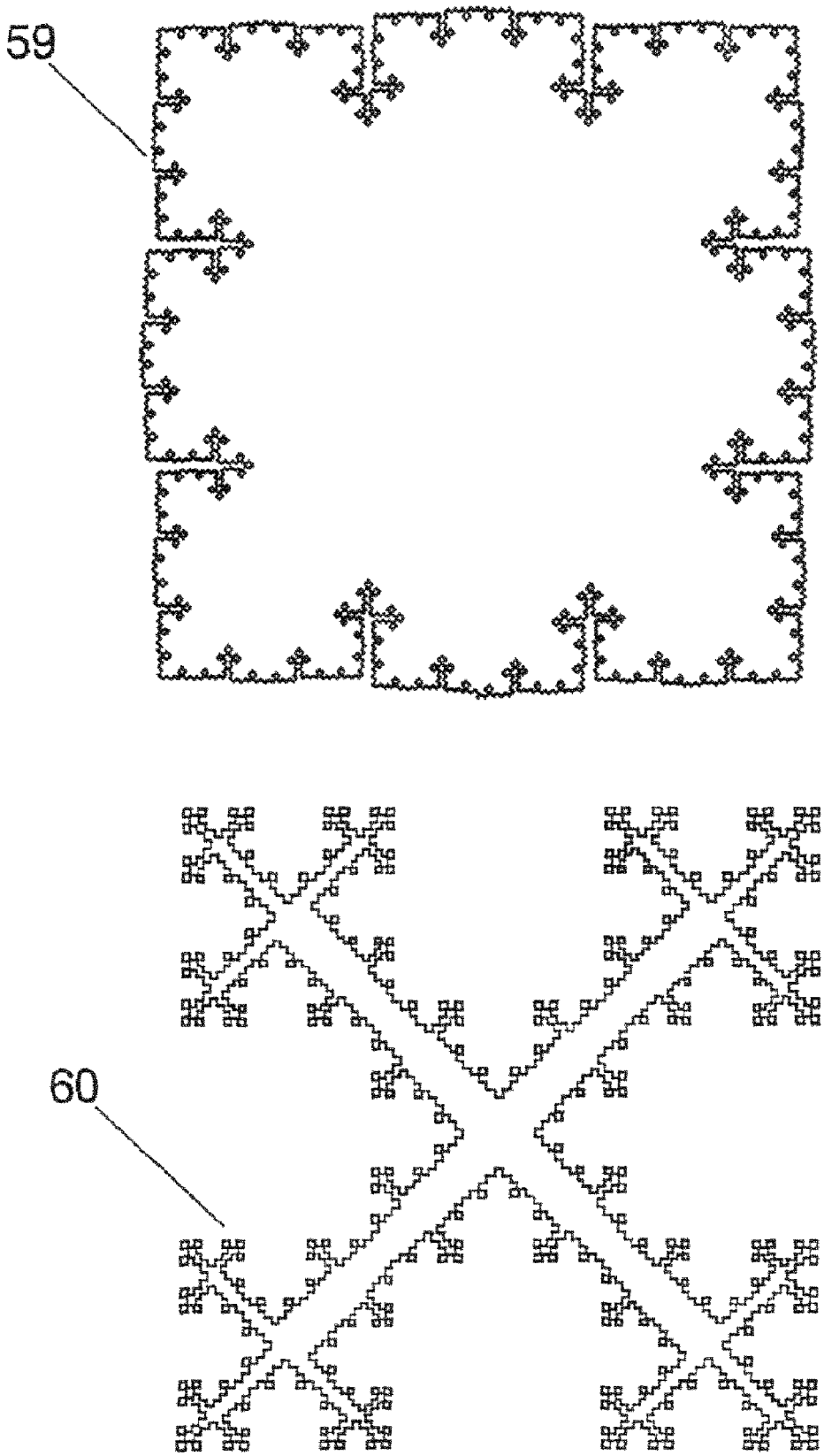
FIG. 21 shows two examples of SFC loops (59, 60) constructed with SFC (57)
Figure 22:
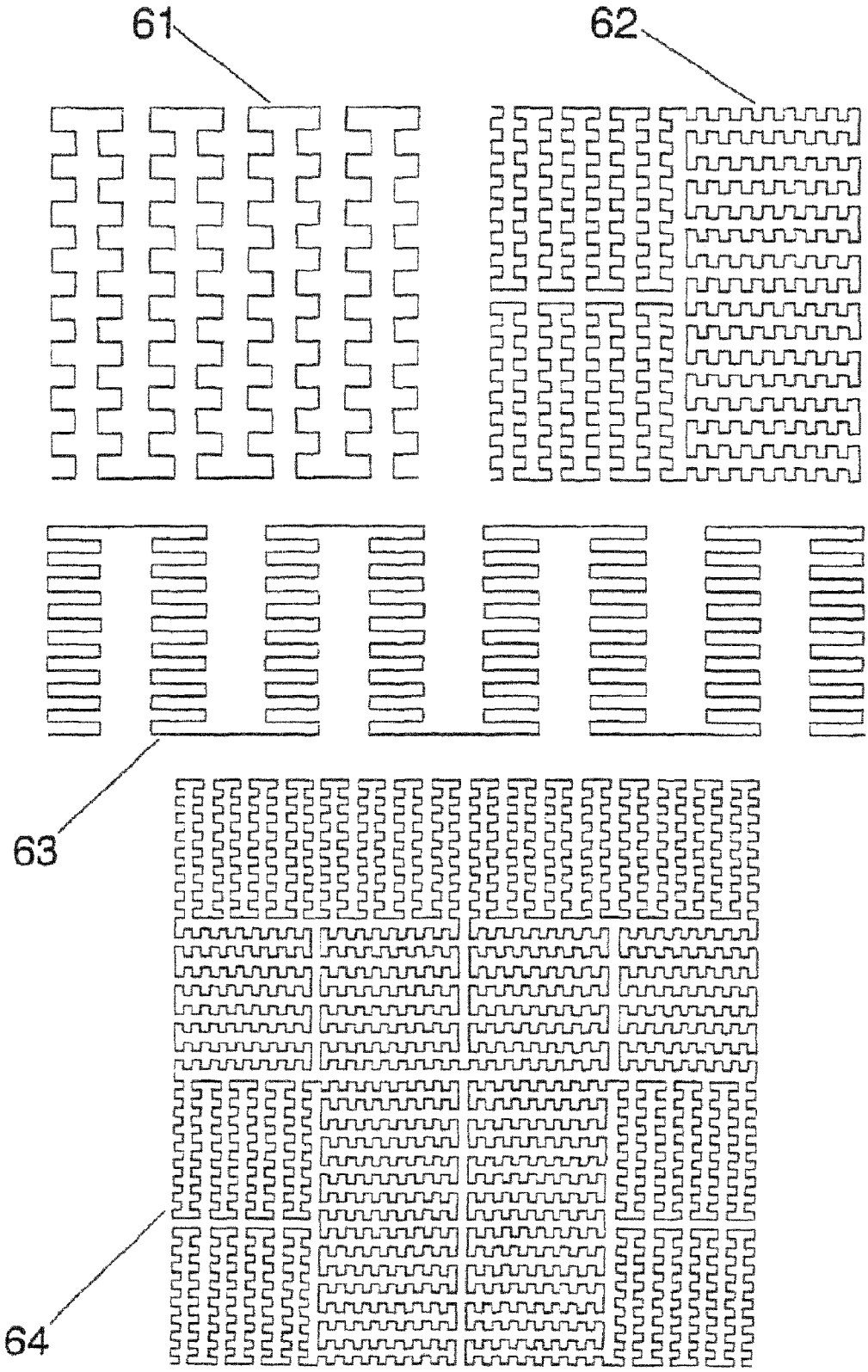
FIG. 22 shows a family of SFC curves (61, 62, 63, 64) named here as HilbertZZ curves.
Figure 23:
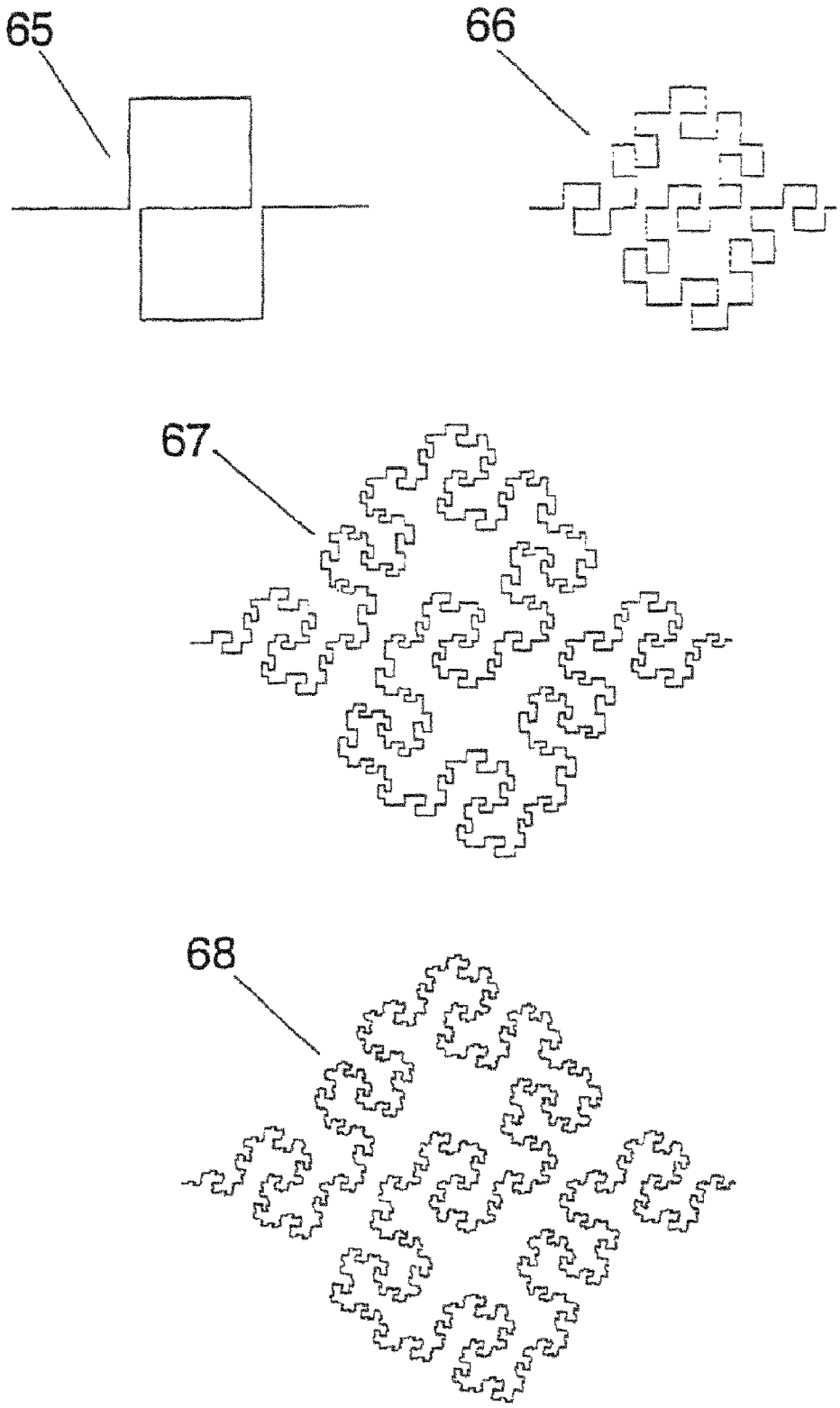
FIG. 23 shows a family of SFC curves (66, 67, 68) named here as Peanodec curves. A non-SFC curve (65) constructed with only nine segments is shown for comparison.
Figure 24:
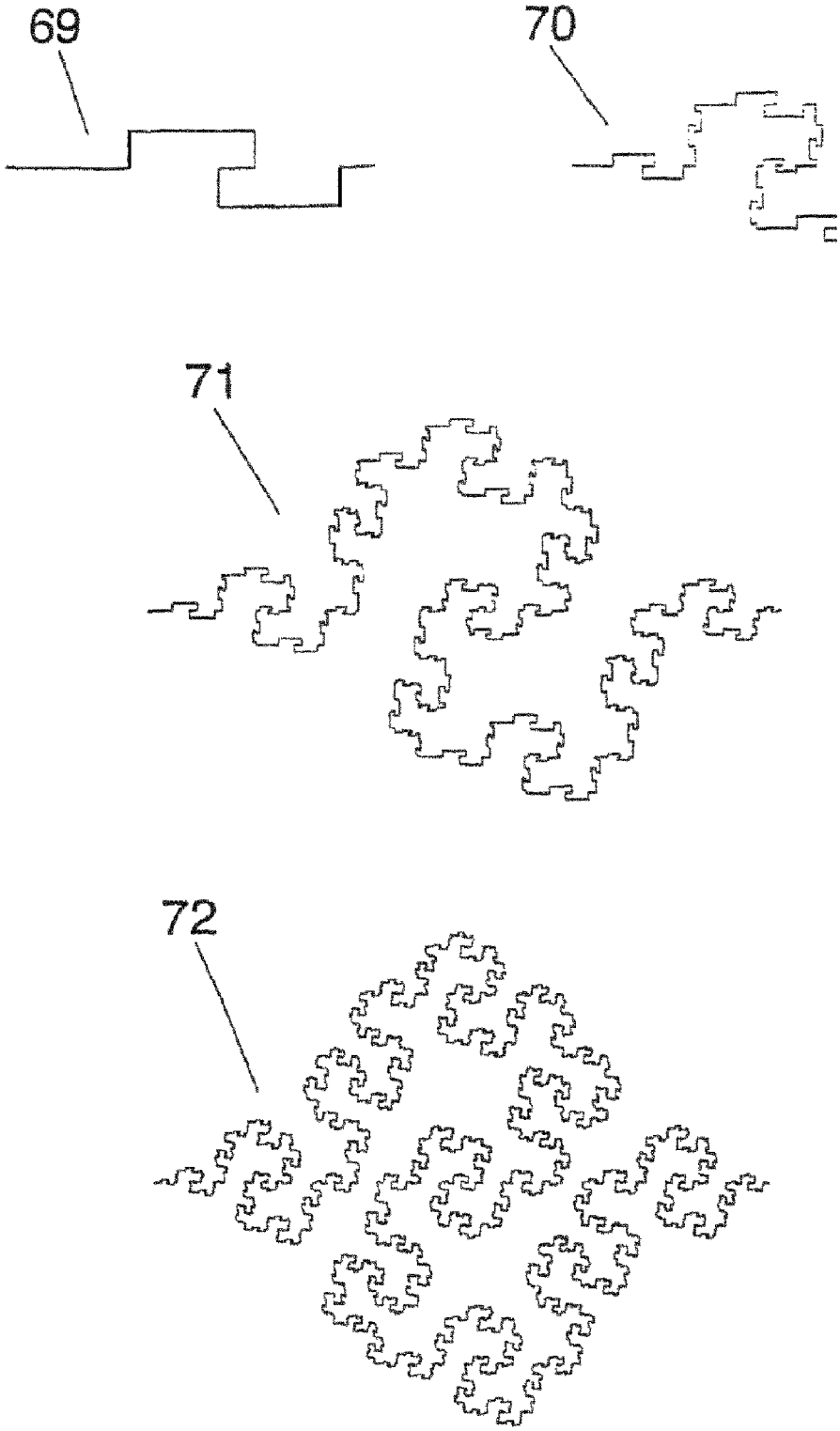
FIG. 24 shows a family of SFC curves (70, 71, 72) named here as Peanoinc curves. A non-SFC curve (69) constructed with only nine segments is shown for comparison.
Figure 25:
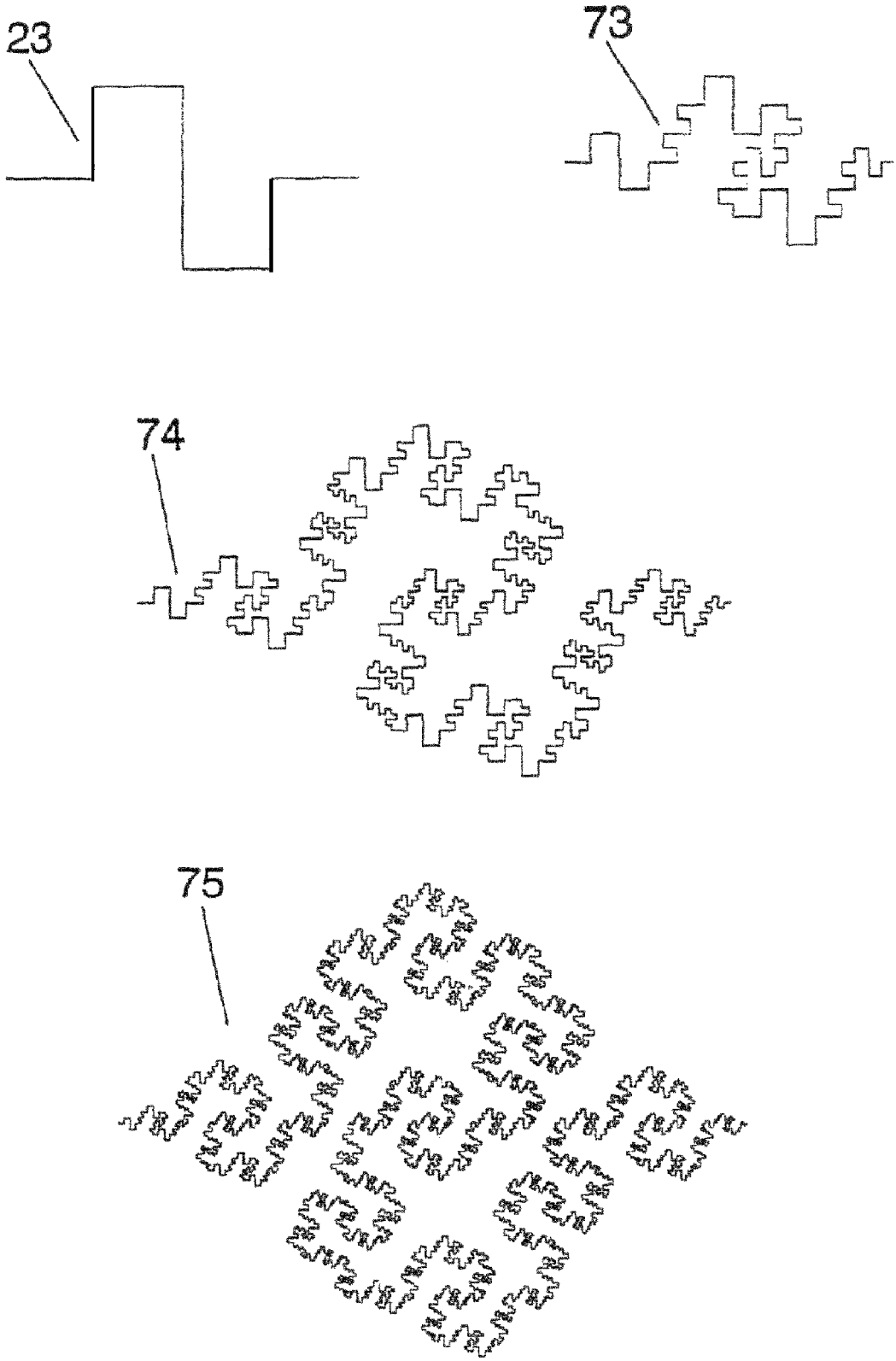
FIG. 25 shows a family of SFC curves (73, 74, 75) named here as PeanoZZ curves. A non-SFC curve (23) constructed with only nine segments is shown for comparison.

FIG. 18 describes another typical configuration of antenna, a reflector antenna (49), with the newly disclosed approach of shaping the reflector perimeter with an SFC curve. The reflector can be either flat or curve, depending on the application or feeding scheme (in for instance a reflectarray configuration the SFC reflectors will preferably be flat, while in focus fed dish reflectors the surface bounded by the SFC curve will preferably be curved approaching a parabolic surface). Also, within the spirit of SFC reflecting surfaces, Frequency Selective Surfaces (FSS) can be also constructed by means of SFC curves; in this case the SFC are used to shape the repetitive pattern over the FSS. In said FSS configuration, the SFC elements are used in an advantageous way with respect to prior art because the reduced size of the SFC patterns allows a closer spacing between said elements. A similar advantage is obtained when the SFC elements are used in an antenna array in an antenna reflectarray.

Having illustrated and described the principles of our invention in several preferred embodiments thereof, it should be readily apparent to those skilled in the art that the invention can be modified in arrangement and detail without departing from such principles. We claim all modifications coming within the spirit and scope of the accompanying claims.

What is claimed is:

1. An apparatus comprising:

a single antenna having a surface that radiates and receives electromagnetic waves, an entirety of an edge enclosing the surface shaped as a substantially non-periodic curve;

said curve comprises a multiplicity of connected segments in which the segments are spatially arranged such that no two adjacent and connected segments form another longer straight segment;

each segment is shorter than one tenth of at least one operating free-space wavelength of the single antenna;

said curve is shaped so that the arrangement of the segments of the curve are not self-similar with respect to the entire curve;

each pair of adjacent segments forms a bend such that said curve has a physical length larger than that of any straight line that can be fitted in the same area in which the segments of the curve are arranged, and so that the resulting antenna curve can be fitted inside the radian sphere of at least one operating frequency of the single antenna;

the single antenna simultaneously receives electromagnetic waves of at least a first and a second operating wavelength, each of the first and second operating wavelengths being respectively within first and second non-overlapping frequency bands; and the first and second non-overlapping frequency bands corresponding respectively to first and second cellular telephone systems.

2. The apparatus as set forth in claim 1, wherein the single antenna radiates across each of at least three cellular telephone system frequency bands.

3. The apparatus as set forth in claim 2, wherein the at least one of the three cellular telephone system frequency bands is UMTS frequency band.

4. The apparatus as set forth in claim 2, wherein the at least three cellular telephone system frequency bands are GSM 1800, PCS 1900, and UMTS.

5. The apparatus as said forth in claim 2, wherein said curve features a box-counting dimension larger than 1.2; and wherein the box-counting dimension is computed as the slope of a substantially straight portion of a line in a log-log graph over at least an octave of scales on the horizontal axes of the log-log graph.

6. The apparatus as said forth in claim 5, wherein said curve features a box-counting dimension larger than 1.3.

7. The apparatus as said forth in claim 5, wherein said curve features a box-counting dimension larger than 1.4.

8. The apparatus as said forth in claim 2, wherein the curve extends across a surface lying in more than one plane.

9. The apparatus as said forth in claim 2, wherein the curve is arranged over two or more surfaces.

10. The apparatus as said forth in claim 2, wherein the curve includes at least 20 segments.

11. The apparatus as said forth in claim 2, wherein the curve includes at least 25 segments.

12. The apparatus as said forth in claim 2, wherein the curve includes at least 30 segments.

13. The apparatus as set forth in claim 1, wherein the single antenna radiates and receives electromagnetic waves across each of at least three cellular telephone system frequency bands.

14. The apparatus as set forth in claim 1, wherein the apparatus is a portable communications device that is designed to operates in at least three cellular telephone system frequency bands.

15. The apparatus as set forth in claim 1, wherein the single antenna comprises multiple elements.

16. The apparatus as set forth in claim 15, wherein the multiple elements include a ground plane.

17. The apparatus as set forth in claim 1, wherein the single antenna radiates across each of at least four cellular telephone system frequency bands.

18. The apparatus as set forth in claim 1, wherein the single antenna radiates and receives electromagnetic waves across each of at least four cellular telephone system frequency bands.

19. The apparatus as set forth in claim 1, wherein the apparatus is a portable communications device that operates in at least four cellular telephone system frequency bands.

20. The apparatus as set forth in claim 1, wherein the single antenna radiates electromagnetic waves across each of at least five cellular telephone system frequency bands.

21. The apparatus as set forth in claim 1, wherein the single antenna radiates and receives electromagnetic waves across each of at least five cellular telephone system frequency bands.

22. The apparatus as set forth in claim 1, wherein the apparatus is a portable communications device that operates in at least five cellular telephone system frequency bands.

23. The apparatus as set forth in claim 1, wherein the first and second non-overlapping frequency bands respectively include GSM 850 and PSC 1900.

24. The apparatus as set forth in claim 1, wherein the first and second non-overlapping frequency bands respectively include GSM 900 and GSM 1800.

25. The apparatus as set forth in claim 1, wherein the first frequency band comprises 1800 MHz.

26. The apparatus as set forth in claim 25, wherein the second frequency band comprises 1900 MHz.

27. The apparatus as set forth in claim 26, wherein the apparatus operates in a third frequency band that comprises 850 MHz.

28. The apparatus as set forth in claim 1, wherein the first frequency band comprises 2100 MHz.

29. The apparatus as set forth in claim 1, wherein the first frequency band comprises 850 MHz and the second frequency band comprises 1900 MHz.

30. The apparatus as set forth in claim 1, wherein the first frequency band comprises 900 MHz and the second frequency band comprises 1800 MHz.

31. The apparatus as set forth in claim 1, wherein the first frequency band comprises 1800 MHz and the second frequency band comprises 2100 MHz.

32. The apparatus of claim 1, wherein the single antenna is a monopole antenna.

33. An antenna, comprising:

A single radiating element a perimeter of which is defined by a multi-segment, irregular curve, each of said segments being spatially arranged such that no two adjacent and connected segments form another longer straight segment and none of said segments intersects with another segment other than at the beginning and at the end of said multi- segment, irregular curve to form a closed loop;

the multi-segment, irregular curve has a box counting dimension larger than one with the box-counting dimension computed as the slope of a substantially straight portion of a line in a log-log graph over at least one octave of scales on a horizontal axis of the log-log graph;

the single antenna radiates at multiple different operating wavelengths;

at least one of the operating wavelengths corresponds to an operating wavelength of a cellular telephone system; and said multi-segment, irregular curve is shaped so that the arrangement of said segments of said multi-segment, irregular curve including bends is not self-similar with respect to the entire multi-segment, irregular curve.

34. The antenna as set forth in claim 33, wherein the antenna is adapted to radiate radiates across each of at least three cellular telephone system frequency bands.

35. The antenna as set forth in claim 34, wherein the at least one of the three cellular telephone system frequency bands is UMTS frequency band.

36. The antenna as set forth in claim 34, wherein the at least three cellular telephone system frequency bands are GSM 1800, PCS 1900, and UMTS.

37. The antenna as said forth in claim 34, wherein said curve features a box-counting dimension larger than 1.2.

38. The antenna as said forth in claim 37, wherein said curve features a box-counting dimension larger than 1.3.

39. The antenna as said forth in claim 37, wherein said curve features a box-counting dimension larger than 1.4.

40. The antenna as said forth in claim 34, wherein the curve extends across a surface lying in more than one plane.

41. The antenna as said forth in claim 34, wherein the curve is arranged over two or more surfaces.

42. The antenna as said forth in claim 34, wherein the curve includes at least 20 segments.

43. The antenna as said forth in claim 34, wherein the curve includes at least 25 segments.

44. The antenna as said forth in claim 34, wherein the curve includes at least 30 segments.

45. The antenna as set forth in claim 33, wherein the antenna radiates and receives electromagnetic waves across each of at least three cellular telephone system frequency bands.

46. The antenna as set forth in claim 33, wherein the antenna is in a portable communications device that operates in at least three cellular telephone system frequency bands.

47. The antenna as set forth in claim 33, wherein the antenna comprises multiple elements.

48. The antenna as set forth in claim 47, wherein the multiple elements include a ground plane.

49. The antenna as set forth in claim 33, wherein the antenna radiates across at least four cellular telephone system frequency bands.

50. The antenna as set forth in claim 33, wherein the antenna radiates and receives electromagnetic waves across each of at least four cellular telephone system frequency bands.

51. The antenna as set forth in claim 33, wherein the antenna is in a portable communications device that operates in at least four cellular telephone system frequency bands.

52. The antenna as set forth in claim 33, wherein the antenna radiates electromagnetic waves across each of at least five cellular telephone system frequency bands.

53. The antenna as set forth in claim 33, wherein the antenna radiates and receives electromagnetic waves across at each of least five cellular telephone system frequency bands.

54. The antenna as set forth in claim 33, wherein the antenna is in a portable communications device that operates in at least five cellular telephone system frequency bands.

55. The antenna as set forth in claim 33, wherein the multiple different operating wavelengths include GSM 1800 and PCS 1900.

56. The antenna as set forth in claim 33, wherein the multiple different operating wavelengths include GSM 850 and GSM 900.

57. The antenna as set forth in claim 33, wherein the antenna operates in a first frequency band at that comprises 1800 MHz.

58. The antenna as set forth in claim 57, wherein the antenna operates in a second frequency band at that comprises 1900 MHz.

59. The antenna as set forth in claim 58, wherein the antenna operates in a third frequency band that comprises 850 MHz.

60. The antenna as set forth in claim 33, wherein the antenna operates in a first frequency band that comprises 2100 MHz.

61. The antenna as set forth in claim 33, wherein the antenna operates in a first frequency band that comprises 1800 MHz and in a second frequency band that comprises 1900 MHz.

62. The antenna as set forth in claim 33, wherein the antenna operates in a first frequency band at that comprises 850 MHz and in a second frequency band that comprises 900 MHz.

63. The antenna as set forth in claim 33, wherein the antenna operates in a first frequency band that comprises 1900 MHz and in a second frequency band that comprises 2100 MHz.

64. An apparatus, comprising:

a single antenna having a surface that radiates and receives electromagnetic waves, an entirety of an edge enclosing the surface shaped as a substantially non-periodic curve;

said curve comprises a set of multiple bends, with the distance between each pair of adjacent bends within said set being shorter than a tenth of a longest operating wavelength of the single antenna;

said curve is shaped so that the arrangement of said of multiple bends is not self-similar with respect to the entire curve, and said curve has a physical length larger than that of any straight line that can be fitted in the same area in which said curve can be arranged; and the single antenna simultaneously receives electromagnetic waves of at least a first and a second operating wavelength and also radiates at multiple different operating wavelength, the first operating wavelength corresponds to an operating wavelength within a first frequency band of a first cellular telephone system and the second operating wavelength corresponds to an operating wavelength within a second frequency band of a second cellular telephone system, the first and second frequency bands being non-overlapping.

65. The apparatus as set forth in claim 64, wherein the single antenna radiates across each of at least three cellular telephone system frequency bands.

66. The apparatus as said forth in claim 65, wherein the curve extends across a surface lying in more than one plane.

67. The apparatus as said forth in claim 65, wherein the curve is arranged over two or more surfaces.

68. The apparatus as said forth in claim 65, wherein the curve includes at least 20 bends.

69. The apparatus as said forth in claim 65, wherein the curve includes at least 25 bends.

70. The apparatus as said forth in claim 65, wherein the curve includes at least 30 bends.

71. The apparatus as set forth in claim 64, wherein the single antenna radiates and receives electromagnetic waves across each of at least three cellular telephone system frequency bands.

72. The apparatus as set forth in claim 64, wherein the apparatus is a portable communications device that operates in at least three cellular telephone system frequency bands.

73. The apparatus as set forth in claim 64, wherein the single antenna comprises multiple elements.

74. The apparatus as set forth in claim 73, wherein the multiple elements include a ground plane.

75. The apparatus as set forth in claim 64, wherein the single antenna radiates across each of at least four cellular telephone system frequency bands.

76. The apparatus as set forth in claim 64, wherein the single antenna radiates and receives electromagnetic waves across each of at least four cellular telephone system frequency bands.

77. The apparatus as set forth in claim 64, wherein the apparatus is a portable communications device that operates in at least four cellular telephone system frequency bands.

78. The apparatus as set forth in claim 64, wherein the single antenna radiates electromagnetic waves across each of at least five cellular telephone system frequency bands.

79. The apparatus as set forth in claim 64, wherein the single antenna radiates and receives electromagnetic waves across each of at least five cellular telephone system frequency bands.

80. The apparatus as set forth in claim 64, wherein the apparatus is a portable communications device that operates in at least five cellular telephone system frequency bands.

81. The apparatus as set forth in claim 64, wherein the multiple different operating wavelengths include GSM 850 and PCS 1900.

82. The apparatus as set forth in claim 64, wherein the multiple different operating wavelengths include GSM 900 and GSM 1800.

83. The apparatus as set forth in claim 64, wherein the apparatus operates in a first frequency band that comprises 1800 MHz.

84. The apparatus as set forth in claim 83, wherein the apparatus operates in a second frequency band that comprises 900 MHz.

85. The apparatus as set forth in claim 84, wherein the apparatus operates in a third frequency band that comprises 850 MHz.

86. The apparatus as set forth in claim 64, wherein the apparatus operates in a first frequency band that comprises 2100 MHz.

87. The apparatus as set forth in claim 64, wherein the apparatus operates in a first frequency band that comprises 850 MHz and in a second frequency band that comprises 1900 MHz.

88. The apparatus as set forth in claim 64, wherein the apparatus operates in a first frequency band that comprises 900 MHz and in a second frequency band that comprises 1800 MHz .

89. The apparatus as set forth in claim 64, wherein the apparatus operates in a first frequency band that comprises 1800 MHz and in a second frequency band that comprises 2100 MHz.

90. The apparatus as set forth in claim 65, wherein the at least one of the three of said cellular telephone system frequency bands is UMTS frequency band.

91. The apparatus as set forth in claim 65, wherein the at least three cellular telephone system frequency bands are GSM 1800, PCS 1900, and UMTS.

92. The apparatus as said forth in claim 65, wherein said curve features a box-counting dimension larger than 1.2; and wherein the box-counting dimension is computed as the slope of a substantially straight portion of a line in a log-log graph over at least an octave of scales on the horizontal axes of the log-log graph.

93. The apparatus as said forth in claim 92, wherein said curve features a box-counting dimension larger than 1.3.

94. The apparatus as said forth in claim 92, wherein said curve features a box-counting dimension larger than 1.4.

95. The apparatus of claim 64, wherein the antenna is a monopole antenna.

96. The apparatus of claim 64, wherein the antenna is a patch antenna.

97. An apparatus, comprising:

a small single antenna in which a perimeter of the antenna is shaped as a substantially irregular, non-periodic curve, with said curve comprising a set of multiple bends and a distance between each pair of adjacent bends within said set being shorter than a tenth of the longest operating wavelength of the antenna;

said curve is shaped so that distances between a pair of consecutive bends are different for at least two pair of bends and the arrangement of said bends is not self-similar with respect to the entire curve, to provide the curve with a physical length larger than that of any straight line that can be fitted in the same area in which said curve can be arranged; and the single antenna simultaneously receives electromagnetic waves of at least a first and a second operating wavelength and also radiates electromagnetic waves at multiple different operating wavelengths, the first operating wavelength corresponds to an operating wavelength within a first frequency band of a first cellular telephone system and the second operating wavelength corresponds to an operating wavelength within a second frequency band of a second cellular telephone system, the first and second frequency bands being non-overlapping.

98. The apparatus as set forth in claim 97, wherein the single antenna radiates radiates across each of at least three cellular telephone system frequency bands.

99. The apparatus as said forth in claim 98, wherein the curve extends across a surface lying in more than one plane.

100. The apparatus as said forth in claim 98, wherein the curve is arranged over two or more surfaces.

101. The apparatus as said forth in claim 98, wherein the curve includes at least 20 bends.

102. The apparatus as said forth in claim 98, wherein the curve includes at least 25 bends.

103. The apparatus as said forth in claim 98, wherein the curve includes at least 30 bends.

104. The apparatus as set forth in claim 97, wherein the single antenna radiates and receives electromagnetic waves across each of at least three cellular telephone system frequency bands.

105. The apparatus as set forth in claim 97, wherein the apparatus is a portable communications device that operates in at least three cellular telephone system frequency bands.

106. The apparatus as set forth in claim 97, wherein the single antenna comprises multiple elements.

107. The apparatus as set forth in claim 106, wherein the multiple elements include a ground plane.

108. The apparatus as set forth in claim 97, wherein the single antenna radiates across at least four cellular telephone system frequency bands.

109. The apparatus as set forth in claim 97, wherein the single antenna radiates and receives electromagnetic waves across each of at least four cellular telephone system frequency bands.

110. The apparatus as set forth in claim 97, wherein the apparatus is a portable communications device that operates in at least four cellular telephone system frequency bands.

111. The apparatus as set forth in claim 97, wherein the single antenna radiates electromagnetic waves across each of at least five cellular telephone system frequency bands.

112. The apparatus as set forth in claim 97, wherein the single antenna radiates and receives electromagnetic waves across at least five cellular telephone system frequency bands.

113. The apparatus as set forth in claim 97, wherein the apparatus is a portable communications device that operates in at least five cellular telephone system frequency bands.

114. The apparatus as set forth in claim 97, wherein the multiple different operating wavelengths include GSM 850 and PCS 1900.

115. The apparatus as set forth in claim 97, wherein the multiple different operating wavelengths include GSM 900 and GSM 1800.

116. The apparatus as set forth in claim 97, wherein the apparatus operates in a first frequency band that comprises 1800 MHz.

117. The apparatus as set forth in claim 116, wherein the apparatus operates in a second frequency band that comprises 900 MHz.

118. The apparatus as set forth in claim 117, wherein the apparatus operates in a third frequency band that comprises 850 MHz.

119. The apparatus as set forth in claim 97, wherein the apparatus operates in a first frequency band at that comprises 2100 MHz.

120. The apparatus as set forth in claim 97, wherein the apparatus operates in a first frequency band that comprises 850 MHz and in a second frequency band that comprises 1900 MHz.

121. The apparatus as set forth in claim 97, wherein the apparatus operates in a first frequency band that comprises 900 MHz and in a second frequency band that comprises 1800 MHz.

122. The apparatus as set forth in claim 97, wherein the apparatus operates in a first frequency band that comprises 1800 MHz and in a second frequency band that comprises 2100 MHz.

123. The apparatus as set forth in claim 98, wherein the at least one of the three cellular telephone system frequency bands is UMTS frequency band.

124. The apparatus as set forth in claim 98, wherein the at least three cellular telephone system frequency bands are GSM 1800, PCS 1900, and UMTS.

125. The antenna as said forth in claim 98, wherein said curve features a box-counting dimension larger than 1.2 and wherein the box counting dimension is computed as the slope of a substantially straight portion of a line in a log log graph over at least an octave of scales on the horizontal axes of the log log graph.

126. The apparatus as said forth in claim 125, wherein said curve features a box-counting dimension larger than 1.3.

127. The apparatus as said forth in claim 125, wherein said curve features a box-counting dimension larger than 1.4.

* * * * *

UNITED STATES PATENT AND TRADEMARK OFFICE

CERTIFICATE OF CORRECTION

PATENT NO. : 8,212,726 B2
APPLICATION NO. : 12/347462
DATED : July 3, 2012
INVENTOR(S) : Carles Puente Baliarda, Edouard Jean Louis Rozan and Jaume Anguera Pros It is certified that error appears in the above-identified patent and that said Letters Patent is hereby corrected as shown below:

On the Title Page, Item (56) please add the following:

The following references were previously filed on December 31, 2008, January 21, 2009, May 7, 2009, November 12, 2009, May 25, 2010, June 10, 2010, August 17, 2010, October 12, 2010, February 3, 2011, March 14, 2011, April 14, 2011, June 3, 2011, June 17, June 21, July 8, 2011, August 31, 2011, December 6, 2011, December 23, 2011, April 10, 2012, May 3, 2012.

Omar, Amjad A. ; Antar, Y. M. M. A new broad band dual frequency coplanar waveguide fed slot antenna. Antennas and Propagation Society International Symposium, 1999. IEEE. July 11, 1999

Hart , N. ; Chalmers , A. Fractal element antennas. Digital Image Computing and Applications 97 in New Zealand. June 2, 1997

Hohlfeld , R. G. ; Cohen N. Self-similarity and the geometric requirements for frequency independence in antennae. Fractals. January 17, 1999

Lauwerier , H. Fractals. Endlessly repeated geometrical figures. Princeton University Press. January 1, 1991

Ohmine , H. et al. A TM mode annular-ring microstrip antenna for personal satellite communication use. IEICE Trans. Commun.. September 1, 1996

Carver , K. R. et al. Microstrip antenna technology, in “Microstrip antennas” to D.M. Pozar; IEEE Antennas and Propagation Society. January 1, 1995

Musser , G. Practical fractals. Scientific American. July 1, 1999

[additional references are listed on the following supplemental pages]

Signed and Sealed this
Ninth Day of July, 2013

Teresa Stanek Rea
*Acting Director of the United States Patent and Trademark Office*

Anguera , J. ; Puente , C. ; Borja , C. A procedure to design wide-band electromagnetically-coupled stacked microstrip antennas based on a simple network model. Antennas and Propagation Society International Symposium, 1999. IEEE. July 11, 1999

Anguera , J. ; Puente , C. ; Borja , C. A procedure to design stacked microstrip patch antennas on a simple network model. Microwave and Optical Technology Letters. August 1, 2001

Garg , R. et al. Microstrip antenna design handbook. Artech House. January 1, 2001

Wimer , M. C. US10/422578 - Office Action dated on October 4, 2004. USPTO. October 4, 2004

Van der Peet , H. EP00909089 - Minutes from Oral Proceedings. EPO. January 28, 2005

Weman , E. EP00909089 - Summons to attend oral proceedings. EPO. October 28, 2004

Carpintero , F. EP00909089 - Response to Office Action dated on February 7, 2003. Herrero y Asociados. August 14, 2003

Carpintero , F. EP00909089 - Written submissions. Herrero y Asociados. December 15, 2004

NA Software - Box counting dimension [electronic]. http://www.sewanee.edu/Physics/PHYSICS123/BOX%20COUNTING%20DIMENSION.html. April 1, 2002

Wimer , M. C. US10/422578 - Office Action dated on April 7, 2005. USPTO. April 7, 2005

Sauer , J. M. US10/422578 - Request for Continued Examination with response to the office action dated on April 7, 2005 and the advisory action dated on June 23, 2005. Jones Day. August 8, 2005

Sauer , J. M. US10/422578 - Response to the Office Action dated on April 7, 2005. Jones Day. May 31, 2005

Sauer , J. M. US10/422578 - Response to the Office Action dated on October 4, 2004. Jones Day. January 6, 2005

Rowell , C. R. ; Murch , R.D. A capacitively loaded PIFA for compact mobile telephone handsets. Antennas and Propagation, IEEE Transactions on. May 1, 1997

Rowell , Corbett R. ; Murch , R. D. A compact PIFA suitable for dual-frequency 900-1800-MHz operation. Antennas and Propagation, IEEE Transactions on. April 1, 1998

Sandlin , B. ; Terzouli , A. J. A genetic antenna desig for improved radiation over earth. Antenna Applications Symposium , Program for 1997 - Allerton Conference Proceedings. September 17, 1997

Brown, A. A high-performance integrated K-band diplexer. Transactions on Microwave Theory and Techniques. August 8, 1999

Nagai , K. ; Mikuni , Y. ; Iwasaki , H. A mobile radio antenna system having a self-diplexing function. IEEE Transactions on Vehicular Technology. November 1, 1979

Foroutan-pour , K. ; Dutilleul , P. ; Smith , D.L. Advances in the implementation of the box-counting method of fractal dimension estimation. Applied Mathematics and Computation ; Elsevier. May 1, 1999

Shimoda , R. Y. A variable impedance ratio printed circuit balun. Antenna Applications Symposium. September 26, 1979

Teeter , W. L. ; Bushore , K. R. A variable-ratio microwave power divider and multiplexer. IRE Transactions on microwave theory and techniques. October 1, 1957

Rosa , J. ; Case E. W. A wide angle circularly polarized omnidirectional array antenna. Symposium on the USAF antenna Research and Development Program , 18th. October 15, 1968

Phelan , R. A wide-band parallel-connected balun. Microwave Theory and Techniques, IEEE Transactions on. May 1, 1970

Gagnepain , J. J. Fractal approach to two-dimensional and three-dimensional surface roughness. Wear. May 1, 1986

Ou , J. D. An analysis of annular, annular sector, and circular sector microstrip antennas. Antenna Applications Symposium. September 23, 1981

Sanchez Hernandez , David et al Analysis and design of a dual-band circularly polarized microstrip patch antenna. Antennas and Propagation, IEEE Transactions on. February 1, 1995

Shnitkin , H. Analysis of log-periodic folded dipole array. Antenna Applications Symposium. September 10 1992

Weeks , W. L. Antenna engineering. McGraw-Hill Book Company. January 1, 1968

Heberling , D. ; Geisser , M. Trends on handset antennas. Microwave Conference, 1999. 29th European. March 3, 1999

Watanabe , T. ; Furutani , K. ; Nakajima , N. et al Antenna switch duplexer for dualband phone (GSM / DCS) using LTCC multilayer technology. IEEE MTT-S International Microwave Symposium Digest. June 19, 1999

Stutzman , W. L. ; Thiele , G. Antenna theory and design. John Wiley and Sons. January 1, 1981

Huang , Qian ; Lorch , J.R. ; Dubes , R. Can the fractal dimension of images be measured?. Pattern Recognition Society. February 1, 1994

Saunders , S. R. Antennas and Propagation for Wireless Communication Systems - Chapter 4. John Wiley & Sons. January 1, 1999

Wegner , D. E. B-70 antenna system. Symposium on the USAF antenna research and development program, 13th. October 14, 1963

Stang , P. F. Balanced flush mounted log-periodic antenna for aerospace vehicles - in Abstracts of the Twelfth Annual Symposium USAF antenna research. Symposium on USAF antenna Research and Development, 12th. October 16, 1962

Rensh , Y. A. Broadband microstrip antenna. Proceedings of the Moscow International Conference on Antenna Theory and Tech. September 22, 1998

Wong , K. L. ; Kuo , J. S. ; Fang , S. T. et al Broadband microstrip antennas with integrated reactive loading. Asia Pacific Microwave Conference. December 3, 1999

Paschen , D. A. Broadband microstrip matching techniques. Antenna Applications Symposium. September 21, 1983

Seavey , John C-band paste-on and floating ring reflector antennas. Symposium on The USAF Antenna Research and Development Program, 23th. October 10, 1973

Wall , H. ; Davies , H. W. Communications antennas for mercury space capsule. Symposium on the USAF antenna research and development program, 11th. October 16, 1961

Turner , E. M. ; Richard , D. J. Development of an electrically small broadband antenna. Symposium on the USAF antenna research and development program, 18th. October 15, 1968

Nishikawa , T., Ishikawa , Y., Hattori , J. and Wakino , K. Dielectric receiving filter with Sharp stopband using an active feedback resonator method for cellular base stations. IEEE Transactions on Microwave Theory and Techniques. December 1, 1989

Nagy , L. L Antenna engineering handbook - Chapter 39 - Automobile antennas. Volakis , J. - McGraw-Hill; 4th edition. January 1, 2007

Turner , E. M. Broadband passive electrically small antennas for TV application. Proceedings of the 1977 Antenna Applications Symposium. April 27, 1977

Stutzman , W. L. ; Thiele , G. A. Antenna theory and design - Chapter 5 - Resonant Antennas: Wires and Patches. Wiley. January 1, 1998

The Glenn L. Martin Company Antennas for USAF B-57 series bombers. Symposium on the USAF antenna research and development program, 2nd. October 19, 1952

Wong , K. L. ; Sze , J. Y. Dual-frequency slotted rectangular microstrip antenna. Electronic Letters. July 9, 1998

Nakano ; Vichien Dual-frequency square patch antenna with rectangular notch. Electronic Letters. August 3, 1989

Tanner , R. L. ; O'Reilly , G. A. Electronic counter measure antennas for a modern electronic reconnaissance aircraft. Symposium on the USAF antenna research and development program, 4th. October 17, 1954

Weeks , W. L. Eletromagnetic theory for engineering applications. John Wiley & Sons. January 1, 1964

Song, C. T. P. Fractal stacked monopole with very wide bandwidth. Electronic Letters. June 1, 1999

Walker , G. J. et al Fractal volume antennas. Electronic Letters. August 6, 1998

NA Nokia 8860 - External photos - OET Exhibits list for FCC ID: LJPNSW-6NX. Federal Communications Commission - FCC. July 8, 1999

NA Nokia 8260. Nokia. September 8, 2000

Rumsey , V. Frequency independent antennas. Academic Press. January 1, 1996

Werner , D. H. Frequency independent features of self-similar fractal antennas. Radio Science. November 1, 1996

Snow , W. L. Ku-band planar spiral antenna. Symposium on The USAF Antenna Research and Development Program, 19th. October 14, 1969

Virga , K. L. Low-profile enhanced-bandwidth PIFA antennas for wireless communications packaging. Microwave Theory and Techniques, IEEE Transactions on. October 10, 1997

Schaubert , D. H. ; Chang , W. C. ; Wunsch , G. J. Measurement of phased array performance at arbitrary scan angles. Antenna Applications Symposium. September 21, 1994

Buczkowski , S. ; Hildgen , P. ; Cartilier , L. Measurements of fractal dimension by box-counting: a critical analysis of data scatter. Physica A. April 1, 1998

Shibagaki , N. ; Sakiyama , K. ; Hikita , M. Miniature saw antenna duplexer module for 1.9GHz PCN systems using saw-resonator-coupled filters. IEEE Ultrasonics Symposium. October 5, 1998

Borja , C. MSPK product. Fractus - Telefonica. January 1, 1998

Song , C. T. P. et al Multi-circular loop monopole antenna. Electronic Letters. March 2, 2000

NA Nokia 3210. Nokia. January 1, 1999

NA Nokia 8210. Nokia. January 1, 1999

NA Nokia 8260 - FCC ID GMLNSW-4DX. Nokia. April 1, 1999

NA Nokia 8265. Nokia. March 4, 2002

NA Nokia 8810. Nokia. January 1, 1998

NA Nokia 8850. Nokia. January 1, 1999

NA Nokia 8860 - Internal photos - FCC ID: LJPNSW-6NX. Nokia and Federal Communications Commission ( FCC ). June 24, 1999

Shenoy , A. et al. Notebook satcom terminal technology development. International Conference on Digital Satellite Communications, 10th. May 15, 1995

Puente , C. ; Romeu , J. ; Cardama , A. ; Pous , R. On the behavior of the Sierpinski multiband fractal antenna. Antennas and Propagation, IEEE Transactions on. April 1, 1998

Borja , C. Panel 01. Fractus - Telefonica. January 1, 1998

Taga , T. Performance analysis of a built-in planar inverted F antenna for 800 MHz band portable radio units. IEEE Journal on Selected Areas in Communications. January 1, 1987

Puente , C. ; Romeu , J. ; Bartolome , R. ; Pous , R. Perturbation of the Sierpinski antenna to allocate operating bands. Electronic Letters. November 21, 1996

Rotman , W. Problems encountered in the design of flush-mounted antennas for high speed aircraft. Symposium on the USAF Antenna Research and Development Program, 2nd. October 19, 1952

Terman , F. E. Radio engineering. McGraw-Hill Book Company, Inc.. January 1, 1947

NA RIM 857 pager. RIM. October 1, 2000

NA RIM 957 page maker. RIM. November 15, 2000

Shibagaki , N. Saw antenna duplexer module using saw-resonator-coupled filter for PCN system. IEEE Ultrasonics symposium. October 5, 1998

Pan, S. et al. Single-feed dual-frequency microstrip antenna with two patches. Antennas and Propagation Society International Symposium, 1999. IEEE. August 1, 1999

Wheeler , H. A. Small antennas. Symposium on the USAF antenna research and development program, 23rd. October 10, 1973

Paschen , D. A. Structural stopband elimination with the monopole-slot antenna. Antenna Applications Symposium. September 22, 1982

Scharfman , W. Telemetry antennas for high altitude missiles. Symposium on the USAF antenna research and development program, 8th. October 20, 1958

NA Rockwell B-1B Lancer. <http://home.att.net/~jbaugher2/newb1_2.html>. October 12, 2001

Wheeler , H. A. The radiansphere around a small antenna. Proceedings of the IRE. August 1, 1959

Sinclair, G. Theory of models of electromagnetic systems. Proceedings of the IRE. November 1, 1948

NA The handbook of antenna design - Index. Rudge, A. W. et al. - Peter Peregrinus - Institution of Electrical Engineers. January 1, 1986

Snow , W. L. UHF crossed-slot antenna and applications. Symsposium on the USAF Antenna Research and Development program, 19th. September 1, 1963

Walsh , J.J. ; Watterson , J. Fractal analysis of fracture patterns using the standard box-counting technique: valid and invalid methodologies. Journal of Structure Geology. March 10, 1993

Besthorn 1.0 to 21.0 GHz Log-periodic dipole antenna. Symposium on the USAF Antenna Research and Development Program, 18th. October 15, 1968

Ishikawa , Y. ; Hattori , J. ; Andoh , M. et al. 800 MHz High Power Bandpass Filter Using TM Dual Mode Dielectric Resonators. European Microwave Conference , 21th. September 9, 1991

Greiser , J. W. and Brown , G. S. A 500:1 scale model of warla : A wide aperture radio location array. Symposium on the USAF Antenna Research and Development Program, 13th. October 14, 1963

Larson , J. A BAW Antenna Duplexer for the 1900 MHz PCS Band. IEEE Ultrasonics Symposium. October 17, 1999

Chen , M.H. A compact EHF/SHF dual frequency antenna. IEEE International Symposium on Antennas and Propagation. May 7, 1990

Hofer , D. A. ; Kesler , Dr. O. B. ; Loyet , L. L. A compact multi-polarized broadband antenna. Proceedings of the 1989 antenna applications symposium. September 20, 1989

Kuhlman , E. A. A directional flush mounted UHF communications antenna for high performance jet aircraft for the 225-400 MC frequency range. Symposium on The USAF Antenna Research and Development Program, 5th. October 1, 1955

Halloran , T. W. A dual channel VHF telemetry antenna system for re-entry vehicle applications. Symposium on the USAF Antenna Research and Development Program, 11th. October 16, 1961

Holtum , A. G. A dual frequency dual polarized microwave antenna. Symposium on the USAF Antenna Research and Development Program, 16. October 11, 1966

Barrick , W. A helical resonator antenna diplexer. Symposium on the USAF antenna research and development program, 10th. October 3, 1960

Liu , D. A multi-branch monopole antenna for dual-band cellular applications. IEEE Antennas and Propagation Society International Symposium. September 3, 1999

Fenwick , R. C. A new class of electrically small antennas. Antennas and Propagation, IEEE Transactions on. May 1, 1965

Bokhari , S. A. ; Zürcher , J.-F. ; Mosig , Juan R. et al A small microstrip patch antenna with a convenient tuning option. Antennas and Propagation, IEEE Transactions on. November 1, 1996

Ferris , J. E. A status report of an Azimuth and elevation direction finder. Symposium on the USAF Antenna Research and Development Program. October 15, 1968

Deng , Sheng-Ming A t-strip loaded rectangular microstrip patch antenna for dual-frequency operation. Antennas and Propagation Society International Symposium, 1999. IEEE. July 1, 1999

May , M. Aerial magic. New Scientist. January 31, 1998

Ellis , A. R. Airborne UHF antenna pattern improvements. Symposium on the USAF antenna research and development program, 3rd. October 18, 1953

Hill , J. E. ; Bass , J. F. An integrated strip-transmission-line antenna system for J-band. Symposium on the USAF Antenna Research and Development Program, 23th. October 10, 1973

Martin , R. W. ; Stangel , J. J. An unfurlable, high-gain log-periodic antenna for space use. Symposium on The USAF Antenna Research and Development Program. November 14, 1967

Lee, J. C. Analysis of differential line lenght diplexers and long-stub filters. Symposium on the USAF Antenna Research and Development, 23th. October 12, 1971

Locus , Stanley S. Antenna design for high performance missile environment. Symposium on the USAF Antenna Research and Development Program, 5th. October 16, 1955

Burnett , G. F. Antenna installations on super constellation airbone early warning and control aircraft. Symposium on the USAF antenna research and development program, 4th. October 17, 1954

Dickstein , Harold D. Antenna system for a ground passive electronic reconnaissance facility. Symposium on the USAF Antenna Research and Development Program. October 20, 1958

Ingerson , P. G. ; Mayes , P. E. Asymmetrical feeders for log-periodic antennas. Symposium on the USAF antenna research and development program, 17th. November 14, 1967

DuHamel , R. H. Broadband logarithmically periodic antenna structures. IRE International Convention Record. March 14, 1957

Gupta , K.C. Broadbanding techniques for microstrip patch antennas - a review. Antenna Applications Sysmposium. September 21, 1988

Hong , J. S. ; Lancaster , M. J. Compact microwave elliptic function filter using novel microstrip meander open-loop resonators. Electronic Letters. March 14, 1996

Jones , H. S. Conformal and Small antenna designs. Proceedings of the Antennas Applications Symposium. August 1, 1981

Munson , R. Conformal microstrip array for a parabolic dish. Symposium on the USAF Antenna Research and Development Program. October 1, 1973

Best , S. R. Demonstratives presented by Dr. Steven Best during trial. Defendants. May 19, 2011

Long , S. Demonstratives presented by Dr. Stuart Long during trial. Fractus. May 18, 2011

Moheb , H. Design and development of co-polarized ku-band ground terminal system for very small aperture terminal (VSAT) application. IEEE International Symposium on Antennas and Propagation Digest. July 11, 1999

McSpadden , J. O. Design and experiments of a high-conversion-efficiency 5.8-GHz rectenna. IEEE Transactions on Microwave Theory and Techniques. December 1, 1998

Esteban , J. ; Rebollar , J. M. Design and optimization of a compact Ka-Band antenna diplexer. AP-S. Digest Antennas and Propagation Society International Symposium. June 18, 1995

Campi , M. Design of microstrip linear array antennas. Antenna Applications Symposium. August 8, 1981

Ikata , O. ; Satoh , Y. ; Uchishiba , H. et al Development of small antenna duplexer using saw filters for handheld phones. IEEE Ultrasonics Symposium. October 31, 1993

NA Digital cellular telecommunications system (Phase 2) : Types of Mobile Stations (MX) (GSM 02.06). ETSI. May 9, 1996

NA Digital cellular telecommunications system (Phase 2+) ; Radio transmission and reception (GSM 05.05). ETSI. July 1, 1996

NA Digital cellular telecommunications system (Phase2) : Abbreviations and acronyms (GSM01.04) GSM Technical Specification vs. 5.0.0. ETSI. March 1, 1996

NA Digital cellular telecommunications system (Phase2). Mobile Station MS Conformance specifiaction Part 1 Conformance Specification GSM11.10-1). ETSI. March 1, 1996

NA Digital cellular telecommunications system (Phase2); Mobile Station (MS) conformance specification; Part 1: Conformance specification (GSM 11.10-1 version 4.21.1). ETSI. August 1, 1998

Kumar , G. ; Gupta , K. Directly coupled multiple resonator wide-band microstrip antennas. IEEE Transactions on Antennas and Propagation. June 6, 1985

Guo , Y. X. ; Luk , K. F. Lee ; Chow , Y. L. Double U-slot rectangular patch antenna. Electronic Letters. September 17, 1998

Chiba , N. et al Dual frequency planar antenna for handsets. Electronic Letters. December 10, 1998

Maci , S. et al. Dual-band Slot-loaded patch antenna. IEE Proceedings Microwave Antennas Propagation. June 1, 1995

Maci , S. et al. Dual-frequency patch antennas. Antennas and Propagation Magazine, IEEE. December 1, 1997

Liu , Zi Dong ; Hall , Peter S. ; Wake , David Dual-frequency planar inverted-f antenna. Antennas and Propagation, IEEE Transactions on. October 1, 1997

Lu , J. H. ; Wong , K. L. Dual-frequency rectangular microstrip antenna with embedded spur lines and integrated reactive loading. Microwave and Optical Technology Letters. May 20, 1999

Gray , D. ; Lu , J. W. ; Thiel , D. V. Electronically steerable Yagi-Uda microstrip patch antenna array. IEEE Transactions on antennas and propagation. May 1, 1998

Misra , S. Experimental investigations on the impedance and radiation properties of a three-element concentric microstrip square-ring antenna. Microwave and Optical TEchnology Letters. February 5, 1996

Cohn , S. B. Flush airborne radar antennas. Symposium on the USAF antenna research and development program, 3rd. October 18, 1953

McDowell , E. P. Flush mounted X-band beacon antennas for aircraft. Symposium on USAF antenna Research and Development, 3th. October 18, 1953

Martin, W. R. Flush vor antenna for c-121 aircraft. Symposium on The USAF Antenna Research and Development Program, 2nd. October 19, 1952

Katsibas , K. D. ; Balanis , C. A. ; Panayiotis , A. T. ; Birtcher , C. R. Folded loop antenna for mobile hand-held units. IEEE Transactions on antennas and propagation. February 1, 1998

Cohen , N. Fractal element antennas. Journal of Electronic Defense. July 1, 1997

Addison , P. S. Fractals and chaos. An illustrated course. Institute of Physics Publishing. January 1, 1997

Kuo , Sam Frequency-independent log-periodic antenna arrays with increased directivity and gain. Symposium on USAF Antenna Research and Development, 21th Annual. October 12, 1971

Gillespie , E. S. Glide slope antenna in the nose radome of the F-104 A and B. Symposium on the USAF antenna research and development program, 7th. October 21, 1957

Holzschuh , D. L. Hardened antennas for atlas and titan missile site communications. Symposium on the USAF Antenna Research and Development Program, 13th. October 14, 1963

Mayes , P. E. High gain log-periodic antennas. Symposium on the USAF antenna research and development program, 10th. October 3, 1960

McDowell , E. P. High speed aircraft antenna problems and some specific solutions for MX-1554. Symposium on the USAF Antenna Research and Development Program, 2nd. October 19, 1952

Hyneman , R. F. ; Mayes , P. E. ; Becker , R. C. Homing antennas for aircraft ( 450 - 2500 MC ). Symposium on the USAF antenna research and development program, 5th. October 16, 1955

Nadan , T. ; coupez , J. P. Integration of an antenna filter device, using a multi-layer, multi-technology process. European Microwave Conference, 28th. October 1, 1988

Gupta , K. C. ; Benalla , A. Microstrip antenna design. Artech House. January 1, 1988

Deschamps , G. Microstrip Microwave Antenna. Symposium on the USAF Antenna Research and Development Program. October 18, 1953

Munson , R. Microstrip phased array antennas. Symposium on The USAF Antenna Research and Development Program, 22th. October 11, 1972

Lancaster , M. J. et al. Miniature superconducting filters. Microwave Theory and Techniques, IEEE Transactions on. July 1, 1996

Mayes , P.E. Multi-arm logarithmic spiral antennas. Symposium on The USAF Antenna Research and Development Program, 10th. October 3, 1960

Isbell , D. E. Multiple terminal log-periodic antennas. Symposium on the USAF antenna research and development program, 8th. October 20, 1958

Cohen, N. NEC4 analysis of a fractalized monofiliar helix in an axial mode. ACES Conference Procedings. April 1, 1998

Hikita , M. ; Shibagaki , N. ; Asai , K. et al New miniature saw antenna duplexer used in GHz-band digital mobile cellular radios. IEEE Ultrasonics Symposium. November 7, 1995

Adcock , M. D New type feed for high speed conical scanning. Symposium on the USAF Antenna Research and Development Program, 2nd. August 11, 1952

Isbell , D. E. Non-planar logarithmically periodic antenna structures. Symposium on the USAF antenna research and development program, 7th. October 21, 1957

Kumar , G. ; Gupta , K. Nonradiating edges and four edges gap-coupled multiple resonator broadband microstrip antennas. Antennas and Propagation, IEEE Transactions on. February 1, 1985

Hagström , P. Novel ceramic antenna filters for GSM / DECT and GSM / PCN network terminals. The 8th IEEE International Symposium on Personal, Indoor and Mobile Radio Communications, 1997. 'Waves of the Year 2000'. PIMRC '97. September 1, 1997

Lu , J.H. ; Tang , C. L. ; Wong , K. L. Novel dual-frequency and broad-band designs of slot-loaded equilateral triangular microstrip antennas. IEEE Transactions on Antennas and Propagation. July 1, 2000

Hong , J. S. ; Lancaster , M. J. Recent advances in microstrip filters for communications and other applications. IEE Colloquium on Advances in Passive Microwave Components (Digest No.: 1997/154). May 22, 1997

Daniel , A. E. ; Kumar , G. Rectangular microstrip antennas with stub along the non-radiating edge for dual band operation. IEEE Antennas and Propagation Society International Symposium Digest. June 18, 1995

Mushiake, Yasuto Self-Complementary Antennas : Principle of Self Complementarity for Constant Impedance. Springer-Verlag. January 1, 1996

Lu , J. H. ; Wong , K. L. Single-feed dual-frequency equilateral-triangular microstrip antenna with pair of spur lines. Electronic Letters. June 11, 1998

Huynh , T. ; Lee , K. F. Single-layer single-patch wideband microstrip antenna. Electronic Letters. August 3, 1995

Lu , Jui-Han et al. Slot-loaded, Meandered Rectangular Microstrip Antenna With Compact Dualfrequency Operation. IEEE Electronics Letters. May 28, 1998

Mayes , P. Some broadband , low-profile antennas. Antenna Applications Symposium. September 18, 1985

Chen , Wen-Shyang Square-ring microstrip antenna with a cross strip for compact circular polarization operation. Antennas and Propagation, IEEE Transactions on. October 1, 1999

Gilbert , R. ; Pirrung , A. ; Kopf , D. et al. Structurally-integrated optically-reconfigurable antenna array. Antenna Applications Symposium. September 20, 1995

Misra , S. ; Chowdhury , S. K. Study of impedance and radiation properties of a concentric microstrip triangular-ring antenna and Its modeling techniques using FDTD method. IEEE Transactions on Antennas and Propagation. April 1, 1998

Force , R. et al. Synthesis of multilayer walls for radomes of aerospace vehicles. Symposium on the USAF Antenna Research and Development Program. November 14, 1967

Bushman , F.W The boeing B-52 all flush antenna system. Symposium on the USAF Antenna Reseach and Development Program, 5th. October 16, 1955

Dyson , J. D. The equiangular spiral antenna. Antennas and Propagation, IRE Transactions on. April 1, 1959

Blackband , W. T. The handbook of antenna design - Chapter 18 - Coaxial transmisison lines and components. Rudge , A. W. et al.Peter Peregrinus. January 1, 1986

Blackband , W. T. The handbook of antenna design - Chapter 18 - Coaxial transmission lines and components. Rudge , A. W. et al - IEE Eletromagnetic Waves Series; Peter Peregrinus Ltd.. January 1, 1986

Andersen , J. B. The handbook of antenna design - Low- and medium-gain microwave antennas. Rudge , A. W. et al - IEE Eletromagnetic Waves Series; Peter Peregrinus Ltd. (2nd ed.). January 1, 1986

Collier , D. ; Shnitkin , H. The monopole as a wideband array antenna element. Antenna Applications Symposium. September 22, 1993

Kurpis , G. P. The New IEEE standard dictionary of electrical and electronics terms. IEEE Standards. January 1, 1993

Dyson , J. D. The non-planar equiangular spiral antenna. Symposium on the USAF Antenna Research and Development Program. October 20, 1958

Lo , Y. T. ; Solomon , D. ; Richards , W. F. Theory and experiment on microstrip antennas. Antenna Applications Symposium. September 20, 1978

Du Plessis , M. ; Cloete , J. H. Tuning stubs for microstrip patch antennas. AP-S. Digest Antennas and Propagation Society International Symposium. June 28, 1993

Batson , D. D. et al VHF unfurlable turnstile antennas. Symposium USAF antenna research and development program, 19th. October 14, 1969

NA IEEE Standard definitions of terms for antennas, IEEE Std. 145-1983. Antenna Standards Committee of the IEEE Antennas and Propagation Group, USA;. June 22, 1983

NA IEEE Standard Dictionary of Electrical and Electronics Terms. IEEE Press (6th ed.). January 1, 1996

Wimer , M. C. US10/822933 - Office Action dated on October 05, 2006. USPTO. October 5, 2006

Robinson, R. T. US10/822933 - Response to Office Action dated on October 5, 2006. Jenkens & Gilchrist. January 4, 2007

NA GSM Technical specification and related materials. ETSI. March 1, 1996

NA Hagenuk mobile phone - Antenna photo - Technical specs - User manual. Hagenuk Telecom GmbH. January 1, 1996

Counter , V. A. ; Margerum , D. L. Flush dielectric disc antenna for radar. Symposium on the USAF antenna research and development program, 2nd. October 19, 1952

Counter , V. A. Flush, re-entrant, impedance phased, circularly polarized cavity antenna for missiles. Symposium on the USAF antenna research and development program, 2nd. October 19, 1952

NA Motorola 2000x pager. Motorola. June 13, 1997

NA Motorola Advisor Elite mobile phone - Antenna photos - User manual. Motorola. January 1, 1997

NA Motorola Advisor Gold FLX pager. Motorola , Inc. August 1, 1996

NA Motorola Bravo Plus pager. Motorola. March 3, 1995

NA Motorola P935. Motorola. August 13, 1997

NA Nokia 3360. Nokia. May 3, 2001

NA RIM 950 product - Photos of. RIM. June 30, 1998

NA Document 0415 - P.R. 4-3 joint claim construction statement. Susman Godfrey. June 14, 2010

Bhavsar , Samir A. Letter ** - Fractus S.A. v. Samsung Electronics Co., Ltd. et al., 6:09-cv-00203 and Fractus S.A. v. LG Electronics Mobilecomm U.S.A., Inc. et al., 6-09-cv-00205 disclosure of material information to the USPTO. Defendants - Baker Botts LLP. August 5, 2010

Balanis, Constantine A. Antenna theory - Analysis and design - Chapter 2 - Fundamental parameters of antennas. John Wiley & Sons. January 1, 1982

Balanis , Constantine A. Antenna theory - Analysis and Design - Chapter 9 / Chapter 14 - Broadband dipoles and matching techniques / Microstrip antennas. Hamilton Printing. January 1, 1982

Pozar , David M. ; Schaubert , Daniel H. Microstrip antennas. The analysis and design of microstrip antennas and arrays. IEEE Press; Pozar, Schaubert. January 1, 1995

Pozar , David M. Microwave Engineering - Chapter 12: Introduction to Microwave Systems. Addison-Wesley. January 1, 1990

Bach Andersen , J. et al. On closely coupled dipoles in a random field. Antennas and Wireless Propagation Letters, IEEE. December 1, 2006

Lu , Jui-Han ; Tang , Chia-Luan ; Wong , Kin-Lu Single-feed slotted equilateral triangular microstrip antenna for circular polarization. Antennas and Propagation, IEEE Transactions on. July 1, 1999

NA Document 1082 - Joint motion to dismiss HTC. Susman Godfrey LLP. September 13, 2011

NA Document 1083 - Order - Final consent judgement HTC. Court. September 15, 2011

NA Document 1088 - Samsung's motion to determine intervening rights in view of new Federal Circuit case law or, in the alternative, to stay the case pending the outcome of reexamination. Defendants. October 19, 2011

NA Document 1091 - Fractus's response to Samsung's motion to determine intervening rights or to stay the case pending the outcome of reexamination. Susman Godfrey LLC. November 2, 2011

NA Document 1092 - Samsung's reply in support of its motion to determine intervening rights in view of new Federal Circuit case law or, in the alternative, to stay the case pending the outcome of reexamination. Defendants. November 14, 2011

Sauer , J. M. US10/181790 - Response to the office action dated on March 2, 2005. Jones Day. March 14, 2005

Sauer , J. M. US10/182635 - Amendment and response to office action dated on December 13, 2004. Jones Day. March 17, 2005

Sauer , J. M. US10/182635 - Amendment and response to office action dated on October 04, 2004. Jones Day. November 12, 2004

Nguyen , H. V. US10/182635 - Notice of Allowance dated on April 11, 2005. USPTO. April 11, 2005

Nguyen , H. V. US10/182635 - Office Action dated on December 13, 2004. USPTO. December 13, 2004

Nguyen , H. V. US10/182635 - Office action dated on October 4, 2004. USPTO. October 4, 2004

Nguyen , H. V. US11/110052 - Notice of Allowance dated on March 29, 2006. USPTO. March 31, 2006

Walker , B. US11/154843 - Amendment and response to office action dated August 2, 2006. Howison and Arnott. August 11, 2006

Nguyen , H. V. US11/154843 - Notice of Allowance dated on October 24, 2006. USPTO. October 24, 2006

Nguyen , H. V. US11/154843 - Office Action dated on August 2, 2006. USPTO. August 2, 2006

Nguyen , H. V. US11/154843 - Office action dated on May 9, 2006. USPTO. May 9, 2006

Nguyen , H. V. US11/179250 - Notice of Allowance dated on January 20, 2007. USPTO. January 26, 2007

Walker , B. US11/686804 - Amendment and response to office action dated April 15, 2008. Howison and Arnott. July 9, 2008

Nguyen , H. V. US11/686804 - Notice of Allowance dated on September 9, 2008. USPTO. September 9, 2008

Nguyen , H. V. US11/686804 - Office action dated on April 15, 2008.. USPTO. April 15, 2008

Nguyen , H. V. US12/498090 - Office Action dated on August 18, 2010. USPTO. August 18, 2010

NA Document 0001 - Complaint for patent infringement. Susman Godfrey. May 5, 2009

NA Document 0111 - Civil cover sheet. Susman Godfrey. May 5, 2009

NA Document 0014 - Amended complaint for patent infringement. Fractus. May 6, 2009

NA Document 0064 - Defendant Pantech Wireless, INC.'S answer, affirmative defenses and counterclaims to Fractus SA' s Amended complaint. Defendants. June 4, 2009

NA Document 0066 - Defendant UTStarcom, Inc's answer affirmative defenses and counterclaims to plaintiff's amended complaint. Defendants. June 8, 2009

NA Document 0073 - Plaintiff Fractus SA' s answer to defendant Pantech Wireless, Inc' s counterclaims. Defendants. June 24, 2009

NA Document 0079 - Plaintiff Fractus SA' s answer to defendant UTStarcom, Inc' s counterclaims. Fractus. June 29, 2009

NA Document 0091 - Answer, affirmative defenses and counterclaims to the amended complaint for patent infringement on behalf of Defendant Personal Communications Devices Holdings, LLC. Defendants. July 20, 2009

NA Document 0099 - Defendant Sanyo North America Corporation's partial answer to amended complaint for patent infringement. Defendants. July 20, 2009

NA Document 0099 - Defendant Sanyo North America Corporation's partial answer to amended complaint for patent infringement. Defendants. July 20, 2009

NA Document 0106 - Kyocera Communications Inc's answer, affirmative defenses and counterclaims to plaintiff's amended complaint. Defendants. July 21, 2009

NA Document 0107 - Kyocera Wireless Corp's answer, affirmative defenses and counterclaims to plaintiff's amended complaint. Defendants. July 21, 2009

NA Document 0108 - Palm Inc.'s answer, affirmative defenses and counterclaims to plaintiff's amended complaint. Defendants. July 21, 2009

NA Document 0032 - Defendants LG Electronics Mobilecomm USA., Inc.'s answer and counterclaim to complaint. Defendants. October 1, 2009

NA Document 0180 - Defendants Samsung Electronics Co., Ltd.'s; Samsung Electronics Research Institute's and Samsung Semiconductor Europe GMBH' s answer; and Samsung Telecommunications America LLC' s answer and counterclaim. Defendants. October 1, 2009

NA Document 0185 - Defendants Research in Motion LTD, and Research in Motion Corporation's answers, defenses and counterclaims to plaintiff's amended complaint. Defendants. October 1, 2009

NA Document 0187 - Defendants LG Electronics Inc., LG Electronics USA, Inc., and LG Electronics Mobilecomm USA Inc. answer and counterclaim to amended complaint. Defendants. October 1, 2009

NA Document 0190 - Defendant HTC Corporation's First amended answer and counterclaim to plaintiff's amended complaint. Defendants. October 2, 2009

NA Document 0191 - Defendant HTC America, Inc's first amended answer and counterclaims to plaintiff's amended complaint. Defendants. October 2, 2009

NA Letter from Baker Botts to Kenyon & Kenyon LLP, Winstead PC and Howison & Arnott LLP including exhibits.. Defendants - Baker Botts. October 28, 2009

NA Document 0222 - Second amended complaint for patent infringement. Susman Godfrey. December 2, 2009

NA Document 0227 - Second amended complaint for patent infringement - Case 6:09-cv-00203. Fractus. December 8, 2009

NA Request for Inter Partes reexamination of US Patent 7015868 - OTH-A ** - Civil Action Case 6:09cv-0203 - Second Amended Complaint for patent infringement. Fractus. December 8, 2009

NA Document 0235 - Answer, affirmative defenses and counterclaims to the second amended complaint for patent infringement on behalf of Defendant Personal Communications Devices Holdings, LLC. Defendants. December 17, 2009

NA Document 0238 - Defendant HTC America, Inc's answer and counterclaims to plaintiff's second amended complaint. Defendants. December 21, 2009

NA Document 0239 - Defendant HTC Corporation's answer and counterclaims to plaintiff's second amended complaint. Defendants. December 21, 2009

NA Document 0241 - Defendant Research in Motion LTD and Research in Motion Corporation's second answer, defenses and counterclaims to plaintiff's second amended complaint. Defendants. December 21, 2009

NA Document 0242 - Defendant Pantech Wireless, Inc's answer, affirmative defenses and counterclaims to Fractus SA's second amended complaint. Defendants. December 21, 2009

NA Document 0243 - Defendant Sanyo Electric Co. LTD's answer to second amended complaint for patent infringement. Defendants. December 22, 2009

NA Document 0244 - Defendant Sanyo North America Corporation's answer to second amended complaint for patent infringement. Defendants. December 22, 2009

NA Document 0246 - Defendant UTStarcom, Inc's answer, affirmative defenses and counterclaims to Fractus SA's second amended complaint. Defendants. December 22, 2009

NA Document 0247 - Palm, Inc's answer, affirmative defenses and counterclaims to plaintiff's second amended complaint. Defendants. December 22, 2009

NA Document 0248 - Kyocera Communications, Inc's answer, affirmative defenses and counterclaims to plaintiff's second amended complaint. Defendants. December 22, 2009

NA Document 0249 - Kyocera Wireless Corp's answer, affirmative defenses and counterclaims to plaintiff's second amended complaint. Defendants. December 22, 2009

NA Document 0250 - Defendants Samsung Electronics Co., Ltd.'s; Samsung Electronics answer and counterclaim to the second amended complaint of plaintiff Fractus. Defendants. December 23, 2009

NA Document 0251 - Defendants LG Electronics Inc., LG Electronics USA, Inc., and LG Electronics Mobilecomm USA Inc. answer and counterclaim to second amended complaint. Defendants. December 28, 2009

NA Document 0252 - Answer of the Sharp Defendants to plaintiff's second amended complaint. Defendants. December 29, 2009

NA Defendant's Invalidity Contentions including apendix B and exhibits 6, 7, 10, 11 referenced in Space Filling Antenna. Defendants. February 24, 2010

NA Document 0290 - Defendant HTC America, Inc.'s amended answer and counterclaim to plaintiff's second amended complaint. Defendants. February 24, 2010

NA Document 0291 - Defendant HTC Corporation's amended answer and counterclaim to plaintiff's second amended complaint. Defendants. February 24, 2010

NA Document 0297 - Defendant HTC Corporation's amended answer and counterclaim to plaintiff's second amended complaint. Defendants. February 25, 2010

NA Document 0298 - Defendant HTC America, Inc.'s amended answer and counterclaim to plaintiff's second amended complaint. Defendants. February 25, 2010

Paschen , D. A. ; Olson , S. A crossed-slot antenna with an infinite balun feed. Antenna Applications Symposium, 1995.. September 20, 1995

McCormick , J. A Low-profile electrically small VHF antenna. 15th Annual Symposium on the USAF antenna reserach and development program. October 12, 1965

Feder, J. Fractals. Plenum Press. January 1, 1988

Felgel-Farnholz , W. D. PCT/EP00/00411 - International preliminary examination report dated on August 29, 2002 - Notification concerning documents transmitted. European Patent Office ( EPO ). August 29, 2002

Felgel-Farnholz , W. D. PCT/EP00/00411 - Invitation to restrict or to pay additional fees dated on March 5, 2002. International Preliminary Examination Authority - European Patent Office. March 5, 2002

Fleishmann , M. ; Tildesley , DJ ; Balls , RC Fractals in the natural sciences. Royal Society of London. January 1, 1999

Fontenay , P. EP05012854 - Communication of the board of appeal. EPO. December 30, 2010

Graf, R Modern dictionary of electronics. Butterworth-Heinemann (6th Ed.). January 1, 1984

Henderson West , B The Prentice-Hall encyclopedia of mathematics. Prentice-Hall. January 1, 1982

Jaggard , D. Diffraction by Bandlimited Fractal Screens. Optical Society AM. June 1, 1987

Johnson , R. C. Antenna engineering handbook - Table of contents. McGraw-Hill. January 1, 1993

Kim , R. C. US95/000592 - Request for inter partes reexamination for US patent 7202822 including exhibits from CC1 to CC6. Kyocera. November 16, 2010

Kraus , John D. Antennas. McGraw-Hill Book Company. January 1, 1988

Kritikos , H.N. ; Jaggard , D.L. Recent advances in electromagnetic theory - Chapter 6 On fractal electrodynamics. Springer - Verlag. October 1, 1990

Lancaster , M. J. et al Superconducting filters using slow-wave transmission lines. Advances in superconductivity. New materials, critical current and devices. Proceedings of the international symposium. New age int, New Delhi, India. January 1, 1996

Borowski , E. J. Dictionary of Mathematics. Collins - Case 6:09-cv-00203-LED-JDL. January 1, 1989

Sawaya , K. ; Ishizone , T. ; Mushiake , Y. A simplified Expression of Dyadic Green's Function for a Conduction Half Sheet Vol. AP-29, No. 5 (Sept. 1981). IEEE TRANSACTIONS ON ANTENNAS & PROPAGATION. September 1, 1981

NA American Heritage College Dictionary (1997). Pags 340 and 1016. Mifflin Comp. Case 6:09-cv-00203-LED-JDL. January 1, 1997

NA American Heritage Dictionary of the English Language. Houghton Mifflin Company. January 1, 2000

Pozar , David M. ; Newman , E. Analysis of a Monopole Mounted near or at the Edge of a Half-Plane. IEEE Transactions on Antennas and Propagation. May 1, 1981

Tai , Chen to ; Long , Stuart. Antenna engineering handbook - Chapter 4 - Dipoles and Monopoles. Johnson , R. Mc Graw Hill - (3rd Ed.). January 1, 1993

Stutzman , W. L. ; Thiele , G. A. Antenna theory and design. John Wiley and Sons. January 1, 1998

Meier , K. ; Burkhard , M. ; Schmid , T. et al Broadband calibration of E-field probes in Lossy Media. IEEE Transactions on Microwave Theory and Techniques. October 1, 1996

Peitgen et al, H O Chaos and fractals : new frontiers of science. Springer-Verlag. January 1, 1992

NA Document 0175 - Defendant HTC Corporation's amended answer and counterclaim to plaintiff's second amended complaint. Defendants. September 25, 2009

NA Document 0176 - Defendant HTC America Inc's answer and counterclaim to plaintiff's amended complaint. Defendants. September 25, 2009

NA Claim construction and motion for summary judgement - Markman Hearing - [Defendants]. Defendants. September 2, 2010

NA CN00818542 - Response to Office Action dated on November 5, 2004. Herrero Asociados. March 31, 2005

Phan , T. G. US10/102568 - Office Action dated on January 23, 2004. USPTO. January 23, 2004

NA CN01823716 - Office action dated on February 16, 2007. CCPIT Patent and Trademark Law Office - Chinese Patent Office. February 16, 2007

Menefee , J. A. US95/001413 - US95/000593 - US95/000598 - Office action for the US patent 7148850 dated on October 8, 2010. USPTO. October 8, 2010

NA CN01823716 - Response to the office action dated on February 16, 2007. CCPIT Patent and Trademark Law Office - Chinese Patent Office. August 21, 2007

NA Collins Dictionary. Collins. January 1, 1979

NA Document 0217 - Defendants Research in Motion LTD, and Research in Motion Corporation's amended answer, defenses and counterclaims to plaintiff's amended complaint. Defendants. November 24, 2009

Wolin , H. A. US10/102568 - Preliminary Amendment - Exhibit CCCC. Rosenman & Colin LLP. March 18, 2002

Mithani , S. US10/797732 - Response to Office Action dated August 9, 2007. Winstead. November 8, 2007

Love , J. D. Document 0475 - Order. Provisional claim construction and motion for summary judgement. Provisional markman order. Court. November 9, 2010

Love , J. D. Document 0526 - Memorandum order and opinion. Court. December 17, 2010

NA Document 0575 - Fractus ´s Objections to claim construction memorandum and order. Susman Godfrey. January 14, 2011

NA Document 0255 - Plaintiff Fractus, S. A.'s answer to defendant Personal Communications Devices Holdings, LLC's counterclaims to the Second Amended Complaint. Susman Godfrey. January 4, 2010

NA Document 0256 - Plaintiff Fractus, S. A.'s answer to the counterclaims of defendants Research in Motion LTD. and Research in Motion Corporation to the Second Amended Complaint. Susman Godfrey. January 4, 2010

NA Document 0257 - Plaintiff Fractus, S. A.'s answer to counterclaims of defendant Pantech Wireless, Inc. to the Second Amended Complaint. Susman Godfrey. January 4, 2010

NA Document 0258 - Plaintiff Fractus, S. A.'s answer to defendant Kyocera Communications, Inc's Counterclaims to the Second Amended Complaint. Susman Godfrey. January 4, 2010

NA Document 0259 - Plaintiff Fractus, S. A.'s answer to defendant Kyocera Wireless Corp's Counterclaims to the Second Amended Complaint. Susman Godfrey. January 4, 2010

NA Document 0260 - Plaintiff Fractus, S. A.'s answer to defendant Palm, Inc's Counterclaims to the Second Amended Complaint. Susman Godfrey. January 4, 2010

NA Document 0261 - Plaintiff Fractus, S. A.'s answer to defendant UTStarcom, Inc's Counterclaims to the Second Amended Complaint. Susman Godfrey. January 4, 2010

NA Document 0262 - Plaintiff Fractus, S. A.'s answer to counterclaims of defendant Samsung Telecommunications America LLC to the Second Amended Complaint. Susman Godfrey. January 4, 2010

NA Document 0263 - Plaintiff Fractus, S. A.'s answer to counterclaims of defendants LG Electronics Inc., Electronics USA, Inc., and LG Electronics Mobilecomm USA, Inc. to the Second Amended Complaint. Susman Godfrey. January 4, 2010

NA Document 0273 - Plaintiff Fractus, S. A.'s answer to counterclaims of defendants HTC America, Inc to the Second Amended Complaint. Susman Godfrey. January 14, 2010

NA Document 0286 - Amended answer of the Sharp defendants to plaintiff's second amended complaint. Defendants. February 24, 2010

NA Document 0287 - Defendants Samsung Electronics Co., Ltd.'s; Samsung Electronics Research Institute's and Samsung Semiconductor Europe GMBH' s first amended answer; and Samsung Telecommunications America LLC' s first amended answer. Defendants. February 24, 2010

NA Document 0288 - Defendants LG Electronics Inc., LG Electronics USA, Inc., and LG Electronics Mobilecomm USA Inc. First amended answer and counterclaim to second amended complaint. Defendants. February 24, 2010

NA Document 0351 - Plaintiff Fractus, S. A.'s answer to amended counterclaims of defendant Samsung Telecommunications America LLC's to Fractus's Second Amended Complaint. Susman Godfrey. April 1, 2010

NA Document 0352 - Plaintiff Fractus, S. A.'s answer to amended counterclaims of defendant HTC Corporation to Fractus's Second Amended Complaint. Susman Godfrey. April 1, 2010

NA Document 0353 - Plaintiff Fractus, S. A.'s answer to amended counterclaims of defendant HTC America, Inc. To Fractus's Second Amended Complaint. Susman Godfrey. April 1, 2010

NA Document 0354 - Plaintiff Fractus, S. A.'s answer to amended counterclaims of defendant LG Electronics Inc., LG Electronics USA, Inc., and LG Electronics Mobilecomm USA Inc's to Fractus's Second Amended Complaint. Susman Godfrey. April 1, 2010

NA Document 0430 - Defendants RIM, Samsung, HTC, LG and Pantech's response to plaintiff Fractus SA's opening claim construction brief - Exhibit 1 - Chart of Agreed Terms and Disputed Terms. Defendants. July 30, 2010

NA Document 0430 - Defendants RIM, Samsung, HTC, LG and Pantech's response to plaintiff Fractus SA's opening claim construction brief - Exhibit 2 - Family Tree of Asserted Patents. Defendants. July 30, 2010

NA Document 0430 - Defendants RIM, Samsung, HTC, LG and Pantech's response to plaintiff Fractus SA's opening claim construction brief - Exhibit 33 - Excerpt from Plaintiff's '868 pat. inf.cont.for Samsung SPH M540. Defendants. July 30, 2010

NA Document 0430 - Defendants RIM, Samsung, HTC, LG and Pantech's response to plaintiff Fractus SA's opening claim construction brief - Exhibit 34 - Excerpts from Plaintiff's '431 patent Infringement Contentions of HTC Diamond. Defendants. July 30, 2010

NA Document 0430 - Defendants RIM, Samsung, HTC, LG and Pantech's response to plaintiff Fractus SA's opening claim construction brief - Exhibit 41 - Demonstrative re: counting segments. Defendants. July 30, 2010

NA Document 0430 - Defendants RIM, Samsung, HTC, LG and Pantech's response to plaintiff Fractus SA's opening claim construction brief - Exhibit 42 - Demonstrative showing how straight segments can be fitted over a curved surface. Defendants. July 30, 2010

NA Document 0430 - Defendants RIM, Samsung, HTC, LG and Pantech's response to plaintiff Fractus SA's opening claim construction brief - Exhibit 57 - Excerpts from Plaintiff's '868 and '762 Pat. Infr. cont. for RIM 8310. Defendants. July 30, 2010

Pressley, A Elementary Differential Geometry. Springer. January 1, 2000

NA EP00909089 - Claims. Herrero y Asociados. January 28, 2005

Naik , A. ; Bathnagar , P. S. Experimental study on stacked ring coupled triangular microstrip antenna. Antenna Applications Symposium, 1994. September 21, 1994

Lyon , J. ; Rassweiler , G. ; Chen , C. Ferrite-loading effects on helical and spiral antennas. 15th Annual Symposium on the USAF antenna reserach and development program. October 12, 1965

Mehaute, A. Fractal Geometrics. CRC Press - Case 6:09-cv-00203-LED-JDL. January 1, 1990

NA FractalComs web - www.tsc.upc.es/fractalcoms/. Univeritat Politecnica de Catalunya.

Nelson , Thomas R. ; Jaggard , Dwight L. Fractals in the Imaging Sciences. J. Optical Society AM.. January 1, 1999

Puente , C. ; Romeu , J. ; Cardama , A. Fractal-shaped antennas. Frontiers in electromagnetics - IEEE Press. January 1, 2000

NA Fractus' Claim Construction Presentation - Markman Hearing. Fractus. September 2, 2010

NA Fractus web - www.fractus.com/main/fractus/corporate/. Fractus SA. October 7, 2010

Werner , D. H and Mittra , R. Frontiers in electromagnetics. IEEE Press. January 1, 2000

Matthaei , George L. et al. Hairpin-comb filters for HTS and other narrow-band applications. Microwave Theory and Techniques, IEEE Transactions on. August 1, 1997

NA IEEE Standard dictionary of electrical and electronics terms. IEEE Standard (6th ed.). January 1, 1996

NA Int'l Electro-Technical Commission IEV No. 712-01-04 - Electropedia : the world's online electrotechnical vocabulary. Electropedia - Commission Electrotechnique Internationale - http://www.electropedia.org. April 1, 1998

NA Letter from Baker Botts to Howison & Arnott LLP including exhibits. Defendants - Baker Botts. August 5, 2010

NA Letter to FCC - Application form 731 and Engineering Test Report by Nokia Mobile Phones for FCC ID: LJPNSW-6NX. M. Flom Associates. April 1, 1999

Parker , S. McGraw-Hill Dictionary of Scientific and Technical Terms (5th ed. 1994). McGraw-Hill - Case 6:09-cv-00203-LED-JDL. January 1, 1994

Sclater , N. ; Markus , J. McGraw-Hill Electronics Dictionary. Mc-Graw Hill. January 1, 1997

NA Merriam-Webster's Collegiate Dictionary (1993) - Declaration of J. Baxter - Exhibit CC. Merriam-Webster's. Case 6:09-cv-00203-LED-JDL. January 1, 1993

Matthaei , George L. Microwave filters impedance-matching networks and coupling structures. Artech House. January 1, 1980

Falconer , K. Fractal geometry. Mathematical foundations and applications. John Wiley and Sons. January 1, 1990

Mandelbrot , B. B. Opinions (Benoit B. Mandelbrot). World Scientific Publishing Company - Case 6:09-cv-00203-LED-JDL. January 1, 1993

NA The Random House Dictionary. Random House. January 1, 1984

Collier , C. P. Geometry for teachers. Waveland Press, Inc.. January 1, 1984

Cristal , E. G. et al Hairpin-line and hybrid hairpin-line / Half-wave parallel-coupled-line filers. Microwave Theory and Techniques, IEEE Transactions on. November 1, 1972

NA Infringement Chart - Blackberry 8100. Patent: 7148850. Fractus. November 5, 2009

NA Infringement Chart - Blackberry 8100. Patent: 7202822. Fractus. November 5, 2009

NA Infringement Chart - Blackberry 8110. Patent: 7148850. Fractus. November 5, 2009

NA Infringement Chart - Blackberry 8110. Patent: 7202822. Fractus. November 5, 2009

NA Infringement Chart - Blackberry 8120. Patent: 7148850. Fractus. November 5, 2009

NA Infringement Chart - Blackberry 8120. Patent: 7202822. Fractus. November 5, 2009

NA Infringement Chart - Blackberry 8130. Patent: 7148850. Fractus. November 5, 2009

NA Infringement Chart - Blackberry 8130. Patent: 7202822. Fractus. November 5, 2009

NA Infringement Chart - Blackberry 8220. Patent: 7148850. Fractus. November 5, 2009

NA Infringement Chart - Blackberry 8220. Patent: 7202822. Fractus. November 5, 2009

NA Infringement Chart - Blackberry 8310. Patent: 7148850. Fractus. November 5, 2009

NA Infringement Chart - Blackberry 8310. Patent:7202822. Fractus. November 5, 2009

NA Infringement Chart - Blackberry 8320. Patent: 7148850. Fractus. November 5, 2009

NA Infringement Chart - Blackberry 8320. Patent: 7202822. Fractus. November 5, 2009

NA Infringement Chart - Blackberry 8330. Patent: 7148850. Fractus. November 5, 2009

NA Infringement Chart - Blackberry 8330. Patent: 7202822. Fractus. November 5, 2009

NA Infringement Chart - Blackberry 8820. Patent: 7148850. Fractus. November 5, 2009

NA Infringement Chart - Blackberry 8820. Patent: 7202822. Fractus. November 5, 2009

NA Infringement Chart - Blackberry 8830. Patent: 7148850. Fractus. November 5, 2009

NA Infringement Chart - Blackberry 8830. Patent: 7202822. Fractus. November 5, 2009

NA Infringement Chart - Blackberry 8900. Patent: 7148850. Fractus. November 5, 2009

NA Infringement Chart - Blackberry 8900. Patent: 7202822. Fractus. November 5, 2009

NA Infringement Chart - Blackberry 9630. Patent: 7148850. Fractus. November 5, 2009

NA Infringement Chart - Blackberry 9630. Patent: 7202822. Fractus. November 5, 2009

NA Infringement Chart - Blackberry Bold 9000. Patent: 7148850. Fractus. November 5, 2009

NA Infringement Chart - Blackberry Bold 9000. Patent: 7202822. Fractus. November 5, 2009

NA Infringement Chart - Blackberry Storm 9530. Patent: 7148850. Fractus. November 5, 2009

NA Infringement Chart - Blackberry Storm 9530. Patent: 7202822. Fractus. November 5, 2009

NA Infringement Chart - HTC Dash. Fractus. November 5, 2009

NA Infringement Chart - HTC Dash. Patent: 7148850. Fractus. November 5, 2009

NA Infringement Chart - HTC Dash. Patent: 7202822. Fractus. November 5, 2009

NA Infringement Chart - HTC Diamond. Fractus. November 5, 2009

NA Infringement Chart - HTC Diamond. Patent: 7148850. Fractus. November 5, 2009

NA Infringement Chart - HTC Diamond. Patent: 7202822. Fractus. November 5, 2009

NA Infringement Chart - HTC G1 Google.. Fractus. November 5, 2009

NA Infringement Chart - HTC G1 Google. Patent: 7148850. Fractus. November 5, 2009

NA Infringement Chart - HTC G1 Google. Patent: 7202822. Fractus. November 5, 2009

NA Infringement Chart - HTC My Touch.. Fractus. November 5, 2009

NA Infringement Chart - HTC My Touch. Patent: 7148850. Fractus. November 5, 2009

NA Infringement Chart - HTC My Touch. Patent: 7202822. Fractus. November 5, 2009

NA Infringement Chart - HTC Ozone. Fractus. November 5, 2009

NA Infringement Chart - HTC Ozone. Patent: 7148850. Fractus. November 5, 2009

NA Infringement Chart - HTC Ozone. Patent: 7202822. Fractus. November 5, 2009

NA Infringement Chart - HTC Pure. Fractus. November 5, 2009

NA Infringement Chart - HTC Pure. Patent: 7148850. Fractus. November 5, 2009

NA Infringement Chart - HTC Pure. Patent: 7202822. Fractus. November 5, 2009

NA Infringement Chart - HTC Snap. Fractus. November 5, 2009

NA Infringement Chart - HTC Snap. Patent: 7148850. Fractus. November 5, 2009

NA Infringement Chart - HTC Snap. Patent: 7202822. Fractus. November 5, 2009

NA Infringement Chart - HTC TILT 8925.. Fractus. November 5, 2009

NA Infringement Chart - HTC TILT 8925. Patent: 7148850. Fractus. November 5, 2009

NA Infringement Chart - HTC TILT 8925. Patent: 7202822. Fractus. November 5, 2009

NA Infringement Chart - HTC Touch Pro 2. Fractus. November 5, 2009

NA Infringement Chart - HTC Touch Pro 2 CDMA. Patent: 7148850. Fractus. November 5, 2009

NA Infringement Chart - HTC Touch Pro 2. Patent: 7202822. Fractus. November 5, 2009

NA Infringement Chart - HTC Touch Pro Fuze. Fractus. November 5, 2009

NA Infringement Chart - HTC Touch Pro Fuze. Patent: 7148850. Fractus. November 5, 2009

NA Infringement Chart - HTC Touch Pro Fuze. Patent: 7202822. Fractus. November 5, 2009

NA Infringement Chart - HTC Touch Pro.. Fractus. November 5, 2009

NA Infringement Chart - HTC Touch Pro. Patent: 7148850. Fractus. November 5, 2009

NA Infringement Chart - HTC Touch Pro. Patent: 7202822. Fractus. November 5, 2009

NA Infringement Chart - HTC Wing. Fractus. November 5, 2009

NA Infringement Chart - HTC Wing. Patent: 7148850. Fractus. November 5, 2009

NA Infringement Chart - HTC Wing. Patent: 7202822. Fractus. November 5, 2009

NA Infringement Chart - Kyocera Jax. Fractus. November 5, 2009

NA Infringement Chart - Kyocera Jax. Patent: 7148850. Fractus. November 5, 2009

NA Infringement Chart - Kyocera Jax. Patent: 7202822. Fractus. November 5, 2009

NA Infringement Chart - Kyocera MARBL. Fractus. November 5, 2009

NA Infringement Chart - Kyocera MARBL. Patent: 7148850. Fractus. November 5, 2009

NA Infringement Chart - Kyocera MARBL. Patent: 7202822. Fractus. November 5, 2009

NA Infringement Chart - Kyocera NEO E1100. Fractus. November 5, 2009

NA Infringement Chart - Kyocera NEO E1100. Patent: 7148850. Fractus. November 5, 2009

NA Infringement Chart - Kyocera NEO E1100. Patent: 7202822. Fractus. November 5, 2009

NA Infringement Chart - Kyocera S2400. Fractus. November 5, 2009

NA Infringement Chart - Kyocera S2400. Patent: 7148850. Fractus. November 5, 2009

NA Infringement Chart - Kyocera S2400. Patent: 7202822. Fractus. November 5, 2009

NA Infringement Chart - Kyocera Wildcard M1000. Fractus. November 5, 2009

NA Infringement Chart - Kyocera Wildcard M1000. Patent: 7148850. Fractus. November 5, 2009

NA Infringement Chart - Kyocera Wildcard M1000. Patent: 7202822. Fractus. November 5, 2009

NA Infringement Chart - LG 300G.. Fractus. November 5, 2009

NA Infringement Chart - LG 300G. Patent: 7148850. Fractus. November 5, 2009

NA Infringement Chart - LG 300G. Patent: 7202822. Fractus. November 5, 2009

NA Infringement Chart - LG Aloha LX140.. Fractus. November 5, 2009

NA Infringement Chart - LG Aloha LX140. Patent: 7148850. Fractus. November 5, 2009

NA Infringement Chart - LG Aloha LX140. Patent: 7202822. Fractus. November 5, 2009

NA Infringement Chart - LG AX155.. Fractus. November 5, 2009

NA Infringement Chart - LG AX155. Patent: 7148850. Fractus. November 5, 2009

NA Infringement Chart - LG AX155. Patent: 7202822. Fractus. November 5, 2009

NA Infringement Chart - LG AX300. Fractus. November 5, 2009

NA Infringement Chart - LG AX300. Patent: 7148850. Fractus. November 5, 2009

NA Infringement Chart - LG AX300. Patent: 7202822. Fractus. November 5, 2009

NA Infringement Chart - LG AX380. Fractus. November 5, 2009

NA Infringement Chart - LG AX380. Patent: 7148850. Fractus. November 5, 2009

NA Infringement Chart - LG AX380. Patent: 7202822. Fractus. November 5, 2009

NA Infringement Chart - LG AX585.. Fractus. November 5, 2009

NA Infringement Chart - LG AX585. Patent: 7148850. Fractus. November 5, 2009

NA Infringement Chart - LG AX585. Patent: 7202822. Fractus. November 5, 2009

NA Infringement Chart - LG AX8600. Fractus. November 5, 2009

NA Infringement Chart - LG AX8600. Patent: 7148850. Fractus. November 5, 2009

NA Infringement Chart - LG AX8600. Patent: 7202822. Fractus. November 5, 2009

NA Infringement Chart - LG CF360.. Fractus. November 5, 2009

NA Infringement Chart - LG CF360. Patent: 7148850. Fractus. November 5, 2009

NA Infringement Chart - LG CF360. Patent: 7202822. Fractus. November 5, 2009

NA Infringement Chart - LG Chocolate VX8550. Fractus. November 5, 2009

NA Infringement Chart - LG Chocolate VX8550. Patent: 7148850. Fractus. November 5, 2009

NA Infringement Chart - LG Chocolate VX8550. Patent: 7202822. Fractus. November 5, 2009

NA Infringement Chart - LG CU515. Fractus. November 5, 2009

NA Infringement Chart - LG CU515. Patent: 7148850. Fractus. November 5, 2009

NA Infringement Chart - LG CU515. Patent: 7202822. Fractus. November 5, 2009

NA Infringement Chart - LG Dare VX9700 . Patent 7528782. Fractus. November 5, 2009

NA Infringement Chart - LG Dare VX9700. Patent: 7148850. Fractus. November 5, 2009

NA Infringement Chart - LG Dare VX9700. Patent: 7202822. Fractus. November 5, 2009

NA Infringement Chart - LG enV Touch VX1100.. Fractus. November 5, 2009

NA Infringement Chart - LG enV Touch VX1100. Patent: 7148850. Fractus. November 5, 2009

NA Infringement Chart - LG enV Touch VX1100. Patent: 7202822. Fractus. November 5, 2009

NA Infringement Chart - LG enV VX-9900. Fractus. November 5, 2009

NA Infringement Chart - LG enV VX-9900. Patent: 7148850. Fractus. November 5, 2009

NA Infringement Chart - LG enV VX-9900. Patent: 7202822. Fractus. November 5, 2009

NA Infringement Chart - LG EnV2 VX9100. Fractus. November 5, 2009

NA Infringement Chart - LG EnV2 VX9100. Patent: 7148850. Fractus. November 5, 2009

NA Infringement Chart - LG EnV2 VX9100. Patent: 7202822. Fractus. November 5, 2009

NA Infringement Chart - LG EnV3 VX9200.. Fractus. November 5, 2009

NA Infringement Chart - LG EnV3 VX9200. Patent: 7148850. Fractus. November 5, 2009

NA Infringement Chart - LG EnV3 VX9200. Patent: 7202822. Fractus. November 5, 2009

NA Infringement Chart - LG Flare LX165. Fractus. November 5, 2009

NA Infringement Chart - LG Flare LX165. Patent: 7148850. Fractus. November 5, 2009

NA Infringement Chart - LG Flare LX165. Patent: 7202822. Fractus. November 5, 2009

NA Infringement Chart - LG GT365 NEON.. Fractus. November 5, 2009

NA Infringement Chart - LG GT365 NEON. Patent: 7148850. Fractus. November 5, 2009

NA Infringement Chart - LG GT365 NEON. Patent: 7202822. Fractus. November 5, 2009

NA Infringement Chart - LG Lotus. Fractus. November 5, 2009

NA Infringement Chart - LG Lotus. Patent: 7148850. Fractus. November 5, 2009

NA Infringement Chart - LG Lotus. Patent: 7202822. Fractus. November 5, 2009

NA Infringement Chart - LG MUZIQ LX570. Fractus. November 5, 2009

NA Infringement Chart - LG Muziq LX570. Patent: 7148850. Fractus. November 5, 2009

NA Infringement Chart - LG Muziq LX570. Patent: 7202822. Fractus. November 5, 2009

NA Infringement Chart - LG Rumor. Fractus. November 5, 2009

NA Infringement Chart - LG Rumor 2.. Fractus. November 5, 2009

NA Infringement Chart - LG Rumor 2. Patent: 7148850. Fractus. November 5, 2009

NA Infringement Chart - LG Rumor 2. Patent: 7202822. Fractus. November 5, 2009

NA Infringement Chart - LG Rumor. Patent: 7148850. Fractus. November 5, 2009

NA Infringement Chart - LG Rumor. Patent: 7202822. Fractus. November 5, 2009

NA Infringement Chart - LG Shine CU720. Fractus. November 5, 2009

NA Infringement Chart - LG Shine CU720. Patent: 7148850. Fractus. November 5, 2009

NA Infringement Chart - LG Shine CU720. Patent: 7202822. Fractus. November 5, 2009

NA Infringement Chart - LG UX280. Fractus. November 5, 2009

NA Infringement Chart - LG UX280. Patent: 7148850. Fractus. November 5, 2009

NA Infringement Chart - LG UX280. Patent: 7202822. Fractus. November 5, 2009

NA Infringement Chart - LG Versa VX9600. Fractus. November 5, 2009

NA Infringement Chart - LG Versa VX9600. Patent: 7148850. Fractus. November 5, 2009

NA Infringement Chart - LG Versa VX9600. Patent: 7202822. Fractus. November 5, 2009

NA Infringement Chart - LG Voyager VX10000. Fractus. November 5, 2009

NA Infringement Chart - LG Voyager VX10000. Patent: 7148850. Fractus. November 5, 2009

NA Infringement Chart - LG Voyager VX10000. Patent: 7202822. Fractus. November 5, 2009

NA Infringement Chart - LG VU CU920. Fractus. November 5, 2009

NA Infringement Chart - LG Vu CU920. Patent: 7148850. Fractus. November 5, 2009

NA Infringement Chart - LG Vu CU920. Patent: 7202822. Fractus. November 5, 2009

NA Infringement Chart - LG VX5400. Fractus. November 5, 2009

NA Infringement Chart - LG VX5400. Patent: 7148850. Fractus. November 5, 2009

NA Infringement Chart - LG VX5400. Patent: 7202822. Fractus. November 5, 2009

NA Infringement Chart - LG VX5500. Fractus. November 5, 2009

NA Infringement Chart - LG VX5500. Patent: 7148850. Fractus. November 5, 2009

NA Infringement Chart - LG VX5500. Patent: 7202822. Fractus. November 5, 2009

NA Infringement Chart - LG VX8350. Fractus. November 5, 2009

NA Infringement Chart - LG VX8350. Patent: 7148850. Fractus. November 5, 2009

NA Infringement Chart - LG VX8350. Patent: 7202822. Fractus. November 5, 2009

NA Infringement Chart - LG VX8360.. Fractus. November 5, 2009

NA Infringement Chart - LG VX8360. Patent: 7148850. Fractus. November 5, 2009

NA Infringement Chart - LG VX8360. Patent: 7202822. Fractus. November 5, 2009

NA Infringement Chart - LG VX8500. Fractus. November 5, 2009

NA Infringement Chart - LG VX8500. Patent: 7148850. Fractus. November 5, 2009

NA Infringement Chart - LG VX8500. Patent: 7202822. Fractus. November 5, 2009

NA Infringement Chart - LG VX8560 Chocolate 3. Fractus. November 5, 2009

NA Infringement Chart - LG VX8560 Chocolate 3. Patent: 7148850. Fractus. November 5, 2009

NA Infringement Chart - LG VX8560 Chocolate 3. Patent: 7202822. Fractus. November 5, 2009

NA Infringement Chart - LG VX8610. Fractus. November 5, 2009

NA Infringement Chart - LG VX8610. Patent: 7148850. Fractus. November 5, 2009

NA Infringement Chart - LG VX8610. Patent: 7202822. Fractus. November 5, 2009

NA Infringement Chart - LG VX8800. Fractus. November 5, 2009

NA Infringement Chart - LG VX8800. Patent: 7148850. Fractus. November 5, 2009

NA Infringement Chart - LG VX8800. Patent: 7202822. Fractus. November 5, 2009

NA Infringement Chart - LG VX9400. Fractus. November 5, 2009

NA Infringement Chart - LG Xenon GR500.. Fractus. November 5, 2009

NA Infringement Chart - LG Xenon GR500. Patent: 7148850. Fractus. November 5, 2009

NA Infringement Chart - LG Xenon GR500. Patent: 7202822. Fractus. November 5, 2009

NA Infringement Chart - Palm Centro 685. Fractus. November 5, 2009

NA Infringement Chart - Palm Centro 685. Patent: 7148850. Fractus. November 5, 2009

NA Infringement Chart - Palm Centro 685. Patent: 7202822. Fractus. November 5, 2009

NA Infringement Chart - Palm Centro 690. Fractus. November 5, 2009

NA Infringement Chart - Palm Centro 690. Patent: 7148850. Fractus. November 5, 2009

NA Infringement Chart - Palm Centro 690. Patent: 7202822. Fractus. November 5, 2009

NA Infringement Chart - Palm Pre. Fractus. November 5, 2009

NA Infringement Chart - Palm Pre. Patent: 7148850. Fractus. November 5, 2009

NA Infringement Chart - Palm Pre. Patent: 7202822. Fractus. November 5, 2009

NA Infringement Chart - Pantech Breeze C520.. Fractus. November 5, 2009

NA Infringement Chart - Pantech Breeze C520. Patent: 7148850. Fractus. November 5, 2009

NA Infringement Chart - Pantech Breeze C520. Patent: 7202822. Fractus. November 5, 2009

NA Infringement Chart - Pantech C610. Fractus. November 5, 2009

NA Infringement Chart - Pantech C610. Patent: 7148850. Fractus. November 5, 2009

NA Infringement Chart - Pantech C610. Patent: 7202822. Fractus. November 5, 2009

NA Infringement Chart - Pantech C740. Fractus. November 5, 2009

NA Infringement Chart - Pantech C740. Patent: 7148850. Fractus. November 5, 2009

NA Infringement Chart - Pantech C740. Patent: 7202822. Fractus. November 5, 2009

NA Infringement Chart - Pantech DUO C810.. Fractus. November 5, 2009

NA Infringement Chart - Pantech DUO C810. Patent: 7148850. Fractus. November 5, 2009

NA Infringement Chart - Pantech DUO C810. Patent: 7202822. Fractus. November 5, 2009

NA Infringement Chart - Pantech Slate C530. Fractus. November 5, 2009

NA Infringement Chart - Phone: LG Dare VX9700. Fractus. November 5, 2009

NA Infringement Chart - RIM Blackberry 8110. Fractus. November 5, 2009

NA Infringement Chart - RIM Blackberry 8120. Fractus. November 5, 2009

NA Infringement Chart - RIM Blackberry 8130. Fractus. November 5, 2009

NA Infringement Chart - RIM Blackberry 8220. Fractus. November 5, 2009

NA Infringement Chart - RIM Blackberry 8310. Fractus. November 5, 2009

NA Infringement Chart - RIM Blackberry 8320. Fractus. November 5, 2009

NA Infringement Chart - RIM Blackberry 8330. Fractus. November 5, 2009

NA Infringement Chart - RIM Blackberry 8820. Fractus. November 5, 2009

NA Infringement Chart - RIM Blackberry 8830. Fractus. November 5, 2009

NA Infringement Chart - RIM Blackberry 8900. Fractus. November 5, 2009

NA Infringement Chart - RIM Blackberry 9630. Fractus. November 5, 2009

NA Infringement Chart - RIM Blackberry Bold 9000.. Fractus. November 5, 2009

NA Infringement Chart - RIM Blackberry Pearl 8100. Fractus. November 5, 2009

NA Infringement Chart - RIM Blackberry Storm 9530.. Fractus. November 5, 2009

NA Infringement Chart - Samsung Blackjack II SCH-I617. Patent: 7148850. Fractus. November 5, 2009

NA Infringement Chart - Samsung Blackjack II SCH-I617. Patent: 7202822. Fractus. November 5, 2009

NA Infringement Chart - Samsung Blackjack II SGH-i617.. Fractus. November 5, 2009

NA Infringement Chart - Samsung Blast SGH T729. Fractus. November 5, 2009

NA Infringement Chart - Samsung Blast SGH-T729. Patent: 7148850. Fractus. November 5, 2009

NA Infringement Chart - Samsung Blast SGH-T729. Patent: 7202822. Fractus. November 5, 2009

NA Infringement Chart - Samsung EPIX SGH-I907. Fractus. November 5, 2009

NA Infringement Chart - Samsung FlipShot SCH-U900. Fractus. November 5, 2009

NA Infringement Chart - Samsung FlipShot SCH-U900. Patent: 7148850. Fractus. November 5, 2009

NA Infringement Chart - Samsung FlipShot SCH-U900. Patent: 7202822. Fractus. November 5, 2009

NA Infringement Chart - Samsung Instinct M800. Fractus. November 5, 2009

NA Infringement Chart - Samsung Instinct M800. Patent: 7148850. Fractus. November 5, 2009

NA Infringement Chart - Samsung Instinct M800. Patent: 7202822. Fractus. November 5, 2009

NA Infringement Chart - Samsung M320. Fractus. November 5, 2009

NA Infringement Chart - Samsung M320. Patent: 7148850. Fractus. November 5, 2009

NA Infringement Chart - Samsung M320. Patent: 7202822. Fractus. November 5, 2009

NA Infringement Chart - Samsung Messager. Fractus. November 5, 2009

NA Infringement Chart - Samsung Messager. Patent: 7148850. Fractus. November 5, 2009

NA Infringement Chart - Samsung Messager. Patent: 7202822. Fractus. November 5, 2009

NA Infringement Chart - Samsung Omnia SGH-I900. Fractus. November 5, 2009

NA Infringement Chart - Samsung Omnia SGH-I900. Patent: 7148850. Fractus. November 5, 2009

NA Infringement Chart - Samsung Omnia SGH-I900. Patent: 7202822. Fractus. November 5, 2009

NA Infringement Chart - Samsung SCH A127.. Fractus. November 5, 2009

NA Infringement Chart - Samsung SCH U340.. Fractus. November 5, 2009

NA Infringement Chart - Samsung SCH U340. Patent: 7148850. Fractus. November 5, 2009

NA Infringement Chart - Samsung SCH U340. Patent: 7202822. Fractus. November 5, 2009

NA Infringement Chart - Samsung SCH U410.. Fractus. November 5, 2009

NA Infringement Chart - Samsung SCH U410. Patent: 7148850. Fractus. November 5, 2009

NA Infringement Chart - Samsung SCH U410. Patent: 7202822. Fractus. November 5, 2009

NA Infringement Chart - Samsung SCH U700. Fractus. November 5, 2009

NA Infringement Chart - Samsung SCH U700. Patent: 7148850. Fractus. November 5, 2009

NA Infringement Chart - Samsung SCH U700. Patent: 7202822. Fractus. November 5, 2009

NA Infringement Chart - Samsung SCH-A630. Fractus. November 5, 2009

NA Infringement Chart - Samsung SCH-A630. Patent: 7148850. Fractus. November 5, 2009

NA Infringement Chart - Samsung SCH-A630. Patent: 7202822. Fractus. November 5, 2009

NA Infringement Chart - Samsung SCH-A645. Fractus. November 5, 2009

NA Infringement Chart - Samsung SCH-A645. Patent: 7148850. Fractus. November 5, 2009

NA Infringement Chart - Samsung SCH-A645. Patent: 7202822. Fractus. November 5, 2009

NA Infringement Chart - Samsung SCH-A870. Fractus. November 5, 2009

NA Infringement Chart - Samsung SCH-A887 Solstice. Patent: 7148850. Fractus. November 5, 2009

NA Infringement Chart - Samsung SCH-A887 Solstice. Patent: 7202822. Fractus. November 5, 2009

NA Infringement Chart - Samsung SCH-I910. Fractus. November 5, 2009

NA Infringement Chart - Samsung SCH-I910. Patent: 7148850. Fractus. November 5, 2009

NA Infringement Chart - Samsung SCH-I910. Patent: 7202822. Fractus. November 5, 2009

NA Infringement Chart - Samsung SCH-R430. Fractus. November 5, 2009

NA Infringement Chart - Samsung SCH-R430. Patent: 7148850. Fractus. November 5, 2009

NA Infringement Chart - Samsung SCH-R430. Patent: 7202822. Fractus. November 5, 2009

NA Infringement Chart - Samsung SCH-R500.. Fractus. November 5, 2009

NA Infringement Chart - Samsung SCH-R500. Patent: 7148850. Fractus. November 5, 2009

NA Infringement Chart - Samsung SCH-R500. Patent: 7202822. Fractus. November 5, 2009

NA Infringement Chart - Samsung SCH-R600. Fractus. November 5, 2009

NA Infringement Chart - Samsung SCH-R600. Patent: 7148850. Fractus. November 5, 2009

NA Infringement Chart - Samsung SCH-R600. Patent: 7202822. Fractus. November 5, 2009

NA Infringement Chart - Samsung SCH-R800. Fractus. November 5, 2009

NA Infringement Chart - Samsung SCH-R800. Patent: 7148850. Fractus. November 5, 2009

NA Infringement Chart - Samsung SCH-R800. Patent: 7202822. Fractus. November 5, 2009

NA Infringement Chart - Samsung SCH-U310. Fractus. November 5, 2009

NA Infringement Chart - Samsung SCH-U310. Patent: 7148850. Fractus. November 5, 2009

NA Infringement Chart - Samsung SCH-U310. Patent: 7202822. Fractus. November 5, 2009

NA Infringement Chart - Samsung SCH-U430. Fractus. November 5, 2009

NA Infringement Chart - Samsung SCH-U430. Patent: 7148850. Fractus. November 5, 2009

NA Infringement Chart - Samsung SCH-U430. Patent: 7202822. Fractus. November 5, 2009

NA Infringement Chart - Samsung SCH-U470. Fractus. November 5, 2009

NA Infringement Chart - Samsung SCH-U470. Patent: 7148850. Fractus. November 5, 2009

NA Infringement Chart - Samsung SCH-U470. Patent: 7202822. Fractus. November 5, 2009

NA Infringement Chart - Samsung SCH-U520. Fractus. November 5, 2009

NA Infringement Chart - Samsung SCH-U520. Patent: 7148850. Fractus. November 5, 2009

NA Infringement Chart - Samsung SCH-U520. Patent: 7202822. Fractus. November 5, 2009

NA Infringement Chart - Samsung SCH-U740. Fractus. November 5, 2009

NA Infringement Chart - Samsung SCH-U740. Patent: 7148850. Fractus. November 5, 2009

NA Infringement Chart - Samsung SCH-U740. Patent: 7202822. Fractus. November 5, 2009

NA Infringement Chart - Samsung SCH-U750. Fractus. November 5, 2009

NA Infringement Chart - Samsung SCH-U750. Patent: 7148850. Fractus. November 5, 2009

NA Infringement Chart - Samsung SCH-U750. Patent: 7202822. Fractus. November 5, 2009

NA Infringement Chart - Samsung SCH-U940. Fractus. November 5, 2009

NA Infringement Chart - Samsung SCH-U940. Patent. 7202822. Fractus. November 5, 2009

NA Infringement Chart - Samsung SCH-U940. Patent: 7148850. Fractus. November 5, 2009

NA Infringement Chart - Samsung SGH A117. Fractus. November 5, 2009

NA Infringement Chart - Samsung SGH A117. Patent: 7148850. Fractus. November 5, 2009

NA Infringement Chart - Samsung SGH A117. Patent: 7202822. Fractus. November 5, 2009

NA Infringement Chart - Samsung SGH A127. Patent: 7148850. Fractus. November 5, 2009

NA Infringement Chart - Samsung SGH A127. Patent: 7202822. Fractus. November 5, 2009

NA Infringement Chart - Samsung SGH A437. Fractus. November 5, 2009

NA Infringement Chart - Samsung SGH A437. Patent: 7148850. Fractus. November 5, 2009

NA Infringement Chart - Samsung SGH A437. Patent: 7202822. Fractus. November 5, 2009

NA Infringement Chart - Samsung SGH A737. Fractus. November 5, 2009

NA Infringement Chart - Samsung SGH A737. Patent: 7148850. Fractus. November 5, 2009

NA Infringement Chart - Samsung SGH A737. Patent: 7202822. Fractus. November 5, 2009

NA Infringement Chart - Samsung SGH A867. Fractus. November 5, 2009

NA Infringement Chart - Samsung SGH A867. Patent: 7148850. Fractus. November 5, 2009

NA Infringement Chart - Samsung SGH A867. Patent: 7202822. Fractus. November 5, 2009

NA Infringement Chart - Samsung SGH T229. Fractus. November 5, 2009

NA Infringement Chart - Samsung SGH T229. Patent: 7148850. Fractus. November 5, 2009

NA Infringement Chart - Samsung SGH T229. Patent: 7202822. Fractus. November 5, 2009

NA Infringement Chart - Samsung SGH T439. Fractus. November 5, 2009

NA Infringement Chart - Samsung SGH T439. Patent: 7148850. Fractus. November 5, 2009

NA Infringement Chart - Samsung SGH T439. Patent: 7202822. Fractus. November 5, 2009

NA Infringement Chart - Samsung SGH T459. Fractus. November 5, 2009

NA Infringement Chart - Samsung SGH T459. Patent: 7148850. Fractus. November 5, 2009

NA Infringement Chart - Samsung SGH T459. Patent: 7202822. Fractus. November 5, 2009

NA Infringement Chart - Samsung SGH T919. Fractus. November 5, 2009

NA Infringement Chart - Samsung SGH T919. Patent: 7148850. Fractus. November 5, 2009

NA Infringement Chart - Samsung SGH T919. Patent: 7202822. Fractus. November 5, 2009

NA Infringement Chart - Samsung SGH-A237. Fractus. November 5, 2009

NA Infringement Chart - Samsung SGH-A237. Patent: 7148850. Fractus. November 5, 2009

NA Infringement Chart - Samsung SGH-A237. Patent: 7202822. Fractus. November 5, 2009

NA Infringement Chart - Samsung SGH-A257. Fractus. November 5, 2009

NA Infringement Chart - Samsung SGH-A257 Magnet. Patent: 7148850. Fractus. November 5, 2009

NA Infringement Chart - Samsung SGH-A257 Magnet. Patent: 7202822. Fractus. November 5, 2009

NA Infringement Chart - Samsung SGH-A837. Fractus. November 5, 2009

NA Infringement Chart - Samsung SGH-A837. Patent: 7148850. Fractus. November 5, 2009

NA Infringement Chart - Samsung SGH-A837. Patent: 7202822. Fractus. November 5, 2009

NA Infringement Chart - Samsung SGH-A887. Fractus. November 5, 2009

NA Infringement Chart - Samsung SGH-I907. Patent: 7148850. Fractus. November 5, 2009

NA Infringement Chart - Samsung SGH-I907. Patent: 7202822. Fractus. November 5, 2009

NA Infringement Chart - Samsung SGH-T219.. Fractus. November 5, 2009

NA Infringement Chart - Samsung SGH-T219. Patent: 7148850. Fractus. November 5, 2009

NA Infringement Chart - Samsung SGH-T219. Patent: 7202822. Fractus. November 5, 2009

NA Infringement Chart - Samsung SGH-T239. Fractus. November 5, 2009

NA Infringement Chart - Samsung SGH-T239. Patent: 7148850. Fractus. November 5, 2009

NA Infringement Chart - Samsung SGH-T239. Patent: 7202822. Fractus. November 5, 2009

NA Infringement Chart - Samsung SGH-T559. Fractus. November 5, 2009

NA Infringement Chart - Samsung SGH-T559 Comeback. Patent: 7148850. Fractus. November 5, 2009

NA Infringement Chart - Samsung SGH-T559 Comeback. Patent: 7202822. Fractus. November 5, 2009

NA Infringement Chart - Samsung SGH-T639. Fractus. November 5, 2009

NA Infringement Chart - Samsung SGH-T639. Patent: 7148850. Fractus. November 5, 2009

NA Infringement Chart - Samsung SGH-T639. Patent: 7202822. Fractus. November 5, 2009

NA Infringement Chart - Samsung SGH-T739. Fractus. November 5, 2009

NA Infringement Chart - Samsung SGH-T739. Patent: 7148850. Fractus. November 5, 2009

NA Infringement Chart - Samsung SGH-T739. Patent: 7202822. Fractus. November 5, 2009

NA Infringement Chart - Samsung SGH-T819. Fractus. November 5, 2009

NA Infringement Chart - Samsung SGH-T819. Patent: 7148850. Fractus. November 5, 2009

NA Infringement Chart - Samsung SGH-T819. Patent: 7202822. Fractus. November 5, 2009

NA Infringement Chart - Samsung SGH-T929. Fractus. November 5, 2009

NA Infringement Chart - Samsung SGH-T929. Patent: 7148850. Fractus. November 5, 2009

NA Infringement Chart - Samsung SGH-T929. Patent: 7202822. Fractus. November 5, 2009

NA Infringement Chart - Samsung Spex R210a. Fractus. November 5, 2009

NA Infringement Chart - Samsung Spex R210a. Patent: 7148850. Fractus. November 5, 2009

NA Infringement Chart - Samsung Spex R210a. Patent: 7202822. Fractus. November 5, 2009

NA Infringement Chart - Samsung SPH M520. Fractus. November 5, 2009

NA Infringement Chart - Samsung SPH M520. Patent: 7148850. Fractus. November 5, 2009

NA Infringement Chart - Samsung SPH M520. Patent: 7202822. Fractus. November 5, 2009

NA Infringement Chart - Samsung SPH M540.. Fractus. November 5, 2009

NA Infringement Chart - Samsung SPH M540. Patent: 7148850. Fractus. November 5, 2009

NA Infringement Chart - Samsung SPH M540. Patent: 7202822. Fractus. November 5, 2009

NA Infringement Chart - Samsung SPH-A523. Fractus. November 5, 2009

NA Infringement Chart - Samsung SPH-A523. Patent: 7148850. Fractus. November 5, 2009

NA Infringement Chart - Samsung SPH-A523. Patent: 7202822. Fractus. November 5, 2009

NA Infringement Chart - Samsung SPH-M550. Fractus. November 5, 2009

NA Infringement Chart - Samsung SPH-M550. Patent: 7148850. Fractus. November 5, 2009

NA Infringement Chart - Samsung SPH-M550. Patent: 7202822. Fractus. November 5, 2009

NA Infringement Chart - Samsung Sway SCH-U650. Fractus. November 5, 2009

NA Infringement Chart - Samsung Sway SCH-U650. Patent: 7148850. Fractus. November 5, 2009

NA Infringement Chart - Samsung Sway SCH-U650. Patent: 7202822. Fractus. November 5, 2009

NA Infringement Chart - Sanyo Katana II.. Fractus. November 5, 2009

NA Infringement Chart - Sanyo Katana II. Patent: 7148850. Fractus. November 5, 2009

NA Infringement Chart - Sanyo Katana II. Patent: 7202822. Fractus. November 5, 2009

NA Infringement Chart - Sanyo Katana LX. Fractus. November 5, 2009

NA Infringement Chart - Sanyo Katana LX. Patent: 7148850. Fractus. November 5, 2009

NA Infringement Chart - Sanyo Katana LX. Patent: 7202822. Fractus. November 5, 2009

NA Infringement Chart - Sanyo S1. Fractus. November 5, 2009

NA Infringement Chart - Sanyo S1. Patent: 7148850. Fractus. November 5, 2009

NA Infringement Chart - Sanyo S1. Patent: 7202822. Fractus. November 5, 2009

NA Infringement Chart - Sanyo SCP 2700.. Fractus. November 5, 2009

NA Infringement Chart - Sanyo SCP 2700. Patent: 7148850. Fractus. November 5, 2009

NA Infringement Chart - Sanyo SCP 2700. Patent: 7202822. Fractus. November 5, 2009

NA Infringement Chart - Sharp Sidekick 2008.. Fractus. November 5, 2009

NA Infringement Chart - Sharp Sidekick 2008. Patent: 7148850. Fractus. November 5, 2009

NA Infringement Chart - Sharp Sidekick 2008. Patent: 7202822. Fractus. November 5, 2009

NA Infringement Chart - Sharp Sidekick 3. Fractus. November 5, 2009

NA Infringement Chart - Sharp Sidekick 3. Patent: 7148850. Fractus. November 5, 2009

NA Infringement Chart - Sharp Sidekick 3. Patent: 7202822. Fractus. November 5, 2009

NA Infringement Chart - Sharp Sidekick LX 2009.. Fractus. November 5, 2009

NA Infringement Chart - Sharp Sidekick LX 2009. Patent: 7148850. Fractus. November 5, 2009

NA Infringement Chart - Sharp Sidekick LX 2009. Patent: 7202822. Fractus. November 5, 2009

NA Infringement Chart - Sharp Sidekick LX. Patent: 7148850. Fractus. November 5, 2009

NA Infringement Chart - Sharp Sidekick LX. Patent: 7202822. Fractus. November 5, 2009

NA Infringement Chart - UTStarcom CDM7126.. Fractus. November 5, 2009

NA Infringement Chart - UTStarcom CDM7126. Patent: 7148850. Fractus. November 5, 2009

NA Infringement Chart - UTStarcom CDM7126. Patent: 7202822. Fractus. November 5, 2009

NA Infringement Chart - UTStarcom Quickfire GTX75.. Fractus. November 5, 2009

NA Infringement Chart - UTStarcom Quickfire GTX75. Patent: 7148850. Fractus. November 5, 2009

NA Infringement Chart - UTStarcom Quickfire GTX75. Patent: 7202822. Fractus. November 5, 2009

Caswell , W. E. Invisible errors in dimensions calculations: geometric and systematic effects. Dimensions and Entropies in Chaotic Systems. January 1, 1986

Borja , C. ; Puente , C. Iterative network models to predict the performance of Sierpinski fractal antennas and networks. Antennas and Propagation Society International Symposium, 1999. IEEE. July 11, 1999

Menefee , J. A. US95/001389 - Office Action for the US patent 7123208 dated on August 12, 2010. USPTO. August 12, 2010

Rich , Barnett Review of Elementary Mathematics 2d ed.1997. McGraw - Hill - Case 6:09-cv-00203-LED-JDL. January 1, 1997

Buczkowski , Stéphane ; Kyriacos , Soula ; Nekka , Fahima ; Cartilier , Louis The modified box-countig method: analysis of some characteristic paramenters. Pattern Recognition - ElServier Science. April 20, 1998

NA The American Century Dictionary. Oxford University Press. January 1, 1995

West , B.H. et al. The Prentice-Hall Encyclopedia of Mathematics (1982). Prentice-Hall. January 1, 1982

NA The American Heritage College Dictionary. Houghton Mifflin Comp. - 3d ed. - Case 6:09-cv-00203-LED-JDL. January 1, 1997

NA The American Heritage Dictionary. New College ed. (2nd ed. ). January 1, 1982

NA The American Heritage Dictionary. Morris - William - (Second College edition) - Case 6:09-cv-00203-LED-JDL. January 1, 1982

Rademacher , H. ; Toeplitz , O. The Enjoyment of Math. Princeton Science Library. January 1, 1957

Mandelbrot, B. B. The fractal geometry of nature. Freeman and Company. January 1, 1982

Maiorana , D. US10/102568 - Amendment and response to the Office Action dated on January 23, 2004. Jones Day. May 26, 2004

Menefee , J. A. US95/001390 - Office Action for the US patent 7015868 dated August 19, 2010. USPTO. August 19, 2010

Lee , B. T. US10/181790 - Office action dated on August 27, 2004. USPTO. August 27, 2004

Lee , B. T. US10/181790 - Office action dated on August 4, 2005. USPTO. August 4, 2005

Lee , B. T. US10/181790 - Office action dated on June 2, 2005. USPTO. June 2, 2005

Lee , B. T. US10/181790 - Office action dated on March 2, 2005. USPTO. March 2, 2005

Sauer , J. M. US10/181790 - Response to office action dated on August 27, 2004. Jones Day. December 8, 2004

Sauer, J.M. US10/181790 - Response to the office action dated on June 2, 2005. Jones Day. July 20, 2005

Wimer , M. C. US10/422578 - Advisory Action before the filing of an Appeal Brief. USPTO. June 23, 2005

Sauer , J. M. US10/422578 - Response to the Office Action mailed on January 26, 2006 and Advisory Action mailed on March 29, 2006. Jones Day. May 1, 2006

Le , H. T. US10/797732 - Office action dated on August 9, 2007. USPTO. August 9, 2007

Phan , T. G. US10/963080 - Notice of allowance dated on September 1, 2005.. USPTO. September 1, 2005

Sauer , J. M. US10/963080 - Preliminary amendment - Declaration of J. Baxter - Exhibit W. Jones Day. Case 6:09-cv-00203-LED-JDL. December 10, 2004

Mithani , S. US11/021597 - Response to the Office Action dated March 12, 2007. Winstead. August 9, 2007

Moore , S. US11/033788 - Response to Office Action dated February 7, 2006. Jenkens & Gilchrist. June 1, 2006

Phan , T. G. US11/102390 - Notice of allowance dated on July 6, 2006.. USPTO. June 25, 2006

Nguyen , H. V. US11/110052 - Notice of Allowance dated on May 30, 2006. USPTO. May 30, 2006

Walker , B. US11/110052 - Preliminary amendment dated on April 18, 2005. Howison & Arnott. April 18, 2005

Mithani , S. US11/124768 - Amendment in response to non-final office action dated August 23, 2006. Jenkens & Gilchrist. November 13, 2006

Phan , T. G. US11/179257 - Notice of allowance dated on October 19, 2006. USPTO. October 19, 2006

Peitgen & D. Saupe, H The science of fractal images. Springer-Verlag. January 1, 1988

Phan , T. G. US11/550256 - Office Action dated on January 15, 2008. USPTO. January 15, 2008

NA US95/000593 - Request for inter partes reexamination for US patent 7148850 including exhibits from CC1 to CC7. Kyocera. November 16, 2010

Williams , B. P. US95/000598 - Request for inter partes reexamination for US patent 7148850 including exhibits from C1 to F3. HTC Corporation ; HTC America , Inc.. December 3, 2010

NA US95/001413 - Request for inter partes reexamination for US patent 7148850 including claim charts from CC-A to CC-F. Samsung Electronics Co. Ltd.. August 4, 2010

NA US95/001413 - Request for inter partes reexamination for US patent 7148850. CC-F: Claim Chart Comparing Claims 1, 4, 6, 16, 17, 19, 21, 22, 24-26, 29, 35, 38, 40, 45-48, 51, 53, 57, 58, 61, 65, 66, 69, and 70 to US patent 5363114 Shoemaker. Defendants. August 1, 2010

NA US95/001413 - Request for inter partes reexamination for US patent no 7148850. CC-A: Claim Chart Comparing Claims 1, 4, 6, 17, 19, 21, 22, 24-26, 29, 35, 38, 40, 45-48, 51, 53, 58, 61, 65, 66, 69, and 70 to US patent 6140975 Cohen. Defendants. August 1, 2010

NA US95/001413 - Request for inter partes reexamination for US patent no 7148850. CC-B: Claim Chart Comparing Claims 1, 4, 6, 16, 17, 19, 21, 22, 24-26, 29, 35, 38, 40, 45-48, 51, 53, 57, 58, 61, 65, 66, 69 and 70 to US patent 6140975 Cohen. Defendants. August 1, 2010

NA US95/001413 - Request for inter partes reexamination for US patent no 7148850. CC-C: Claim Chart Comparing Claims 1, 4, 6, 17, 19, 21, 22, 24-26, 29, 35, 38, 40, 45-48, 53, 58, 61, 65, 66, and 69 to US patent 6140975 Cohen. Defendants. August 1, 2010

NA US95/001413 - Request for inter partes reexamination for US patent no 7148850. CC-D: Claim Chart Comparing Claims 1, 4, 6, 16, 17, 19, 21, 22, 24-26, 29, 35, 38, 40, 45-48, 51, 53, 57, 58, 61, 65, 66, and 69 to US patent 6140975 Cohen. Defendants. August 1, 2010

NA US95/001413 - Request for inter partes reexamination for US patent no 7148850. CC-E: Claim Chart Comparing Claims 1, 4, 6, 16-17, 19, 21, 22, 24-26, 29, 35, 38, 40, 45-48, 51, 53, 57, 58, 61, 65, 66, 69 and 70 to patent EP0590671B1 Sekine. Defendants. August 1, 2010

Theiler , J. Estimating fractal dimension. J. Opt. Soc. Am. A. Case 6:09-cv-00203-LED-JDL. June 1, 1990

Tinker J. A. US11/021597 - Response to the office action dated October 30, 2007. Winstead. December 28, 2007

Menefee , J. A. US95/001414 - Office action dated on October 8, 2010. USPTO. October 8, 2010

NA US95/001414 - Request for inter partes reexamination for US patent 7202822 including claim charts from CC-A-1 to CCD. Samsung Electronics Co. Ltd.. August 4, 2010

Walker , B. US11/780932 - Preliminary amendment dated on July 20, 2007. Howison & Arnott. July 20, 2007

NA US95/001414 - Request for inter partes reexamination for US patent no. 7202822 - CC-A-1 - Claim chart comparing claims 1, 4-5, 7-9, 20-21, 25 and 31 of US patent 7202822 to US patent 6140975. Defendants. August 9, 2010

NA US95/001414 - Request for inter partes reexamination for US patent no. 7202822 - CC-D - Claim Chart Comparing claims 1, 4-5, 7-9, 12, 13, 15, 18, 21, 25, 29-31, 35, 44, 46, 48 and 52 of US patent no. 7202822 to U.S. Pat.5363114 to Shoemaker. Defendants. August 4, 2010

NA US95/001414 - Request for inter partes reexamination for US patent no. 7202822 issued April 10, 2007 - CC-C - Claim Chart Comparing claims 1, 4, 5, 7-9, 12, 13, 15, 18, 21, 25, 29-31, 35, 44, 46, 48 and 52 of US patent no.7202822 to Sanad.. Defendants. August 4, 2010

NA US95/001414 - Request for inter partes reexamination for US patent no. 7202822. Exhibit CC-A-2. Claim chart comparing claims 1, 4-5, 7-9, 12-13, 15, 18, 20-22, and 31 of US patent 7202822 to US patent 6140975. Defendants. August 9, 2010

NA US95/001414 - Request for inter partes reexamination for US patent no. 7202822. Exhibit CC-A-3. Claim Chart Comparing claims 1, 4, 5, 7-9, 12, 13, 15, 18, 20-25, 29-31, 35, 44, 46, 48, 52 and 53 of US patent 7202822 to US patent 6140975. Defendants. August 9, 2010

Walker , B. D. US11/179250 - Response office action. Howison & Arnott - Case 6:09-cv-00203-LED-JDL. July 12, 2005

Watson , T. ; Friesser , J. A phase shift direction finding technique. Annual Symposium on the USAF antenna research and development program. October 21, 1957

NA US95/001414 - Request for inter partes reexamination for US patent no. 7202822. Exhibit CC-A-4 Claim Chart Comparing claims 1, 4, 5, 7-9, 12, 13, 15, 18, 20-25, 29-31, 35, 44, 46, 48, 52 and 53 of US patent 7202822 to US patent 6140975. Defendants. August 9, 2010

NA US95/001414 - Request for inter partes reexamination for US patent no. 7202822. Exhibit CC-B Claim Chart Comparing claims 1, 4, 5, 7-9, 13, 15, 18, 20-25, 29-31, 35, 44, 46, 48, 52, and 53 of US 7202822 to Sekine. Defendants. August 9, 2010

Wikka , K. Letter to FCC that will authorize the appointment of MORTON FLOM Eng and/or FLOMASSOCIATES INC to act as their Agent in all FCC matters. Nokia Mobile Phones. August 5, 1999

NA US95/001414 - Request for inter partes reexamination of US patent no. 7202822 issued April 10, 2007 - OTH-B - Samsung SCH U340. Defendants. August 10, 2010

NA US95/001414 - Request for inter partes reexamination of US patent no. 7202822 issued April 10, 2007 - OTH-C - Samsung SCH-R500. Defendants. August 10, 2010

NA US95/001414 - Request for inter partes reexamination of US patent no. 7202822 issued April 10, 2007 - OTH-D - Civil Action No. 6:09-cv-00203. Defendants. May 28, 2010

Wimer , M. C. US10/422578 - Office Action dated on August 23, 2007. USPTO. August 23, 2007

Wimer , M. C. US10/422578 - Office Action dated on August 24, 2005. USPTO. August 24, 2005

Wimer , M. C. US10/422578 - Office Action dated on January 26, 2006. USPTO. January 26, 2006

Wimer , M. C. US10/422578 - Office Action dated on March 12, 2007. USPTO. March 12, 2007

Wimer , M. C. US10/422578 - Office action dated on March 26, 2008. USPTO. March 26, 2008

Wimer , M. C. US10/822933 - Notice of allowance dated on October 18, 2007. USPTO. October 18, 2007

Wimer , M. C. US11/021597 - Office action dated October 30, 2007. USPTO. October 30, 2007

Wimer , M. C. US11/021597 - Office Action dated on March 12, 2007. USPTO. March 12, 2007

NA Webster's New Collegiate Dictionary. G & C Merriam Co.. January 1, 1981

Jaggard , D. L. Rebuttal expert report of Dr. Dwight L. Jaggard (redacted version). Fractus. February 16, 2011

Long , S. Rebuttal expert report of Dr. Stuart A. Long (redacted version). Fractus. February 16, 2011

Love , J. D. Document 0582 - Memorandum opinion and order. Court. January 20, 2011

NA Document 0583 - Defendant's notice of compliance regarding second amended invalidity contentions. Defendants. January 21, 2011

NA Document 0607 - Declaration of Thomas E. Nelson - Exhibit A - Antenna photos. Defendants. February 3, 2011

NA Document 0609 - Fractus' reply to defendant's motion for reconsideration of, and objections to, magistrate Judge Love's markman order. Susman Godfrey. February 4, 2011

NA Document 0611 - Report and recommendation of United States magistrate judge. Court. February 8, 2011

NA Document 0622 - Order adopting report and recommendation of magistrate judge. Court. February 11, 2011

NA Document 0624 - Notice of compliance with motion practice orders. Susman Godfrey. February 14, 2011

NA Document 0645 - Reply brief in support of Defendant's motion for reconsideration of the court's ruling on the term "at least a portion" in the court's December 17, 2010 claim construction order based on newly-available evidence. Defendants. February 25, 2011

NA Document 0647 - Defendants Samsung Electronics Co LTD (et al) second amended answer and counterclaims to the second amended complaint of plaintiff Fractus SA - Document 647. Defendants. February 28, 2011

NA Document 0649 - Defendants LG Electronics Inc, LG Electronics USA, and LG Electronics Mobilecomm USA Inc's second amended answer and counterclaim to second amended complaint. Defendants. February 28, 2011

NA Document 0657 - Defendant Pantech Wireless Inc amended answer, affirmative defenses, and counterclaims to Fractus' second amended complaint. Defendants. February 28, 2011

Williams , B. P. US95/000610 - Request for inter partes reexamination of US patent no. 7202822 including exhibits C1-I5. HTC Corporation - HTC America Inc.. December 14, 2010

Stutzman , W. L. Rebuttal expert report of Dr. Warren L. Stutzman (redacted version). Fractus. February 16, 2011

Fujimoto , K. et al Small Antennas. Research Studies Press LTD. January 1, 1987

Jaggard , D. L. Expert report of Dwight L. Jaggard (redacted) - expert witness retained by Fractus. Fractus. February 23, 2011

Kyriacos , S. ; Buczkowski , S. et al. A modified box-counting method. Fractals - World Scientific Publishing Company. January 1, 1994

NA Applications of IE3D in designing planar and 3D antennas - Release 15.0. Mentor Graphics. January 1, 2010

NA Document 0423 - Fractus SA's Opening Claim Construction Brief with Parties' Proposed and Agreed Constructions in the case of Fractus SA v. Samsung Electornics Co. Ltd. et al.. Susman Godfrey. July 16, 2010

NA Document 0666 - Fractus's sur-reply to defendants' motion for reconsideration of the court's december 17, 2010 claim construction order based on newly-available evidence. Susman Godfrey. March 8, 2011

NA Document 0670 - Order. Court. March 9, 2011

NA Document 0678 - Plaintiff Fractus SA's answer to second amended counterclaims of defendant HTC Corporation to Fractus's second amended complaint. Susman Godfrey. March 14, 2011

NA Document 0680 - Plaintiff Fractus SA's answer to second amended counterclaims of defendant HTC to Fractus's second amended complaint. Susman Godfrey. March 14, 2011

NA Document 0694 - Plaintiff Fractus SA's answer to second amended counterclaims of defendant LG Electronics to Fractus's second amended complaint. Susman Godfrey. March 15, 2011

NA Document 0695 - Plaintiff Fractus SA's answer to second amended counterclaims of defendant Samsung to Fractus's second amended complaint. Susman Godfrey. March 15, 2011

NA Document 0696 - Plaintiff Fractus SA's answer to amended counterclaims of defendant Pantech Wireless Inc to Fractus's second amended complaint. Susman Godfrey. March 15, 2011

Davis, L. Document 0783 - Order. Court. April 1, 2011

NA FCC - United States table of frequency allocations. Federal Communications Commission. October 1, 1999

NA Fractal Antenna - Frequently asked questions. Fractal Antenna Systems INC.. January 1, 2011

NA IE3D User´s Manual. Mentor Graphics. January 1, 2010

Barnsley , M. Fractals Everywhere. Academic Press Professional. January 1, 1993

Wheeler , H. A. Small antennas. Antennas and Propagation , IEEE Transactions. July 1, 1975

NA United States Table of Frequency allocations - The Radio Spectrum. United States Department of Commerce. March 1, 1996

Nguyen , H. V. US12/498090 - Notice of Allowance dated on March 10, 2011. USPTO. March 10, 2011

Peitgen , H. Chaos and fractals : New frontiers of science. Springer. January 1, 1992

Rumsey , V. Frequency independent antennas - Full. Academic Press. January 1, 1966

Sterne , R. G. US95/001390 - Response to the Office Action for the US patent 7015868 dated on August 19, 2010. Sterne, Kessler, Goldstein & Fox PLLC. November 19, 2010

Greene , R. US95/001414 - Corrected Patent Owner´s Response to Office Action of October 8, 2010 of US patent no. 7202822. Sterne Kessler Goldstein. April 11, 2011

Harrington , R.F. Effect of antenna size on gain, bandwidth, and efficiency. Journal of Research of the National Bureau of Standards - D. Radio Propagation. January 1, 1960

Lee , M. US95/001413 - US95/000593 - US95/000598 - Corrected Patent Owner´s Response to First Office Action of October 8, 2010 of US patent no. 7148850. Stene, Kessler, Goldstein & Fox P.L.L.C.. April 11, 2011

Lee , M. US95/001413 - US95/000593 - US95/000598 - Corrected Patent Owner´s Response to First Office Action of October 8, 2010 of US patent no. 7148850 - Exhibit 1. Sterne Kessler. April 11, 2011

Bhavsar , S. A. Document 0641 - Defendant HTC America, Inc's second amended answer and counterclaim to plaintiff's second amended complaint. Defendants. February 25, 2011

Bhavsar , S. A. Document 0642 - Defendant HTC Corporation's second amended answer and counterclaim to plaintiff's second amended complaint. Defendants. February 25, 2011

Tribble, M. L. Document 0715 - Letter to John D. Love - Permission to file a summary judgment motion of no indefiniteness on the issues wher the Court's Report and Recommendation already has held that the claim term is not indefinite. Susman Godfrey. March 18, 2011

Tribble , M. L. Document 0716 - Letter to John D. Love - Permission to file a partial summary judgement motion on infringement.. Susman Godfrey , LLP. March 18, 2011

Sirota, N. Document 0721 - Letter to John D. Love - Permission to file a motion for summary judgment of invalidity of the following 7 asserted claims from the MLV, patent family.... Defendants - Baker Botts, LLP. March 18, 2011

Howe , M. Document 0768 - Fractus, S.A.'s objections to the Court's March 9, 2011, Order. Susman Godfrey. March 25, 2011

Jones, Michael E. Document 0780 - Defendants' opposition to Fractus SA objections to the Court's March 9, 2011 Order. Defendants - Baker Botts, LLP. March 31, 2011

NA Document 0841 - Stipulation of Dismissal of all Claims and Counterclaims re '850 and '822. Defendants. April 15, 2011

NA Document 0843 - Joint Motion to Dismiss Claims and Counterclaims re '850 and '822. Defendants. April 15, 2011

NA Document 0854 - Defendants' Motion to Clarify Claim Construction. Defendants. April 18, 2011

Love , J. D. Document 0868 - Order. Court. April 19, 2011

Behncke , M. Document 0876 - Fractus's surreply to defendants' Motion for Summary Judgment re publication dates of three references. Susman Godfrey. April 20, 2011

Howe , M. Document 0887 - Fractus's Response to Defendants' Motion to Clarify Claim Construction. Susman Godfrey. April 25, 2011

NA Document 0889 - Reply in support of defendants' motion to clarify claim construction. Defendants. April 27, 2011

Love , J. D. Document 0901 - Report and recommendation of United States Magistrate Judge. Court. May 2, 2011

Howe , M. Document 0902 - Fractus SA's objections to defendants' prior art notice. Susman Godfrey. May 2, 2011

Sirota , N. Document 0915 - Defendants' response to plaintiff's objections to defendants notice of prior art. Defendants. May 5, 2011

NA Document 0933 - Defendants' motion for reconsideration of, and objections to, the May 2, 2011 report and recommendation clarifying claim construction. Defendants. May 9, 2011

Howe , M. Document 0939 - Fractus's response to defendants' motion for reconsideration of and objections to the May 2, 2011, report and recommendations clarifying claim construction. Susman Godfrey. May 10, 2011

NA US95/001413 - US95/000593 - US95/000598- Third party requester's comments to patent owner's reply dated on April 11, 2011 for US patent 7148850. Samsung. May 2, 2011

NA US95/001413 - US95/000593 - US95/000598- Third party requester's comments to patent owner's reply dated on January 10, 2011 for US patent 7148850. Samsung. February 9, 2011

NA US95/001414 - Third party requester's comments to patent owner's reply dated on January 10, 2011 for US patent 7202822. Samsung. February 9, 2011

NA Document 0428 - Response of defendants Kyocera Communications, Inc; Palm Inc. and UTStarcom, Inc. to plaintiff Fractus SA's opening claim construction brief in "Case 6:09-cv-00203-LED-JDL". Defendants. July 30, 2010

NA Document 0430 - Defendants RIM, Samsung, HTC, LG and Pantech's response to plaintiff Fractus SA's opening claim construction brief. Defendants. July 30, 2010

Borja , C. Fractal microstrip antennas : Antenas fractales microstrip. Universitat Politecnica de Catalunya. July 1, 1997

Addison , P. S. Fractals and chaos. Institute of Physics Publishing. January 1, 1997

Addison , P. S. Fractals and chaos - An illustrated course. Institute of Physics Publishing. January 1, 1997

Verdura, O. Miniature fractal antenna : Antena fractal miniatura. Universitat Politecnica de Catalunya. September 1, 1997

Chen , X. ; Ying , Z. Small Antenna Design for Mobile Handsets (part I). Sony Ericsson. March 25, 2009

Walker , B. US12/498090 - Response to office action dated on August 18, 2010. Howison & Arnott. January 17, 2011

NA Document 0440 - Fractus's opposition to defendants' motion for summary judgement of invalidity based on indefiniteness and lack of written description for certain terms. Susman Godfrey. August 16, 2010

NA Document 0440-1 - Expert declaration by Dr. D. Jaggard including exhibits (curriculum and datasheets from Cushcraft, Antenova, Ethertronics and Taoglas). Susman Godfrey. August 16, 2010

NA Document 0452 - Defendant's reply in support of their motion for summary judgment of invalidity based on indefiniteness and lack of written description for certain terms with exhibits WW, BBB, EEE, GGG, HHH, III, KKK, MMM, NNN, OOO, PPP, Q. Defendants. August 30, 2010

Baxter , J. Document 0429 - Declaration of Jeffery D. Baxter - Including Exhibits: J, K, L, M ,N ,O, P, Q, R, S, T, U, Z, AA, KK, LL. Defendants. July 30, 2010

Howe , M. Document 0440-2 - Declaration of Micah Howe in support of Fractus SA opposition to defendants' motion for summary judgement of invalidity based on indefiniteness and lack of written description for certain terms. Heim , Payne and Chorus LLP. August 16, 2010

NA European Patent Convention - Article 123 - Declaration of Jeffery D. Baxter - Exhibit JJJ. European Patent Office. January 1, 2000

Howe , M. Document 0893 - Fractus SA's surreply to defendant's motion to clarify claim construction. Susman Godfrey. April 29, 2011

Love , J. D. Document 0900 - Order. Court. April 29, 2011

Davis , L. Document 0968 - Order. Court. May 13, 2011

Davis, L. Document 0971 - Order. Court. May 13, 2011

Falconer , K. Fractal geometry _Full. John Wiley Sons - 2nd ed.. January 1, 2003

Carpintero , F. PCT/ES99/00296 - Reply to the Written Opinion dated on November 15, 2001 - Declaration of J. Baxter - Exhibit FFF -. Herrero & Asociados. November 15, 2001

Falconer , K. Fractal Geometry: Mathematical Foundations and Applications. John Wiley & Sons. January 1, 1990

Laufer , P. M. US95/001413 - US95/000593 - US95/000598 - Decision Sua Sponte to merge reexamination proceedings of US patent 7148850. USPTO. June 8, 2011

Laufer , P. M. US95/000592 - US95/000610 - US95/001414 - Decision Sua Sponte to merge reexamination proceedings of US patent 7202822. USPTO. June 7, 2011

Nguyen , L. M. US95/000592 - US95/000610 - US95/001414 - Office Action of US patent 7202822 dated July 29, 2011. UPSTO. July 29, 2011

Nguyen , L. M. US95/001413 - US95/000598 - US95/000593 - Office Action of US patent 7148850 dated July 29, 2011. USPTO. July 29, 2011

NA Transcript of jury trial before the Honorable Leonard Davis - May 18, 2011 - 1:00 PM. Court. May 18, 2011

NA Transcript of jury trial before the Honorable Leonard Davis - May 18, 2011 - 8:45 AM. Court. May 18, 2011

NA Transcript of jury trial before the Honorable Leonard Davis - May 19, 2011 - 1:00 PM. Court. May 19, 2011

NA Transcript of jury trial before the Honorable Leonard Davis - May 19, 2011 - 8:45 AM. Court. May 19, 2011

NA Transcript of jury trial before the Honorable Leonard Davis - May 20, 2011 - 12:30 PM. Court. May 20, 2011

NA Transcript of jury trial before the Honorable Leonard Davis - May 20, 2011 - 8:30 AM. Court. May 20, 2011

NA Transcript of jury trial before the Honorable Leonard Davis - May 23, 2011 - 8:55 AM. Court. May 23, 2011

NA Transcript of jury trial before the Honorable Leonard Davis US District Judge - May 17, 2011 - 8:00 AM. Court. May 17, 2011

NA Transcript of jury trial before the Honorable Leonard Davis, US District Judge - May 17, 2011 - 1:10 PM. Court. May 17, 2011

NA Transcript of pretrial hearing before the Honorable Leonard Davis, US District Judge - May 16, 2011 - 2:00 PM. Court. May 16, 2011

Peitgen , H. ; Saupe , D. The science of fractal images. Springer-Verlag. January 1, 1988

NA US95/001413 - US95/000593 - Third party requester's comments to patent owner's response of October 31, 2011 for US patent 7148850. Defendants. March 23, 2012

NA US95/001413 - US95/000593 - US95/000598 - Patent owner´s response to first office action for US patent 7148850 of July 29, 2011. Sterne, Kessler, Goldstein & Fox. October 31, 2011

NA US95/001414 - US95/000592 - US95/000610 - Patent owner´s response to first office action of July 29, 2011 of US patent 7202822. Sterne, Kessler , Goldstein & Fox. October 31, 2011

NA US95/001414 - US95/000592 - US95/000610 - Third party requester's comments to patent owner's response of October 31, 2011 for US patent 7202822. Defendants. March 23, 2012

Jaggard , D. L. The oral and videotaped deposition of Dwight Jaggard. Volume 1. Defendants. March 8, 2011

Jaggard , D. L. The oral and videotaped deposition of Dwight Jaggard. Volume 2. Defendants. March 9, 2011

Jaggard , D. L. The oral and videotaped deposition of Dwight Jaggard. Volume 3. Defendants. March 10, 2011

Nguyen , H. V. US13/020034 - Office Action dated on November 8, 2011. USPTO. November 8, 2011

Nguyen , H. V. US13/038883 - Office action dated on December 1, 2011. USPTO. December 1, 2011

Nguyen , H. V. US13/044207 - Office action dated on December 5, 2011. USPTO. December 5, 2011

Oral and videotaped deposition of Dr. Stuart Long - Volume 1. . March 11, 2011

Oral and videotaped deposition of Dr. Stuart Long - Volume 2. Fractus. March 13, 2011

Oral and videotaped deposition of Dr. Stuart Long - Volume 3. Fractus. March 14, 2011

Oral and videotaped deposition of Dr. Warren L. Stutzman - Volume 1. Fractus. March 3, 2011

Oral and videotaped deposition of Dr. Warren L. Stutzman - Volume 2. Fractus. March 4, 2011

Qiu , Jianming et al. A planar monopole antenna design with band-notched characteristic. IEEE Transactions on antennas and propagations. January 1, 2006

CN01823716 - Response to the office action dated on September 21, 2007. CCPIT Patent and Trademark Law Office - Chinese Patent Office. December 3, 2007

Stutzman , W. L. Expert report of Dr. Warren L. Stutzman (redacted) - expert witness retained by Fractus. Fractus. February 23, 2011

Long , S. Expert report of Stuart Long (redacted) - expert witness retained by Fractus. Fractus. February 23, 2011

Velasco , J. T. US10/371676 - Amendment and response to final rejection dated on October 06, 2001. Kyocera Wireless Corp.. December 3, 2004

Peitgen , H. O. et al Chaos and fractals. Springer-Verlag. January 1, 1992

Peitgen , H. O. et al Chaos and fractals. Springer-Verlag. January 1, 1992

Durgun , A. C. ; Reese , M. S. ; Balanis , C. A. et al Flexible bow-tie antennas with reduced metallization. IEEE Radio and Wireless Symposium (RWS). January 16, 2011

Walker , B. US12/498090 - Amendment and response to office action dated December 30, 2011. Howison & Arnott. April 3, 2012

Nguyen , H. V. US12/498090 - Office action dated on December 30, 2011. USPTO. December 30, 2011

Walker , B. US13/020034 - Amendment and response to office action dated on November 8, 2011. Howison & Arnott. April 3, 2012

Walker , B. US13/038883 - Amendment and response to office action dated December 1, 2011. Howison & Arnott. April 3, 2012

Walker , B. US13/044207 - Amendment and response to office action dated on December 5, 2011. Howison & Arnott. April 3, 2012

Jaggard , D. L. Expert report of Dwight L. Jaggard (redacted) - expert witness retained by Fractus. Fractus. February 23, 2011

Nguyen , L. M. US95/001413 - US95/000593 - Action Closing Prosecution dated on April 20, 2012 for US patent 7148850. USPTO. April 20, 2012

Nguyen , L. M. US95/001414 - 95/000592 - Action Closing Prosecution dated on April 20, 2012 for US patent 7202822. USPTO. April 20, 2012

US PATENTS

| PATENT NO. | PUBLICATION DATE | APPLICANT/ INVENTOR |
|---|---|---|
| 3521284 | 1970-07-21 | Shelton et al |
| 3599214 | 1971-08-10 | Altmayer |
| 3622890 | 1971-11-23 | Fujimoto |
| 3683379 | 1972-08-08 | Saddler |
| 3818490 | 1974-06-18 | Leahy |
| 3967276 | 1976-06-29 | Goubau |
| 3969730 | 1976-07-13 | Fuchser |
| 4021810 | 1977-05-03 | Urpo et al |
| 4024542 | 1977-05-17 | Ikawa et al. |
| 4072951 | 1978-02-07 | Kaloi |
| 4131893 | 1978-12-26 | Munson et al |
| 4141016 | 1979-02-20 | Nelson |
| 4381566 | 1983-04-26 | Kane |
| 4471358 | 1984-09-11 | Glasser |
| 5712640 | 1998-01-27 | Andou et al |
| 6333719 | 2001-12-25 | Varadan |
| 5363114 | 1994-11-08 | Shoemaker |
| 6011518 | 2000-01-04 | Yamagishi , H. |
| 7511675 | 2009-03-31 | Puente , Carles ; Rozan , Edouard ; Anguera , Jaume ; Martinez Ortigosa , Enrique |
| 3079602 | 1963-02-26 | Du Hamel |
| 3689929 | 1972-09-05 | Moody |
| 4038662 | 1977-07-26 | Turner |
| 4318109 | 1982-03-02 | Weathers |
| 4356492 | 1982-10-26 | Kaloi |
| 4536725 | 1985-08-20 | Hubler |
| 4608572 | 1986-08-26 | Blakney |
| 4860019 | 1989-08-22 | Jiang |
| 5307075 | 1994-04-26 | Huynh |
| 5453752 | 1995-09-26 | Wang |
| 5557293 | 1996-09-17 | McCoy |
| 5608417 | 1997-03-04 | De Vall |
| 5809433 | 1998-09-15 | Thompson |
| 5918183 | 1999-06-29 | Janky |
| 5926139 | 1999-07-20 | Korisch |
| 5929825 | 1999-07-27 | Niu , F. et al. |
| 5936587 | 1999-08-10 | Gudilev |
| 6011699 | 2000-01-04 | Murray |
| 6094179 | 2000-07-25 | Davidson |
| 6097339 | 2000-08-01 | Filipovic |
| 6122533 | 2000-09-19 | Zhang et al. |
| 6130651 | 2000-10-10 | Yanagisawa et al. |
| 6140966 | 2000-10-31 | Pankinaho |
| 6141540 | 2000-10-31 | Richards et al. |
| 6147655 | 2000-11-14 | Roesner , B. B. |
| 6166694 | 2000-12-26 | Ying |
| 6195048 | 2001-02-27 | Chiba et al. |
| 6198442 | 2001-03-06 | Rutkowski |

| | | |
|---|---|---|
| 6201501 | 2001-03-13 | Arkko et al. |
| 6204826 | 2001-03-20 | Rutkowski et al. |
| 6211826 | 2001-04-03 | Aoki |
| 6215474 | 2001-04-10 | Shah |
| 6236366 | 2001-05-22 | Yamamoto et al. |
| 6259407 | 2001-07-10 | Tran |
| 6288680 | 2001-09-11 | Tsuru et al. |
| 6352434 | 2002-03-05 | Emmert |
| 6366243 | 2002-04-02 | Isohatala |
| 6384790 | 2002-05-07 | Dishart et al. |
| 6396444 | 2002-05-28 | Goward |
| 7148850 | 2006-12-12 | Puente et al. |
| 4827271 | 1989-05-02 | Berneking |
| 3683376 | 1972-08-08 | Pronovost |
| 6028567 | 2000-02-22 | Lahti |
| 6087990 | 2000-07-11 | Thill et al. |
| 6664932 | 2003-12-16 | Sabet et al. |
| 6831606 | 2004-12-14 | Sajadinia |
| 7202822 | 2007-04-10 | Carles Puente, Edouard Jean Louis Rozan, Jaume Anguera Pros |
| 5410322 | 1995-04-25 | Sonoda |
| 7015868 | 2006-03-21 | Carles Puente, Jaume Anguera, Carmen Borja, Jordi Soler |
| 7123208 | 2006-10-17 | Puente, Borja, Anguera, Soler |
| 7394432 | 2008-07-01 | Puente , C. ; Borja , C. ; Anguera , J. ; Soler , J. |
| 7397431 | 2008-07-08 | Puente , C. ; Borja , C. ; Anguera , J. ; Soler , J. |
| 7528782 | 2009-05-05 | Puente , C. ; Borja , C. ; Anguera , J. ; Soler , J. |
| 6266538 | 2001-07-24 | Waldron |
| 5790080 | 1998-08-04 | Apostolos |

US PATENT APPLICATION PUBLICATIONS

| PUBLICATION NO. | PUBLICATION DATE | APPLICANT/ INVENTOR |
|---|---|---|
| 2002/0190904 | 2002-12-19 | Cohen |
| 2005/0195112 | 2005-09-08 | Puente et al. |
| 2002/0140615 | 2002-10-03 | Carles Puente, Jordi Romeu, Carmen Borja, Jaume Anguera, Jordi Soler |

FOREIGN REFERENCES

| PATENT/ PUBLICATION NO. | COUNTRY | PUBLICATION DATE | APPLICANT/ INVENTOR |
|---|---|---|---|
| 2215136 | GB | 1989-09-13 | Ronald Cecil Hutchins |
| 2224466 | CN | 1996-04-10 | Huaan Science & Technology SER |
| 0590671 | EP | 1993-09-30 | Kabushiki Kaisha Toshiba |
| 0749176 | EP | 2002-09-18 | Nokia Corporation |
| 0902472 | EP | 1999-03-17 | Microchip Technology Inc. |
| 2317994 | GB | 1998-04-08 | Nortel Patents |
| 05-308223 | JP | 1993-11-19 | Toshiba Corp. |
| 06-085530 | JP | 1994-03-25 | Sony Corp. |
| 10-163748 | JP | 1998-06-19 | Kyocera Corp |
| 10-303637 | JP | 1998-11-13 | HARADA IND CO LTD |
| 11-004113 | JP | 1999-01-06 | Murata MFG CO LTD |
| 11-027042 | JP | 1999-01-29 | Denki Kogyo Co. Ltd. |
| 11136015 | JP | 1999-05-21 | Alps Electronic |
| 11-220319 | JP | 1999-08-10 | Sharp |
| 1997-246852 | JP | 1997-09-19 | NEC Corp. |
| 6252629 | JP | 1994-09-09 | Sony Corp. |
| 00/67342 | WO | 2000-11-09 | Nokia Mobile Phones Limited |
| 88/09065 | WO | 1988-11-17 | COLEMAN |
| 98/05088 | WO | 1998-02-05 | Motorola Inc |
| 98/20578 | WO | 1998-05-14 | Samsung Electronics Co. |
| 99/65102 | WO | 1999-12-16 | E.I. du Pont de Nemours and Company |
| 01/31747 | WO | 2001-05-03 | Fractus, SA |
| 1223637 | EP | 2005-03-30 | Fractus, SA |
| 1258054 | EP | 2002-11-20 | Fractus |
| 1592083 | EP | 2000-01-19 | Fractus |
| 972897 | FI | 1999-01-09 | Nokia |
| 0253608 | EP | 1988-01-20 | British Broadcasting Corporation |

UNITED STATES PATENT AND TRADEMARK OFFICE

CERTIFICATE OF CORRECTION

PATENT NO. : 8,212,726 B2
APPLICATION NO. : 12/347462
DATED : July 3, 2012
INVENTOR(S) : Carles Puente Baliarda, Edouard Jean Louis Rozan and Jaume Anguera Pros It is certified that error appears in the above-identified patent and that said Letters Patent is hereby corrected as shown below:

In the Claims

Claims should read as follows:

Column 9, Claim 14, lines 7-10. The apparatus as set forth in claim 1, wherein the apparatus is a portable communications device that operates in at least three cellular telephone system frequency bands.

Column 9, Claim 23, lines 36-38. The apparatus as set forth in claim 1, wherein the first and second non-overlapping frequency bands respectively include GSM 850 and PCS 1900.

Column 9, Claim 26, lines 44-45. The apparatus as set forth in claim 25, wherein the second frequency band comprises 900 MHz.

Column 10, Claim 34, lines 19-21. The antenna as set forth in claim 33, wherein the antenna radiates across each of at least three cellular telephone system frequency bands.

Column 10, Claim 49, lines 55-57. The antenna as set forth in claim 33, wherein the antenna radiates across each of at least four cellular telephone system frequency bands.

Column 11, Claim 53, lines 1-4. The antenna as set forth in claim 33, wherein the antenna radiates and receives electromagnetic waves across each of at least five cellular telephone system frequency bands.

Column 11, Claim 57, lines 14-16. The antenna as set forth in claim 33, wherein the antenna operates in a first frequency band that comprises 1800 MHz.

Column 11, Claim 58, lines 18-20. The antenna as set forth in claim 57, wherein the antenna operates in a second frequency band that comprises 1900 MHz.

Signed and Sealed this
Twenty-fourth Day of June, 2014

Michelle K. Lee

Michelle K. Lee
*Deputy Director of the United States Patent and Trademark Office*

Column 11, Claim 62, lines 31-33. The antenna as set forth in claim 33, wherein the antenna operates in a first frequency band that comprises 850 MHz and in a second frequency band that comprises 900 MHz.

Column 11, Claim 64, lines 39-62. An apparatus, comprising: a single antenna having a surface that radiates and receives electromagnetic waves, an entirety of an edge enclosing the surface shaped as a substantially non-periodic curve; said curve comprises a set of multiple bends, with the distance between each pair of adjacent bends within said set being shorter than a tenth of a longest operating wavelength of the single antenna; said curve is shaped so that the arrangement of said set of multiple bends is not self-similar with respect to the entire curve, and said curve has a physical length larger than that of any straight line that can be fitted in the same area in which said curve can be arranged; and the single antenna simultaneously receives electromagnetic waves of at least a first and a second operating wavelength and also radiates at multiple different operating wavelength, the first operating wavelength corresponds to an operating wavelength within a first frequency band of a first cellular telephone system and the second operating wavelength corresponds to an operating wavelength within a second frequency band of a second cellular telephone system, the first and second frequency bands being non-overlapping.

Column 13, Claim 90, lines 5-7. The apparatus as set forth in claim 65, wherein the at least one of the three cellular telephone system frequency bands is UMTS frequency band.

Column 13, Claim 98, lines 51-53. The apparatus as set forth in claim 97, wherein the single antenna radiates across each of at least three cellular telephone system frequency bands.

Column 14 and 15, Claim 125. The antenna as set forth in claim 98, wherein said curve features a box-counting dimension larger than 1.2; and wherein the box-counting dimension is computed as the slope of a substantially straight portion of a line in a log-log graph over at least an octave of scales on the horizontal axes of the log-log graph.